US012006677B2

(12) United States Patent
Stokes et al.

(10) Patent No.: US 12,006,677 B2
(45) Date of Patent: Jun. 11, 2024

(54) LINEAR DRAIN ASSEMBLY

(71) Applicant: Kohler Co., Kohler, WI (US)

(72) Inventors: Andrew J. Stokes, Mazomanie, WI (US); Vikas Salunke, Kohler, WI (US)

(73) Assignee: KOHLER CO.

( * ) Notice: Subject to any disclaimer, the term of this patent is extended or adjusted under 35 U.S.C. 154(b) by 478 days.

(21) Appl. No.: 17/230,263

(22) Filed: Apr. 14, 2021

(65) Prior Publication Data

US 2021/0381216 A1 Dec. 9, 2021

Related U.S. Application Data

(60) Provisional application No. 63/109,960, filed on Nov. 5, 2020, provisional application No. 63/034,258, filed on Jun. 3, 2020.

(51) Int. Cl.
*E03F 5/04* (2006.01)
*E03F 5/06* (2006.01)

(52) U.S. Cl.
CPC ..... *E03F 5/0408* (2013.01); *E03F 5/0404* (2013.01); *E03F 2005/0413* (2013.01); *E03F 5/06* (2013.01)

(58) Field of Classification Search
CPC ..... E03F 5/0408; E03F 5/0404; E03F 5/06; E03F 2005/0413; E03F 3/046; E03F 5/04
See application file for complete search history.

(56) References Cited

U.S. PATENT DOCUMENTS

| | | | | |
|---|---|---|---|---|
| 5,340,234 | A | 8/1994 | Rossi et al. | |
| 6,155,015 | A | 12/2000 | Kirby | |
| 6,870,413 | B1 | 3/2005 | Chang et al. | |
| 8,239,974 | B2 * | 8/2012 | Erlebach | E03F 5/04 4/290 |
| 8,850,633 | B2 | 10/2014 | Erlebach | |
| 9,334,638 | B1 * | 5/2016 | Kirby | A47K 3/40 |
| 9,382,701 | B2 | 7/2016 | Meyers | |
| 9,644,363 | B2 | 5/2017 | Meyers | |
| 10,105,017 | B2 | 10/2018 | Clear et al. | |
| 10,544,576 | B2 | 1/2020 | Ismert et al. | |
| 2007/0045863 | A1 | 3/2007 | Hsieh et al. | |
| 2009/0119831 | A1 | 5/2009 | Grave et al. | |
| 2011/0047695 | A1 * | 3/2011 | Niedens | E03F 5/04 4/679 |
| 2016/0281346 | A1 | 9/2016 | Clear et al. | |
| 2018/0038091 | A1 * | 2/2018 | Ismert | E03F 5/0401 |

(Continued)

FOREIGN PATENT DOCUMENTS

| | | |
|---|---|---|
| GB | 2 431 341 | 4/2007 |
| WO | WO-2007/045863 | 4/2007 |

OTHER PUBLICATIONS

Extended European Search Report on EP Appl. Ser. No. 21176394.1 dated Nov. 9, 2021 (6 pages).

*Primary Examiner* — Christine J Skubinna

(74) *Attorney, Agent, or Firm* — FOLEY & LARDNER LLP

(57) ABSTRACT

A linear drain assembly is provided. The linear drain assembly includes a base portion and a first peripheral portion. The base portion includes a base trough and a base flange. The first peripheral portion includes a first trough and a first flange. The first trough is nested within the base trough and the base flange is nested within the first flange.

19 Claims, 35 Drawing Sheets

(56) References Cited

U.S. PATENT DOCUMENTS

| | | | |
|---|---|---|---|
| 2019/0106874 | A1 | 4/2019 | Brill et al. |
| 2019/0211540 | A1 | 7/2019 | Bernoti |
| 2019/0211541 | A1 | 7/2019 | Brill et al. |

* cited by examiner

LINEAR DRAIN ASSEMBLY

CROSS-REFERENCE TO RELATED PATENT APPLICATIONS

This application claims the benefit of and priority to U.S. Provisional Application No. 63/034,258, filed on Jun. 3, 2020, and U.S. Provisional Application No. 63/109,960, filed on Nov. 5, 2020, the entire disclosures of which are hereby incorporated by reference herein.

BACKGROUND

The present disclosure relates generally to drainage devices. More specifically, the present disclosure relates to a linear drain for use in an environment where fluids, such as rain water, pool water, or water from a shower, are drained.

SUMMARY

At least one embodiment relates to a linear drain assembly. The linear drain assembly includes a base portion and a first peripheral portion. The base portion includes a base trough and a base flange. The first peripheral portion includes a first trough and a first flange. The first trough is nested within the base trough and the base flange is nested within the first flange.

Another embodiment relates to a linear drain assembly. The linear drain assembly includes a base portion and a first peripheral portion. The base portion includes a first base end, a second base end, and a base trough extending between the first base end and the second base end. The base portion further includes an outlet body in fluid communication with the base trough and extending away from the base portion in a first direction. The first peripheral portion includes a first peripheral end, a second peripheral end, a first wall, a second wall, and a third wall defining a first trough, and a first flange extending away from the first trough and defining a first flange width, the first flange width greater than the base flange width.

Another embodiment relates to a method of assembling a linear drain assembly. The method includes positioning a first peripheral portion within a base portion; sliding the first peripheral portion within the base portion to a desired position; coupling the first peripheral portion to the base portion; cutting a drain grate to fit within the first peripheral portion and the base portion; and positioning the drain grate within both the first peripheral portion and the base portion.

This summary is illustrative only and is not intended to be in any way limiting.

BRIEF DESCRIPTION OF THE FIGURES

The disclosure will become more fully understood from the following detailed description, taken in conjunction with the accompanying figures, wherein like reference numerals refer to like elements, in which.

Figure 1:
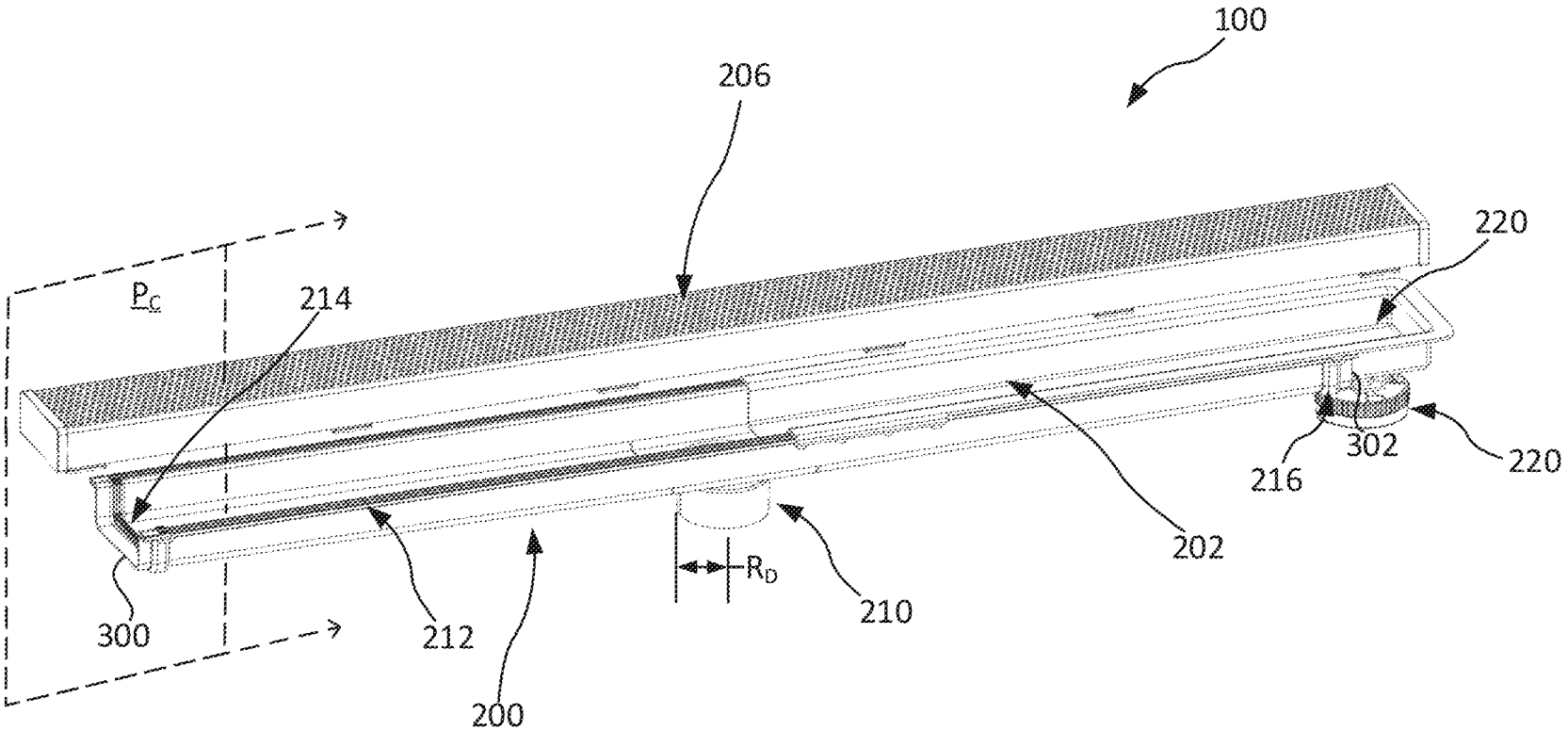
FIG. 1 is an exploded partial view of a linear drain assembly, according to an exemplary embodiment.

It will be recognized that some or all of the FIGURES are schematic representations for purposes of illustration. The FIGURES are provided for the purpose of illustrating one or more implementations with the explicit understanding that they will not be used to limit the scope or the meaning of the claims.

DETAILED DESCRIPTION

Before turning to the FIGURES, which illustrate certain exemplary embodiments in detail, it should be understood that the present disclosure is not limited to the details or methodology set forth in the description or illustrated in the FIGURES. It should also be understood that the terminology used herein is for the purpose of description only and should not be regarded as limiting. Below are more detailed descriptions of various concepts related to, and implementations of, methods, apparatuses, and assemblies for the egress of fluids, typically waste fluids, such as gray water. The various concepts introduced above and discussed in greater detail below may be implemented in any of a number of ways, as the described concepts are not limited to any particular manner of implementation. Examples of specific implementations and applications are provided primarily for illustrative purposes.

Generally speaking, conventional linear drains have a fixed length. For applications of a linear drain in a shower enclosure or shower environment, the shower enclosure must be built and dimensioned to accommodate the fixed length of the linear drain in order to comply with local codes. Thus, it may be desirable to provide a linear drain that has a length that may be adjusted to fit into a variety of shower enclosures and shower environments having different sizes.

In addition, linear drains are typically installed in a floor, such as in a shower or bathing environment, by creating a mortar bed (also referred to as a cement bed or a mud bed) that extends the length of a drain channel of the linear drain, and by backfilling the underside of the drain channel. The mortar bed is used to level the linear drain, and to provide support for the linear drain. In some settings, it may be desirable to level the linear drain prior to providing a mortar bed to, for example, ensure that the linear drain, when leveled, still fits within the environment in which it is placed. Additionally, leveling the linear drain once the mortar bed is in place may introduce added obstacles. For example, if not enough mortar is applied and ends of the linear drain sag, mortar may need to be backfilled underneath the linear drain while simultaneously leveling the linear drain. Also, mortar may shrink as it dries, such that the linear drain may shift and become unleveled once the mortar bed is dry. Thus, there exists a desire to include a device capable of leveling the linear drain without mortar and providing an amount of certainty in the leveling of the drain as the mortar dries.

In addition, linear drains typically include an outlet in the center and are configured for use in a shower environment having drainage plumbing (e.g., a drain opening) in the center of the floor (e.g., equidistant between two walls). Thus, is can be difficult to install a linear drain in a pre-existing shower cell, such as for updating or remodeling a shower cell in an older or out-of-date home. Thus, there exists a desire for a linear drain having an outlet that may be selectively positioned off-center (e.g., not equidistant between two sidewalls of a shower cell). Similarly, there exists a desire for a linear drain where the outlet may be repositioned on-site, such as for a user who inaccurately measures the distances of the floor opening.

As will be discussed in greater detail below, disclosed herein is a linear drain assembly (e.g., linear drain system) that may include a base portion having peripheral portions coupled to the two ends of the base portion. The base portion and the two peripheral portions define a trough configured to receive a flow of water. A drain grate may be positioned within the trough. The linear drain assembly has a length that may be adjusted by sliding the two peripheral portions toward one another and away from one another. The length of the linear drain assembly may be adjusted without cutting any of the base portion or the two peripheral portions, as compared to most conventional linear drains. The linear drain assembly may include a gasket or sealing member interposed between the base portion and the two peripheral portions that forms a watertight seal regardless of the final (e.g., total) length of the linear drain assembly. Thus, an outlet of the linear drain assembly may be positioned such that the outlet is not centered in the middle of the linear drain assembly, but is rather located closer to one end than the other end. In this manner, the linear drain may be installed in a retrofit application in a shower enclosure where the opening for the drain is not centered between two walls. The linear drain assembly may be configured to be used with the pre-existing opening for the drain while the linear drain assembly still extends wall-to-wall within the shower enclosure and provides an aesthetic that may be desirable. The adjustability of the linear drain assembly avoids having to reroute drain plumbing that does not open up in the center of a shower enclosure or shower environment.

Referring now to FIG. 1, an exploded, partial view of the linear drain assembly 100 is shown according to an exemplary embodiment. The linear drain assembly 100 includes a base portion 200 (e.g., first portion, etc.), a first peripheral portion 202, a second peripheral portion 204 (not shown), and a drain grate 206. Generally speaking, the base portion 200 is configured to receive the first peripheral portion 202 and the second peripheral portion 204 such that a watertight trough 101 is formed. Extending substantially orthogonally away from the linear drain assembly 100 may be an annular body, shown as an outlet body 210. A flow of water, such as from a shower head or pool overflow, may enter the trough through the drain grate 206 and flow toward the outlet body 210. The outlet body 210 may be coupled to a drain pipe configured to receive water from the linear drain assembly 100 and carry the water away from the linear drain assembly 100. The outlet body 210 defines a radius, shown as a drain radius $R_D$. The linear drain assembly 100 may also be longitudinally bisected (e.g., split in two lengthwise) by a plane, shown as a central plane $P_C$. From herein, the central plane $P_C$ will be used as a geometric reference point.

In some embodiments, the linear drain assembly 100 may include a sealing member, such as a gasket 212. The gasket 212 may be positioned between the base portion 200 and the first peripheral portion 202, and the gasket 212 is configured to form a substantially watertight seal with both the base portion 200 and the first peripheral portion 202.

Figure 2:
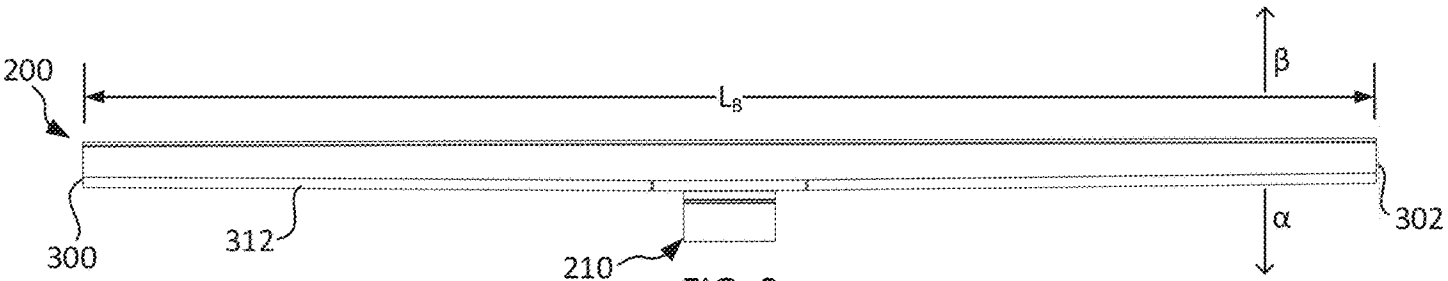
FIG. 2 is a front view of a portion of the linear drain assembly of FIG. 1, according to an exemplary embodiment.
Figure 3:
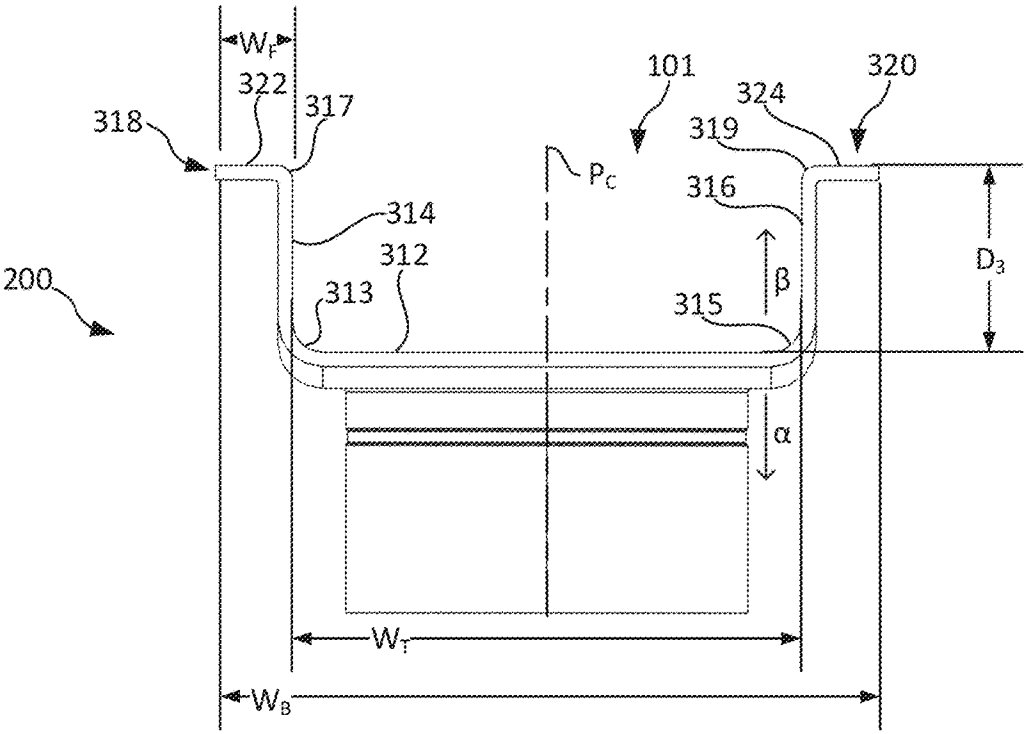
FIG. 3 is a side view of the portion of the linear drain assembly of FIG. 2, according to an exemplary embodiment.

Turning to FIGS. 2 and 3, the base portion 200 is shown according to an exemplary embodiment. The base portion 200 defines a first base end 300 and a second base end 302 separated by a distance, shown as a base length $L_B$. In some embodiments, the base length $L_B$ is approximately (e.g., within ±5%) 30 inches. However, it should be appreciated that the base length may be most any length to accommodate the environment in which the linear drain assembly 100 is installed. For example, for smaller shower enclosures (e.g., apartment shower, garden shower, etc.), the base length $L_B$ may be between approximately 10-20 inches, inclusive. In some embodiments, such as for use as a poolside drain, the base length $L_B$ may be between approximately 40-100 inches, inclusive. In some embodiments, the base portion 200 may be coupled to a similar base portion to effectively extend the base length $L_B$. The base portion 200 may be formed by extrusion, milling, injection molding, stamping and bending, and similar manufacturing processes. In some embodiments, the base portion 200 is formed of 18 gauge stainless steel, such as by stamping out a pattern for the base portion 200, bending the stainless steel, and welding the steel together to form the base portion 200.

The base portion 200 may further include the outlet body 210 (e.g., annular body) extending substantially orthogonally away from the base portion 200. The outlet body 210 may be positioned such that a central axis of the outlet body 210 lies on the central plane $P_C$. In some embodiments, the central plane $P_C$ intersects the outlet body 210. The outlet body 210 may be positioned equidistant from both the first base end 300 and the second base end 302. In some embodiments, the outlet body 210 is positioned such that the outlet body 210 is nearer the first base end 300 than the second base end 302.

When the linear drain assembly 100 is positioned within a shower cell, a conduit may be coupled to the outlet body 210 such that water that enters the base portion 200 and is directed toward the outlet body 210 may be received by a drain or sewer pipe.

Referring specifically to FIG. 3, a side view of the base portion 200 is shown from the first base end 300. The base portion 200 may define a portion of the trough 101, such as a central portion of the trough 101 positioned between the first peripheral portion 202 and the second peripheral portion 204. The portion of the trough 101 defined by the base portion 200 may be defined by a first base surface 312, a second base surface 314, and a third base surface 316. The first base surface 312 may be generally planar and extend between the first base end 300 and the second base end 302. In some embodiments, the first base surface 312 is slightly sloped toward the outlet body 210 such that a fluid that enters the trough 101 would be biased toward the outlet body 210. For example, the first base surface 312 may slope downward between the first base end 300 and the outlet body 210, and the first base surface 312 may slope upward from the outlet body 210 to the second base end 302.

The outlet body 210 extends substantially orthogonally away from the first base surface 312 in a first direction, denoted by $\alpha$. The second base surface 314 and the third base surface 316 may extend substantially orthogonally away from the first base surface 312 in a second direction denoted by $\beta$, the second direction being opposite the first direction $\alpha$. The second base surface 314 and the third base surface 316 may be substantially parallel to each other. In some embodiments, the second base surface 314 and the third base surface 316 are substantially parallel to the central plane $P_C$. However, in some embodiments, the second base surface 314 and the third base surface 316 may extend away from the first base surface 312 at a slight angle relative to the central plane $P_C$ such that the second base surface 314 and the third base surface 316, if extended, would intersect the central plane $P_C$ in the first direction $\alpha$.

The second base surface 314 is contiguous with the first base surface 312 at a first chamfer 313. In some embodiments, the second base surface 314 and the first base surface 312 meet at a sharp corner (e.g., a non-differentiable corner). In some embodiments, the first chamfer 313 is the result of bending a planar material (e.g., sheet metal) to form the first base surface 312 and the second base surface 314. In some embodiments, the first base surface 312 and the second base surface 314 are cut (e.g., waterjet, laser cut, etc.) from the same piece of planar material and coupled together, forming the first chamfer 313. In some embodiments, the first chamfer 313 is a weld.

The third base surface 316 is contiguous with the first base surface 312 at a second chamfer 315. In some embodiments, the third base surface 316 and the first base surface 312 meet at a sharp corner. In some embodiments, the second chamfer 315 is the result of bending a planar material to form the first base surface 312 and the third base surface 316. In some embodiments, the first base surface 312 and the third base surface 316 are cut from the same piece of planar material and coupled together, forming the second chamfer 315. In some embodiments, the second chamfer 315 is a weld.

The base portion 200 may further include a first base flange 318 extending from an end of the second base surface 314 distal from the first base surface 312 in a direction generally away from the central plane $P_C$ at. The first base flange 318 defines a flange width $W_F$, defined as a distance between the second base surface 314 and an end of the first base flange 318 distal to the second base surface 314. The base portion may further include a second base flange 320 extending substantially orthogonally away from an end of the third base surface 316 distal from the first base surface 312 in a direction generally away from the central plane $P_C$. A width of the second base flange 320 may be equal to the flange width $W_F$.

The first base flange 318 includes a surface, shown as a fourth base surface 322, and the second base flange 320 includes a surface, shown as a fifth base surface 324. The fourth base surface 322 and the fifth base surface 324 may be generally parallel to one another such that both the fourth base surface 322 and the fifth base surface 324 lie within the same plane. The fourth base surface 322 may extend substantially orthogonally away from the second base surface 314 in a direction generally away from and generally perpendicular to (e.g., between 85° and 95° from) the central plane $P_C$. The fourth base surface 322 may be contiguous with the second base surface 314 and may meet (e.g., be coupled to) the second base surface 314 at a third chamfer 317. In some embodiments, the fourth base surface 322 and the second base surface 314 meet at a sharp corner. In some embodiments, the third chamfer 317 is the result of bending a planar material to form the second base surface 314 and the fourth base surface 322. In some embodiments, the second base surface 314 and the fourth base surface 322 are cut from the same piece of planar material and coupled together, forming the third chamfer 317. In some embodiments, the third chamfer 317 is a weld.

The fifth base surface 324 may extend substantially orthogonally away from the third base surface 316 in a direction generally away from and generally perpendicular to (e.g., between 85° and 95° from) the central plane $P_C$. The fifth base surface 324 may be contiguous with the third base surface 316 and may meet (e.g., be coupled to) the third base surface 316 at a fourth chamfer 319. In some embodiments, the fifth base surface 324 and the third base surface 316 meet at a sharp corner. In some embodiments, the fourth chamfer 319 is the result of bending a planar material to form the third base surface 316 and the fifth base surface 324. In some embodiments, the third base surface 316 and the fifth base surface 324 are cut from the same piece of planar material and coupled together, forming the fourth chamfer 319. In some embodiments, the fourth chamfer 319 is a weld.

The second base surface 314 and the third base surface 316 are separated by a distance, shown as a trough width $W_T$. In some embodiments the trough width $W_T$ may be less (e.g., shorter) proximate to the first chamfer 313 and the second chamfer 315 than proximate to the third chamfer 317 and the fourth chamfer 319. However, both instances are referred to as the trough width $W_T$. The base portion 200 also defines a distance between the end of the first base flange 318 distal the second base surface 314 and the end of the second base flange 320 distal the third base surface 316, the distance shown as a base width $W_B$.

In some embodiments, the base portion 200 may be formed by extrusion. For example, the first base surface 312, the second base surface 314, the third base surface 316, the fourth base surface 322, and the fifth base surface 324 may be integrally formed in a single body by extrusion. Then, the outlet body 210 may be coupled to the base portion 200, such as by welding. In some embodiments, the sloping of the first base surface 312 may be achieved by cutting the base portion 200 from a flat sheet of material and welding first base surface 312 to both of the second base surface 314 and the third base surface 316.

Referring back to FIG. 1, the gasket 212 may be integrally formed with or coupled to the base portion 200 such as by overmolding, adhesives, or fasteners. The gasket 212 may be positioned on both the first base flange 318 and the second base flange 320, interrupting both the fourth base surface 322 and the fifth base surface 324. In some embodiments, the gasket 212 extends between the first base end 300 and the second base end 302. However, as shown in FIG. 1, the gasket 212 terminates proximate to the both the first base end 300 and the second base end 302, leaving a small gap. The small gap may define a width approximately 2% the base length $L_B$. The gasket 212 further includes a distal first gasket portion 214 and a distal second gasket portion 216 opposite the first gasket portion 214. Both the first gasket portion 214 and the second gasket portion 216 may be coupled to the first base surface 312, the second base surface 314, and the third base surface 316. The first gasket portion 214 is positioned apart from the first base end 300 by approximately 2% of the base length $L_B$. The second gasket portion 216 may positioned apart from the second base end 302 by approximately 2% of the base length $L_B$. In some embodiments, the second gasket portion 216 is positioned apart from the second base end 302 by approximately 5% of the base length $L_B$. In some embodiments, other relative positions of the second gasket portion 216 and the second base end 302 may be used according to other exemplary embodiments. Referring generally to the gasket 212, the gasket 212 forms a contiguous shape that extends along both the first base flange 318 and the second base flange 320 and also extends across the trough 101. When the first peripheral portion 202 is coupled to the base portion 200, the gasket 212 is compressed between the base portion 200 and the first peripheral portion 202, forming a substantially watertight seal such that a flow of fluid (e.g., water) is prevented from exiting the base portion 200 proximate to the second base end 302. Similarly, when the second peripheral portion 204 is coupled to the base portion 200, the gasket 212 is compressed and a flow of fluid is prevented from exiting the base portion 200 proximate to the first base end 300. The gasket 212 facilitates the exit of fluid through the outlet body 210.

The gasket 212 also facilitates adjustment of the first peripheral portion 202 and the second peripheral portion 204 relative to the outlet body 210. For example, the first peripheral portion 202 may be positioned at various distances from the outlet body 210. At each distance, the gasket 212 may provide a substantially watertight sealing engagement between the base portion 200 and the first peripheral portion 202.

The linear drain assembly 100 may further include an adjustable leg 220, shown in FIG. 1. The adjustable leg 220 may be coupled to the first peripheral portion 202 and facilitate leveling of the linear drain assembly 100 when installed. In some embodiments, the adjustable leg 220 may be coupled to the second peripheral portion 204. The adjustable leg 220 may facilitate leveling of the linear drain assembly 100 when the outlet body 210 is positioned over a drain opening in the subfloor of a shower enclosure. The adjustable leg 220 may facilitate positioning of the first peripheral portion 202 above the subfloor such that mortar or a similar floor material may be disposed between the linear drain assembly 100 and the subfloor. When water enters the first peripheral portion 202, the water is biased toward the base portion 200, and the base portion 200 biases the water toward the outlet body 210. To ensure that the first peripheral portion 202 is positioned relative to the subfloor such that the first peripheral portion 202 will drain toward the base portion 200, the adjustable leg 220 may be positioned at a minimum height (e.g., minimum extension) such that the first peripheral portion 202 is appropriately positioned to drain toward the base portion 200. Thus, when mortar is interposed between the first peripheral portion 202 and the subfloor, the adjustable leg 220 prevents the first peripheral portion 202 from an improper incline. The adjustable leg 220 may be enclosed within mortar or cement when the linear drain assembly 100 is installed within a shower environment or shower enclosure.

Figure 4:
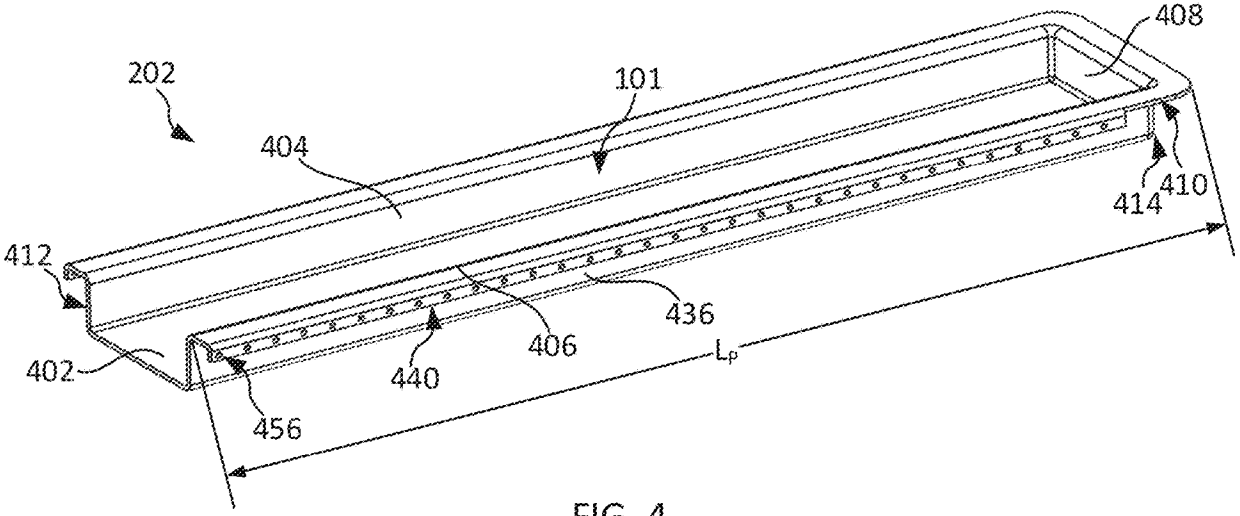
FIG. 4 is a perspective view of a portion of the linear drain assembly of FIG. 1, according to an exemplary embodiment.
Figure 5:
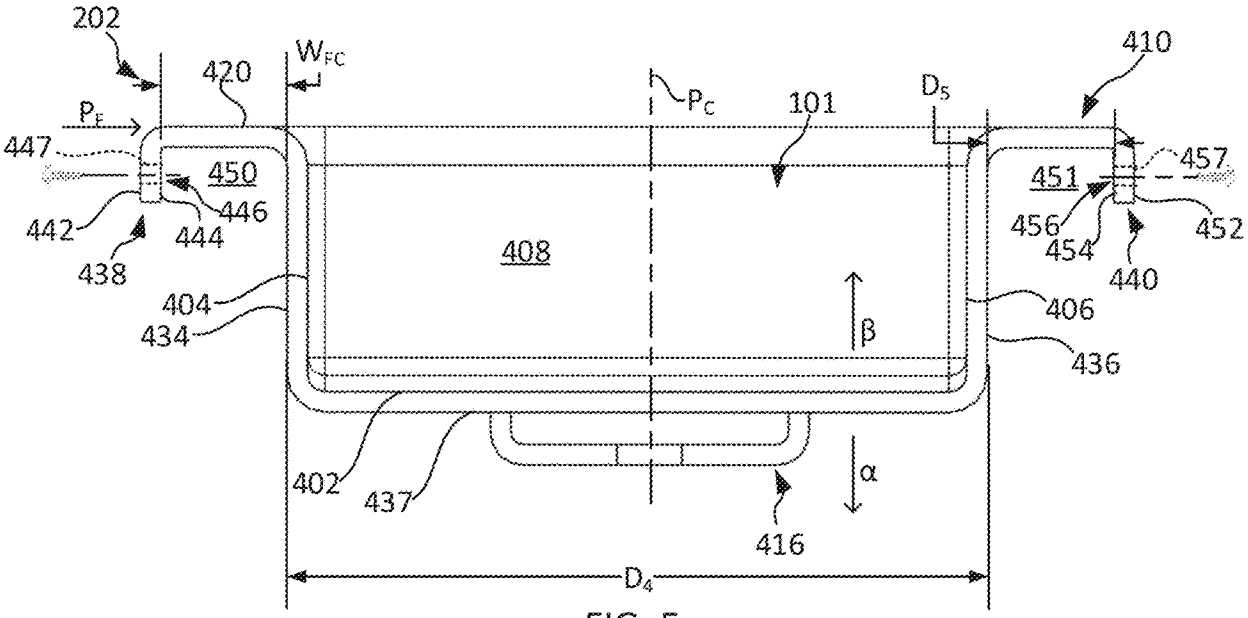
FIG. 5 is a side view of the portion of the linear drain assembly of FIG. 4, according to an exemplary embodiment.

Referring now to FIGS. 4 and 5, the first peripheral portion 202 is shown. While only the first peripheral portion is shown, it should be understood that the second peripheral portion 204 is similar to the first peripheral portion 202. In some embodiments, the first peripheral portion 202 and the second peripheral portion 204 are identical such that a user may not be able to distinguish the first peripheral portion 202 from the second peripheral portion 204. In some embodiments, both the first peripheral portion 202 and the second peripheral portion 204 include a label or marker that distinguish them from each other (e.g., 'L' and 'R', 'A' and 'B', '1' and '2', etc.). The first peripheral portion 202 and the second peripheral portion 204 may be formed by extrusion, milling, injection molding, stamping and bending, and similar manufacturing processes. In some embodiments, the first peripheral portion 202 and the second peripheral portion 204 are formed of 18 gauge stainless steel, such as by stamping out a pattern for the first peripheral portion 202 and the second peripheral portion 204, bending the stainless steel, and welding the steel together to form the first peripheral portion 202 and the second peripheral portion 204.

The first peripheral portion 202 includes a catch pan 402 (e.g., first surface, bottom surface, etc.), a first wall 404, a second wall 406, and a third wall 408. Each of the catch pan 402, the first wall 404, the second wall 406, and the third wall 408 cooperate to define a portion of the trough 101. The first peripheral portion 202 also includes a generally planar and contiguous flange 410 that extends from each of the first wall 404, the second wall 406, and the third wall 408.

The catch pan 402 extends between a first end 412 and a second end 414 of the first peripheral portion 202. The first peripheral portion defines a length, shown as a portion length $L_P$, the portion length $L_P$ defined as the distance between the first end 412 and the flange 410 proximate to the second end 414. Both the first peripheral portion 202 and the second peripheral portion 204 may be defined by the peripheral length $L_P$. Extending from the first peripheral portion 202 in the first direction $\alpha$ may be a bracket 416. The bracket 416 may be configured to receive an adjustable member, such as an adjustable leg, bolt, or spacer that is configured to facilitate leveling of the linear drain assembly 100 during installation. In some embodiments, the adjustable leg 220 is coupled to the bracket 416 and facilitates leveling of the linear drain assembly 100 during installation. In some embodiments, the bracket 416 may extend from the outer catch surface 437 and provide a stopping surface that prevents the first peripheral portion 202 from being positioned entirely within the base portion 200. For example, when the flange 410 is interfacing with both of the first base flange 318 and the second base flange 320, the bracket 416 may extend from the outer catch surface 437 such that the bracket 416 interfaces with the second base end 302 when an installer attempts to slide the first end 412 of the first peripheral portion 202 over the outlet body 210. Thus, the minimum length of the linear drain assembly 100 may be achieved when the bracket 416 interfaces with one of the first base end 300 or the second base end 302.

The first wall 404 and the second wall 406 extend away from the catch pan 402 in generally the second direction $\beta$. In some embodiments, the first wall 404 and the second wall 406 are parallel to one another. However, in some embodiments, the first wall 404 and the second wall 406 may extend away from the catch pan 402 in a direction other than perpendicularly. For example, the first wall 404 may extend away from the catch pan 402 such that the first wall 404 is sloped toward the central plane $P_C$ (e.g., the first wall 404, if extended, would intersect the central plane $P_C$ in the first direction a). Similarly, the second wall 406 may be sloped toward the central plane $P_C$ (e.g., the second wall 406, if extended, would intersect the central plane $P_C$ in the first direction $\alpha$).

The third wall 408 extends from the catch pan 402 in the second direction $\delta$. In some embodiments, the third wall 408 extends from the catch pan 402 perpendicularly. In some embodiments, the third wall 408 slopes toward the outlet body 210 such that the third wall 408, if extended, would intersect a central axis of the outlet body 210 in the first direction $\alpha$.

Each of the first wall 404, the second wall 406, and the third wall 408 are contiguous with the catch pan 402. In some embodiments, the first wall 404 meets the catch pan 402 at a sharp corner. In some embodiments, the transition between the catch pan 402 and the first wall 404 is a gradual curve and may be the result of bending a planar material to form the first wall 404 and the catch pan 402. In some embodiments, the second wall 406 meets the catch pan 402 at a sharp corner. The transition between the catch pan 402 and the second wall 406 may be a gradual curve and may be the result of bending a planar material to form the second wall 406 and the catch pan 402. In some embodiments, the third wall 408 meets the catch pan 402 at a sharp corner. The transition between the catch pan 402 and the third wall 408 may be a gradual curve and may be the result of bending a planar material to form the third wall 408 and the catch pan 402.

The third wall 408 is contiguous with both the first wall 404 and the second wall 406. In some embodiments, the first peripheral portion 202 is cut from a flat sheet of a planar material, such as steel or aluminum (or similar alloys) and welded. While the transition between the first wall 404 and the catch pan 402 may be the result of bending a flat sheet of planar material, the transition between the first wall 404 and the third wall 408 may be formed by coupling the first wall 404 to the third wall 408, such as by welding. Similarly, the second wall 406 and the third wall 408 may be welded together and form a curved transition. In some embodiments, the first peripheral portion 202 is formed by hydroforming, vacuum molding, cold forging, or similar manufacturing processes.

Figure 7:
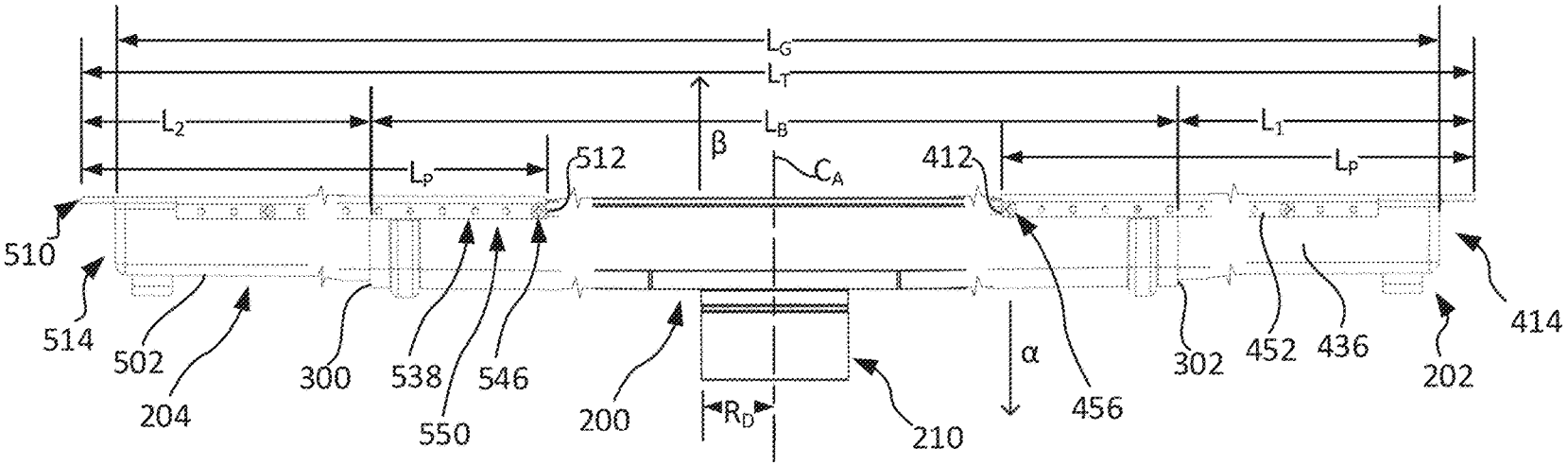
FIG. 7 is a front view of the linear drain assembly of FIG. 1, according to an exemplary embodiment.

Referring specifically to FIG. 7, the flange 410 may define a flange surface 420, and both the flange 410 and the flange surface 420 may lie within a plane substantially orthogonal to the central plane $P_C$, shown as a flange plane $P_F$. The flange 410 extends from all of the first wall 404, the second wall 406, and the third wall 408. The flange surface 420 is contiguous with all of the first wall, the second wall 406, and the third wall 408. Generally speaking, the flange 410 extends between the first end 412 and the second end 414 along both the first wall 404 and the second wall 406. The flange 410 also extends away from the second end 414.

The flange plane $P_F$ may be parallel to the catch pan 402. In some embodiments, the catch pan 402 is slightly sloped from the second end 414 to the first end 412. For example, a distance between the catch pan 402 and the flange plane $P_F$ may be less proximate to the second end 414 than a distance between the catch pan 402 and the flange plane $P_F$ proximate to the first end 412. When the linear drain assembly 100 is installed, the slope of the catch pan 402 of the first peripheral portion 202 may facilitate drainage of water such that water is directed from the second end 414 to the first end 412, and thus from the first peripheral portion 202 to the base portion 200.

The flange 410 is contiguous with all of the first wall 404, the second wall 406, and the third wall 408. In some embodiments, flange 410 is not parallel to the flange plane $P_F$, but is instead sloped inward and toward the catch pan 402. Such a slope of the flange 410 may facilitate drainage of water into first peripheral portion 202. In some embodiments, water is not configured to interface with the flange 410 when the linear drain assembly 100 is assembled and installed. For example, to facilitate coupling of the first peripheral portion 202 to the base portion 200, the flange 410 may be angled away from the catch pan 402.

The first peripheral portion 202 further comprises a first outer wall 434 and a second outer wall 436. The first outer wall 434 may face in a direction generally away from the central plane $P_C$. Similarly, the second outer wall 436 may face in a direction generally away from the central plane $P_C$. Generally speaking, the first peripheral portion 202 is configured to be received within the base portion 200. To allow for such a configuration, the first outer wall 434 and the second outer wall 436 are separated by a distance, shown as a peripheral width $W_P$. While a distance between the first outer wall 434 and the second outer wall 436 may be different at different points (e.g., a greater distance proximate to the flange 410 when compared to a lesser distance proximate to the catch pan 402), the peripheral width $W_P$ designates the distance between the first outer wall 434 and the second outer wall 436. To allow for the first peripheral portion 202 to be received within the base portion 200, the peripheral width $W_P$ is less than the trough width $W_T$.

The flange 410 includes a first ledge 438 and a second ledge 440, each of the first ledge 438 and the second ledge 440 extending away from the flange 410 in the first direction $\alpha$. In some embodiments, the first ledge 438 is generally parallel (±5%) to the first wall 404 and the second ledge 440 is generally parallel to the second wall 406. The first ledge 438 includes an outer ledge surface 442 and an inner ledge surface 444. The outer ledge surface 442 is contiguous with the flange surface 420. In some embodiments, the outer ledge surface 442 meets the flange surface 420 at a curved interface, such as may be achieved by bending a planar material at approximately 90 degrees. The inner ledge surface 444 and the first outer wall 434 are separated by a distance, shown as a flange cavity width $W_{FC}$. The first outer wall 434, the flange 410, and the inner ledge surface 444 cooperate to form a first flange cavity 450 defined in part by the flange cavity width $W_{FC}$ such that the first flange cavity 450 may receive either of the first base flange 318 or the second base flange 320. Specifically, the flange cavity width $W_{FC}$ is greater that less than the flange width $W_F$.

The first ledge 438 further includes a first aperture 446 defined by a generally annular surface, shown as an aperture surface 447. The aperture surface 447 extends through the first ledge 438 and is contiguous with both the outer ledge surface 442 and the inner ledge surface 444. In some embodiments, the aperture surface 447 may be tapped (e.g., threaded) to receive a screw. In some embodiments, the aperture surface 447 is configured to receive a self-tapping screw or a sheet metal screw. The first aperture 446 is configured to receive a fastener, such as a sheet metal screw, that is configured to selectively couple one of the first base flange 318 or the second base flange 320 to the first peripheral portion 202.

Referring now to the second ledge 440, the second ledge 440 includes an outer ledge surface 452 and an inner ledge surface 454. The outer ledge surface 452 is contiguous with the flange surface 420. In some embodiments, the outer ledge surface 452 meets the flange surface 420 at a curved interface, such as may be achieved by bending a planar material at approximately 90 degrees. The inner ledge surface 454 and the second outer wall 436 may be separated by a distance equal to or approximately equal to the flange cavity width $W_{FC}$. The second outer wall 436, the flange 410, and the inner ledge surface 454 cooperate to form a second flange cavity 451 defined in part by the flange cavity width $W_{FC}$ such that the second flange cavity 451 may receive either of the second base flange 320 or the first base flange 318. When the linear drain assembly 100 is installed, the first flange cavity 450 may receive the first base flange 318 while the second flange cavity 451 receives the second base flange 320.

In some embodiments, the linear drain assembly 100 includes a flange hook that extends away from a distal end of the second ledge 440 and is configured to be coupled to one of the first base flange 318 or the second base flange 320. In some shower enclosures, it may be desirable to position the linear drain assembly 100 along a wall, either for ease of installation or for aesthetics. In such an installation configuration, tool access between the linear drain assembly 100 and the wall may be limited. Thus, the flange hook may couple the flange 410 to the first base flange 318 such that a substantially watertight seal is formed between the flange 410 and the first base flange 318. To fully secure the first peripheral portion 202 to the base portion 200, the flange 410 proximate to the first flange cavity 450 may be coupled to the second base flange 320, such as by fasteners, adhesive, welding, and the like. In some embodiments, the first peripheral portion 202 includes a flange hook extending from both of the first ledge 438 and the second ledge 440 such that the base portion 200 may be slidingly received by the first peripheral portion 202, and a substantially watertight seal may be formed between the flange 410, the first base flange 318, and the second base flange 320 without a need for fasteners, welding, adhesive, or the like. In general, the base portion 200 is configured to be received by the first peripheral portion 202 such that the base portion 200 telescopes into the first peripheral portion 202. In some embodiments, the base portion 200 may be configured to receive the first peripheral portion 202 such that the first peripheral portion 202 telescopes into the base portion 200.

The second ledge 440 further includes a second aperture 456 defined by a generally annular surface, shown as a second aperture surface 457. The second aperture surface 457 extends through the second ledge 440 and is contiguous with both the outer ledge surface 452 and the inner ledge surface 454. In some embodiments, the second aperture surface 457 is tapped (e.g., threaded) to receive a screw. In some embodiments, the second aperture surface 457 is configured to receive a self-tapping screw or a sheet metal screw. The second aperture 456 is configured to receive a fastener, such as a sheet metal screw, that is configured to selectively couple one of the first base flange 318 or the second base flange 320 to the first peripheral portion 202.

Referring again to FIG. 3, the second ledge 440 may include a plurality of apertures configured to receive a plurality of fasteners, the plurality of apertures profiled along a length of the second ledge 440. In some embodiments, the second ledge 440 does not extend the full length of the first peripheral portion 202. For example, the second ledge 440 may extend to the first end 412, but the second ledge 440 may not extend to the second end 414. Thus, the second ledge 440 may not be contiguous with the first ledge 438. However, in some embodiments, the first ledge 438 and the second ledge 440 are contiguous, for example in embodiments where a third ledge extends from the flange 410 proximate to the second end, the third ledge may be contiguous with both the first ledge 438 and the second ledge 440.

Similar to the second ledge 440, the first ledge 438 may include a plurality of screw apertures profiled along a length of the first ledge 438, where the plurality of screw apertures are configured to receive a plurality of fasteners configured to selectively couple the first peripheral portion 202 to the base portion 200.

Figure 6:
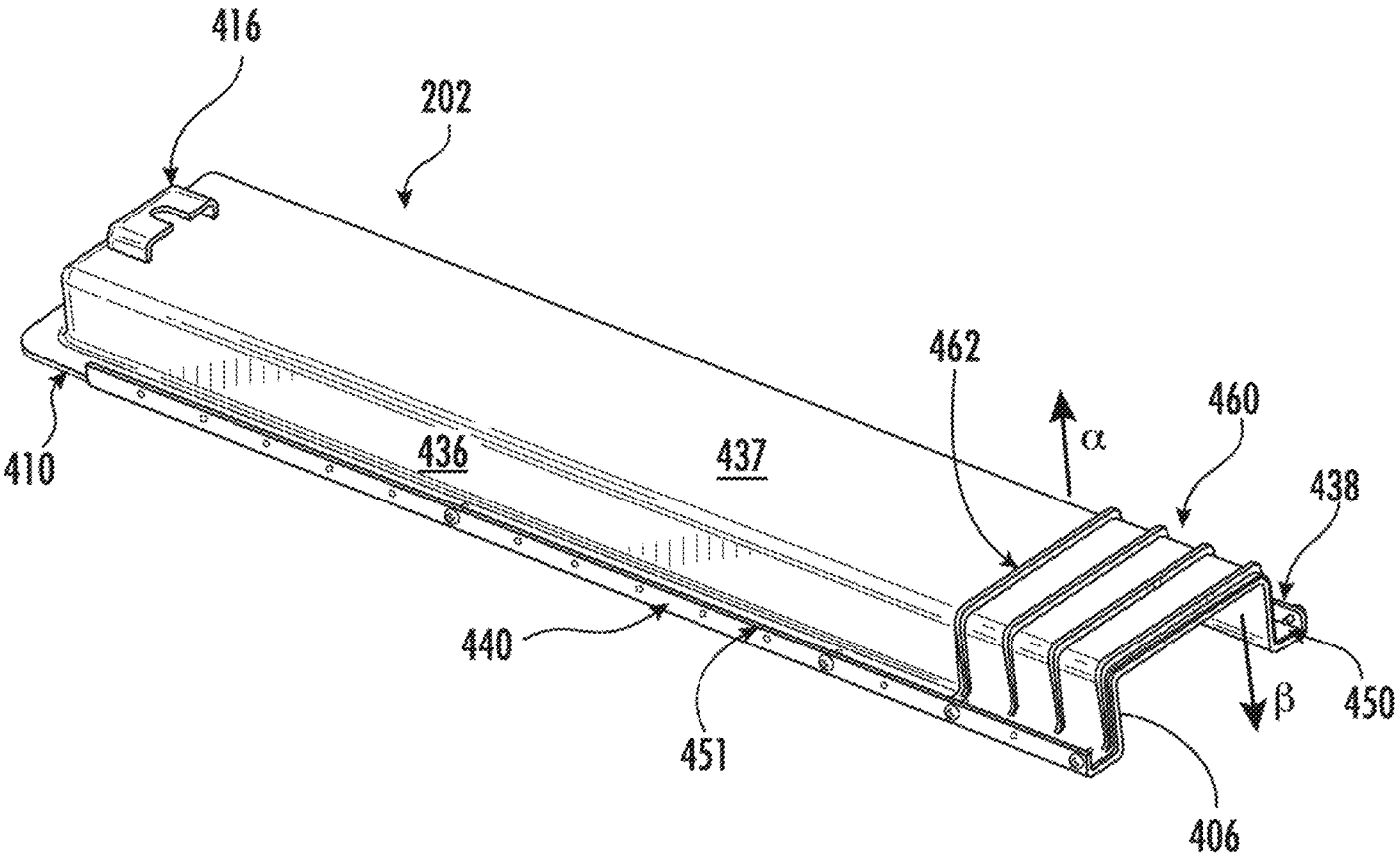
FIG. 6 is a bottom perspective view of the portion of the linear drain assembly of FIG. 4, according to an exemplary embodiment.

Turning to FIG. 6, a bottom peripheral view of the first peripheral portion 202 is shown. The first peripheral portion 202 may further include a sealing member, shown as a gasket 460, coupled to an outer surface of the first peripheral portion 202. The gasket 460 may be coupled to the first peripheral portion 202 by way of overmolding, adhesives, or fasteners. The gasket 460 is coupled to all of the first outer wall 434, the second outer wall 436, the flange 410, and an outer catch surface 437. When the first peripheral portion 202 is positioned within the base portion 200, the gasket 460 is configured to interface with each of the first base surface 312, the second base surface 314, the third base surface 316, the fourth base surface 322, and the fifth base surface 324. When the first peripheral portion 202 is coupled to the base portion 200, the gasket 460 is pinched between the first peripheral portion 202 and the base portion 200. The gasket 460 is configured to provide a sealing engagement with the base portion 200 at all locations between the outlet body 210 and the second base end 302. For example, the installer of the linear drain assembly 100 may slide the first peripheral portion 202 along the length of the base portion 200 while being confident that the gasket 460 will provide a sealing engagement with the base portion 200 within the range of adjustability of the linear drain assembly 100 (e.g., between the minimum length and the maximum length).

In some embodiments, the first peripheral portion 202 includes a roughened surface that is configured to receive an adhesive or seal. For example, the first peripheral portion 202 may include a roughened surface that extends across all of the first outer wall 434, the second outer wall 436, the flange 410, and the outer catch surface 437. The roughened surface may increase the surface area available for an adhesive to adhere to. When an installer is ready to position the first peripheral portion 202 within the base portion 200, the installer may apply an adhesive (e.g., bead of caulking, silicon sealant, gasket, the gasket 460) to the roughened surface and then place the first peripheral portion 202 within the base portion 200. The first peripheral portion 202 may be inserted from above (e.g., from the second direction $\beta$ and in the first direction $\alpha$) such that the adhesive is interposed between the roughened surface and the base portion 200. In some embodiments, the installer may slide the first peripheral portion 202 into the base portion 200 from either of the first base end 300 or the second base end 302. The adhesive applied to roughened surface of the first peripheral portion 202 may be squeezed and spread along the base portion 200 as the first peripheral portion 202 is slid. In some embodiments, an installer may interpose an adhesive between the first peripheral portion 202 and the base portion 200 to work in conjunction with the gasket 460, the adhesive providing redundancy to the substantially watertight seal between the gasket 460, the first peripheral portion 202, and the base portion 200.

Because the first base surface 312 may be sloped, the gasket 460 may include a plurality of gasket fins 462 that extend away from the gasket 460 proximate to the outer catch surface 437 in generally the first direction $\alpha$. The plurality of gasket fins 462 may extend far enough such that the plurality of gasket fins 462 interface with the first base surface 312 when the first peripheral portion 202 is coupled to the base portion 200 in the minimum distance configuration. In some embodiments, a distance between the outer catch surface 437 and the first base surface 312 is greatest when the linear drain assembly 100 is configured in the minimum length configuration.

In some embodiments, the gasket 460 may cooperate with the gasket 212 to provide a watertight seal between the first peripheral portion 202 and the base portion 200 when the first peripheral portion 202 is coupled to the base portion 200. However, either of the gasket 460 of the gasket 212 may be used exclusively (e.g., without the other) while still providing a watertight seal.

Turning now to FIG. 7, a side view of the linear drain assembly 100 is shown with the base portion 200 coupled to both of the first peripheral portion 202 and the second peripheral portion 204.

While the second peripheral portion 204 is not described in detail herein, the second peripheral portion 204 is similar to the first peripheral portion 202, and thus like numbering is used to denote like parts. The first peripheral portion 202 is denoted using the 400-series of numbers (e.g., flange 410, second end 414, first ledge 438, etc.). Herein, the second peripheral portion 204 is referenced using the 500-series of numbers corresponding to the 400-series (e.g., a flange 510, a second end 514, a first ledge 538, etc.).

The base portion 200 and the first peripheral portion 202 are configured to be slidably coupled to one another such that adjustments may be made to the length of the linear drain assembly 100 by sliding the first peripheral portion 202 generally toward and away from the outlet body 210. Specifically, the catch pan 402 is inserted into the portion of the trough 101 defined by the base portion 200 such that the first base flange 318 is received within the first flange cavity 450 and the second base flange 320 is received within the second flange cavity 451. Similarly, the second peripheral portion 204 is configured to be coupled to the base portion 200 such that the first base flange 318 is received within a second flange cavity 551 and the second base flange 320 is received within a first flange cavity 550. During an installation of the linear drain assembly 100, the installer may position the base portion 200 such that the outlet body 210 is disposed within or near to a hole in the floor or near drainage plumbing. Once the base portion 200 is in position, the installer may place a portion of the first peripheral portion 202 into the base portion 200 such that the first peripheral portion 202, and specifically the gasket 460, interfaces with the base portion 200. Further, the first end 412 may be positioned between the outlet body 210 and the second base end 302. In some embodiments, the first peripheral portion 202 is configured to be positioned such that the first end 412 is positioned between the first base end 300 and the second base end 302. Generally speaking, the structure of the first peripheral portion 202 allows the first end 412 and the second end 414 to be positioned anywhere along the length of the base portion 200. However, when the linear drain assembly 100 is installed, it may be desirable for the first end 412 to be positioned between the outlet body 210 and the first base end 300, and for the second end 414 to be positioned at a greater distance from the outlet body 210 than the first end 412.

To adjust a distance between the outlet body 210 and the second end 414, the first peripheral portion 202 may be positioned (e.g., slid, translated, telescoped, etc.) within the base portion 200 such that a central axis of the second aperture 456 intersects the base portion 200. To couple the first peripheral portion 202 to the base portion 200, a fastener may be threaded into the second aperture 456 and interface with the base portion 200, biasing the first base flange 318 into the flange 410 and compressing (e.g., squeezing) the gasket 460 between the first base flange 318 and the flange 410 to form a watertight seal between the first peripheral portion 202 and the base portion 200. Similarly, a fastener may be threaded through the second aperture 456 to couple the second base flange 320 to the first peripheral portion 202 such that the gasket 460 is compressed between the second base flange 320 and the flange 410. At the same time, coupling the first peripheral portion to the base portion 200 may compress the gasket 460 between the first outer wall 434 and the second base surface 314, compress the gasket 460 between the outer catch surface 437 and the first base surface 312, and compress the gasket 460 between the second outer wall 436 and the third base surface 316.

Because the first peripheral portion 202 is slidable relative to the base portion 200, the totally length of the linear drain assembly 100 may be adjusted without cutting (e.g., separating, splitting, etc.) either of the first peripheral portion 202 or the base portion 200. For example, to reduce the total length of the linear drain assembly, the first end 412 may be positioned proximate to the outlet body 210 and the second end 414 may be positioned proximate to the second base end 302. In this configuration, multiple fasteners may be threaded through both of the first ledge 438 and the second ledge 440 to secure the first peripheral portion 202 to the base portion 200. To increase the total length of the linear drain assembly 100, the first end 412 may be positioned proximate to the second base end 302 and a fastener may be threaded through the first aperture 446 and the second aperture 456.

The linear drain assembly 100 defines a total installation length, shown as a total length $L_T$. The total length $L_T$ is defined as the distance between the flange 410 proximate to the second end 414 and the flange 510 proximate to the second end 514. The total length $L_T$ is adjustable between a minimum length and a maximum length. The minimum length may be achieved by positioning the first end 412 and the first end 512.

To achieve the minimum total length of the linear drain assembly 100, the first peripheral portion 202 may be positioned proximate to the outlet body 210 such that the first end 412 is the drain radius $R_D$ (e.g., a distance equal to the drain radius $R_D$) from a central axis $C_A$ of the outlet body 210 and no portion of the first peripheral portion 202 is intersected by the central axis $C_A$. Similarly, to achieve the minimum length, the second peripheral portion 204 may be positioned such that the first end 512 is the drain radius $R_D$ from the central axis $C_A$ and no portion of the second peripheral portion 204 is intersected by the central axis $C_A$. In other words, the minimum distance is achieved when the first end 412 and the first end 512 are separated by twice the drain radius $R_D$. From herein, the "minimum distance" will refer to the aforementioned configuration. However, it should be understood that in some embodiments, the first end 412 and the first end 512 may be positioned such that a distance less than twice the drain radius $R_D$ exists between the first end 412 and the first end 512 (e.g., the first end 412 may interface with the first end 512).

To achieve the maximum total length of the linear drain assembly 100, the first peripheral portion 202 may be positioned such that the first end 412 is proximate to the second base end 302 such that a central axis of the second aperture 456 intersects the base portion 200. Similarly, to achieve the maximum total length, the second peripheral portion 204 may be positioned such that the first end 512 is proximate to the first base end 300 such that the central axis of the second screw aperture 546 intersects the base portion 200.

The total length $L_T$ may be adjusted without the use of adhesives and without permanent modification (e.g., cutting, welding, drilling holes, bending, etc.) to any of the base portion 200, the first peripheral portion 202, and the second peripheral portion 204. The total length $L_T$ may also be adjusted without the use of a ruler. For example, an installer may position the outlet body 210 above the drainage plumbing and place the catch pan 402 into the trough of the base portion 200. If the linear drain assembly 100 is desired to extend the full length of a wall of a shower cell, the second end 414 may be pulled toward a wall of the shower cell until the flange 410 interfaces with or is the desired distance from the wall. The installer may then couple the first peripheral portion 202 to the base portion 200 such that the first peripheral portion 202 is no longer allowed to slide without significant force or without loosening the fasteners. Similarly, the second end 514 may be pulled toward an opposite wall of the shower cell until the flange 510 interfaces with or is the desired distance from the wall. The installer may then couple the second peripheral portion 204 to the base portion 200 by threading a fastener into the first screw aperture 556 (e.g., threading a plurality of fasteners into the first ledge 538).

The adjustability of the first peripheral portion 202 relative to the base portion 200 also allows for installation in environments where an asymmetrical installation configuration is desired. Thus, the base portion 200 may be positioned such that the outlet body 210 is over the drain plumbing. Then the catch pan 402 may be placed within the base portion 200. The installer may then pull the second end 414 a desired distance from the second base end 302, the distance shown a first peripheral distance $L_1$. The installer may then place the catch pan 502 of the second peripheral portion 204 into the trough of the base portion 200 and pull the second end 514 a desired distance away from the first base end 300, the distance shown as a second peripheral distance $L_2$. The first peripheral distance $L_1$ and the second peripheral distance $L_2$ may be different. For example, the second end 414 may be nearer to the outlet body 210 than the second end 514. The total length $L_T$ is defined as the sum of the base length $L_B$, the first peripheral distance $L_1$, and the second peripheral distance $L_2$.

When the linear drain assembly 100 is installed, the base portion 200, the first peripheral portion 202, and the second peripheral portion 204 cooperate to form a trough having a trough length $L_G$. Specifically, the trough length $L_G$ is defined as a distance between the third wall 408 and a third wall 508. The trough width is defined at various points along the trough length $L_G$ by the distance between the first wall 404 and the second wall 406, the first wall 504 and the second wall 506, and the second base surface 314 and the third base surface 316. The trough length $L_G$ shares a linear relationship with the total length $L_T$, in which both the total length $L_T$ and the trough length $L_G$ are adjusted simultaneously and equally. Thus, the trough length $L_G$ similarly may include a minimum trough length and a maximum trough length.

Figure 8:
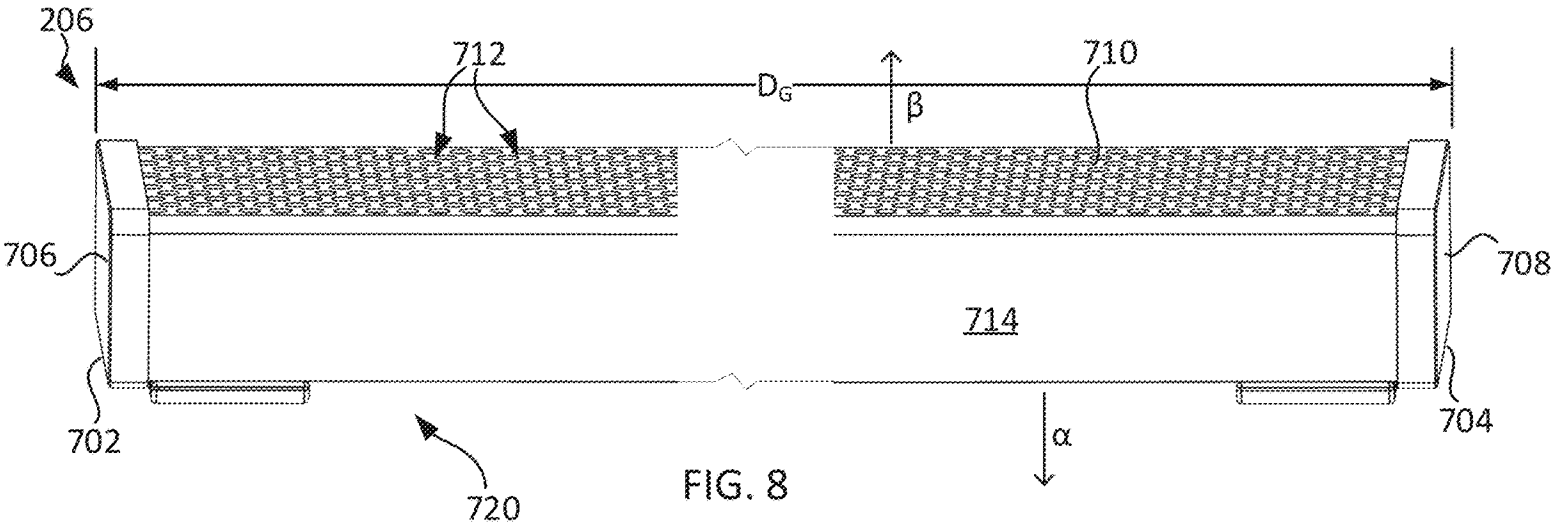
FIG. 8 is a front perspective view of a portion of the linear drain assembly of FIG. 1, according to an exemplary embodiment.

Referring now to FIG. 8, a drain grate 206 is shown according to an example embodiment. The drain grate 206 is configured to be received within the trough 101. The drain grate 206 may be formed of an extruded metal, such as steel, aluminum, or aluminum alloys. The drain grate 206 includes a first grate end 702 and a second grate end 704 opposite the first grate end 702. The first grate end 702 and the second grate end 704 are separated by a distance, shown as a grate length $D_G$. The grate length $D_G$ may be slightly less than the trough length $L_G$ such that the drain grate 206 may be received within the trough without requiring excessive force or tools. The grate length $D_G$ may be adjusted by cutting the drain grate 206 to the desired length (e.g., the trough length $L_G$, slightly less than the trough length $L_G$). For example, the drain grate 206 may be received by the installer has having the grate length $D_G$ equal to the maximum length of the trough length $L_G$. However, during installation, the trough length $L_G$ may be determined to be between the maximum trough length and the minimum trough length. To allow the drain grate 206 to fit within the trough, the installer may cut the drain grate 206. As cuts may be rough or unsightly (especially cuts made by a hacksaw in the field), the drain grate 206 may include a first endcap 706 and a second endcap 708. The first endcap 706 may be configured to be coupled to the first grate end 702 and the second endcap 708 may be configured to be coupled to the second grate end 704.

The drain grate 206 further includes a generally planar surface, shown as a first grate surface 710. The first grate surface 710 extends between the first grate end 702 and the second grate end 704. When the drain grate 206 is installed within the trough, the first grate surface 710 may face (e.g., be directed) generally in the second direction β. The first grate surface 710 may include a surface finish or unique machining to provide a desired aesthetic. For example, as shown in FIG. 8, the first grate surface 710 includes a plurality of apertures 712 profiled evenly about the entirety of the first grate surface 710. In some embodiments, the first grate surface 710 and the plurality of apertures 712 cooperate to provide an additional layer of filtering to a fluid prior to the fluid entering the trough and the outlet body 210. For example, the first grate surface 710 may be configured to allow fluids to pass through, but may prevent larger solid objects from passing through, such as rings, jewelry, debris, leaves, pebbles, and similar foreign bodies. In some embodiments, the first grate surface 710 is profiled with elongated slots that prevent debris from entering the trough. While the first grate surface 710 shows an example pattern, it should be understood that the pattern may be changed for aesthetics while the drain grate 206 is still configured to prevent debris from entering the trough.

The drain grate 206 may further include a first grate side 714 and a second grate side 716 (not shown). The first grate side 714 and the second grate side 716 may extend away from the first grate surface 710 in generally the first direction α. In some embodiments, the first grate side 714 and the second grate side 716 are parallel to one another. Both the first grate side 714 and the second grate side 716 extend between the first grate end 702 and the second grate end 704. The first grate side 714 and the second grate side 716 may be angled to facilitate insertion and removal of the drain grate 206 into and out of the trough. For example, the first grate side 714 and the second grate side 716 may be angled toward each other (e.g., the first grate side 714 and the second grate side 716 are positioned apart at a greater distance proximate the first grate surface 710 than distal to the first grate surface 710) such that the drain grate 206 may form a wedge that facilitates insertion into the trough. In some embodiments, the first grate side 714 and the second grate side 716 may be angled away from one another.

Figure 9:
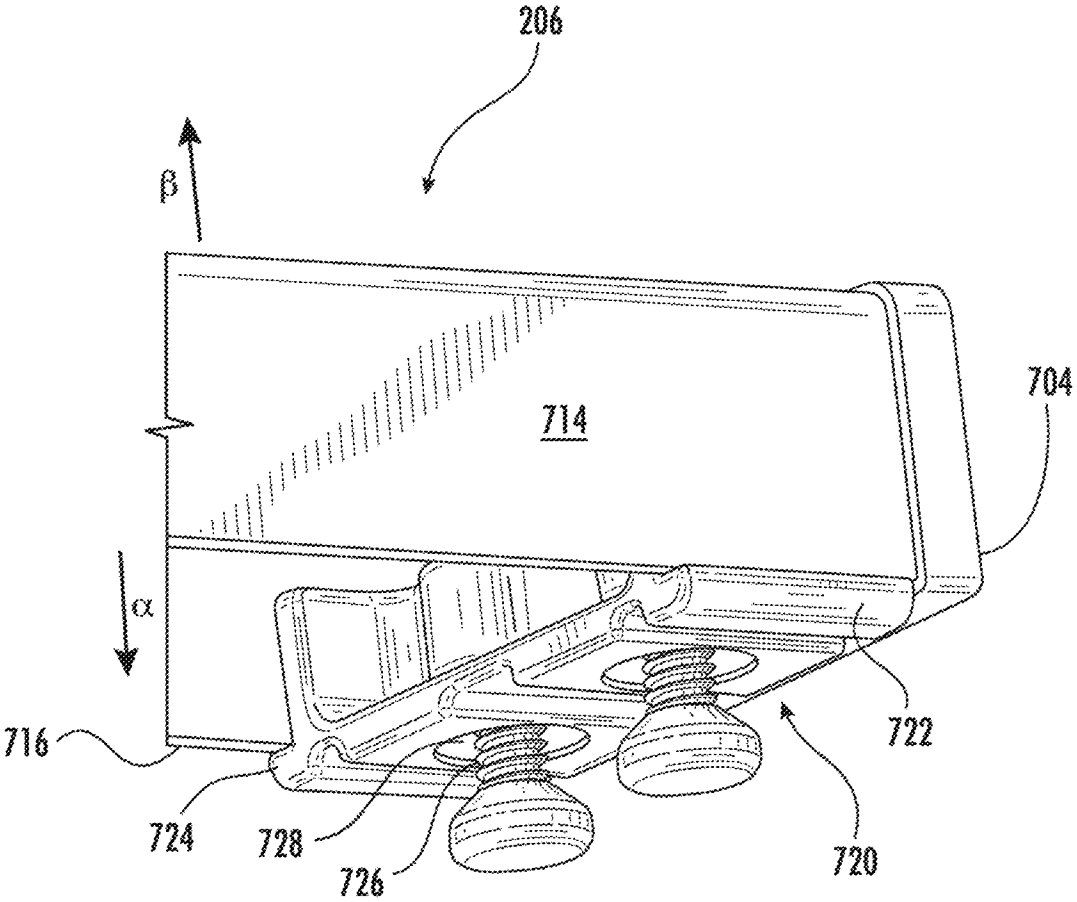
FIG. 9 is a detailed perspective view of the portion of the linear drain assembly of FIG. 8, according to an exemplary embodiment.

The drain grate 206 may further include a support structure, shown as a fixture 720, positioned within an interior of the drain grate 206. The first grate surface 710, the first grate side 714, the second grate side 716, the first endcap 706, and the second endcap 708 cooperate to form the interior of the drain grate 206. Referring to FIG. 9, a perspective cut-away portion of the drain grate 206 is shown with the fixture 720 positioned within the interior of the drain grate 206. The fixture 720 includes a first fixture flange 722 configured to interface with the first grate side 714 and a second fixture flange 724 configured to interface with the second grate side 716. When the drain grate 206 is positioned within the trough, the fixture 720 may interface with the catch pan 402 (e.g., the catch pan 502, the first base surface 312) and the first fixture flange 722 may be positioned between the first grate side 714 and the catch pan 402. Similarly, the second fixture flange 724 may be positioned between the second grate side 716 and the catch pan 402.

The fixture 720 is configured to receive a threaded body, shown as an adjustable leg 726. The adjustable leg 726 is configured to thread into a threaded orifice 728 of the fixture 720. As the adjustable leg 726 is threaded into the fixture 720, the adjustable leg 726 translates in the first direction α, interfacing with the catch pan 402 and biasing the fixture 720 away from the catch pan 402. Thus, the first fixture flange 722 and the second fixture flange 724 are displaced from the catch pan 402. This allows the drain grate 206 to be leveled within the trough. In some embodiments, the distal ends of the linear drain assembly (e.g., the catch pan 402 proximate the second end 414 and the catch pan 502 proximate to the second end 514) are raised above the first base surface 312 such that the catch pan 402 and the catch pan 502 bias fluids toward the outlet body 210. Thus, the catch pan 402 and the catch pan 502 may not be level with the ground (e.g., level relative to gravity) and the drain grate 206 would not sit flush across all of the catch pan 402, the catch pan 502, and the first base surface 312. Thus, by threading the adjustable leg 726 into the threaded orifice 728, the first fixture flange 722 and the second fixture flange 724 may be adjusted to be level. In some embodiments, the drain grate 206 includes a plurality of fixtures 720 positioned within the drain grate 206 and profiled along the length of the drain grate 206, each of the plurality of fixtures 720 interfacing with the drain grate 206 and leveling the drain grate 206. To allow for easy adjustment of the fixture 720, the adjustable leg 726 may be engaged with a tool (or by hand) from above the trough such that the adjustable leg 726 may be threaded while the fixture 720 is positioned within the trough. For example, the fixture 720, or a plurality of fixtures 720, may be positioned within the trough prior to disposing the drain grate 206 within the trough. Each of the plurality of fixtures 720 may be adjusted from above such that the first fixture flange 722 and the second fixture flange 724 are level. Then the drain grate 206 may be inserted within the trough such that the drain grate 206 interfaces with each of the first fixture flange 722 and the second fixture flange 724.

In some embodiments, the height of the fixtures 720 relative to the first base flange 318, the second base flange 320, the flange 410, and the flange 510 is adjusted prior to positioning the drain grate 206 within the trough 101. For example, if the trough length $L_G$ is 36", seven of the fixtures 720 may be positioned within the trough 101 equidistant from one another. The first fixture 720 may be positioned proximate to the second end 514, and the seventh fixture 720 may be positioned proximate to the second end 414. The five other fixtures 720 may be spaced equidistant from one another. When the drain grate 206 is positioned within the trough 101, the drain grate 206 is configured to interface with the first fixture flange 722 and the second fixture flange 724 of each of the fixtures 720. However, because the catch pan 402 and the catch pan 502 are sloped toward the outlet body 210, each of the fixtures 720 may be adjusted to facilitate leveling of the drain grate 206 within the trough 101. For example, an installer may first position the fixture 720 within the trough 101, and then use a leveling gauge to ensure that all of the first fixture flange 722 and the second fixture flange 724 are level and configured to interface with the drain grate 206 when the drain grate 206 is positioned within the trough 101. Once the fixtures 720 are leveled using the adjustable leg 726, the fixtures 720 may be removed from the trough 101 and positioned within the drain grate 206, cooperating with the drain grate 206 to form a friction fit that supports the fixtures 720 within the drain grate 206. Once the fixtures 720 are coupled to the drain grate 206, the drain grate 206 me be positioned within the trough 101.

Figure 10:
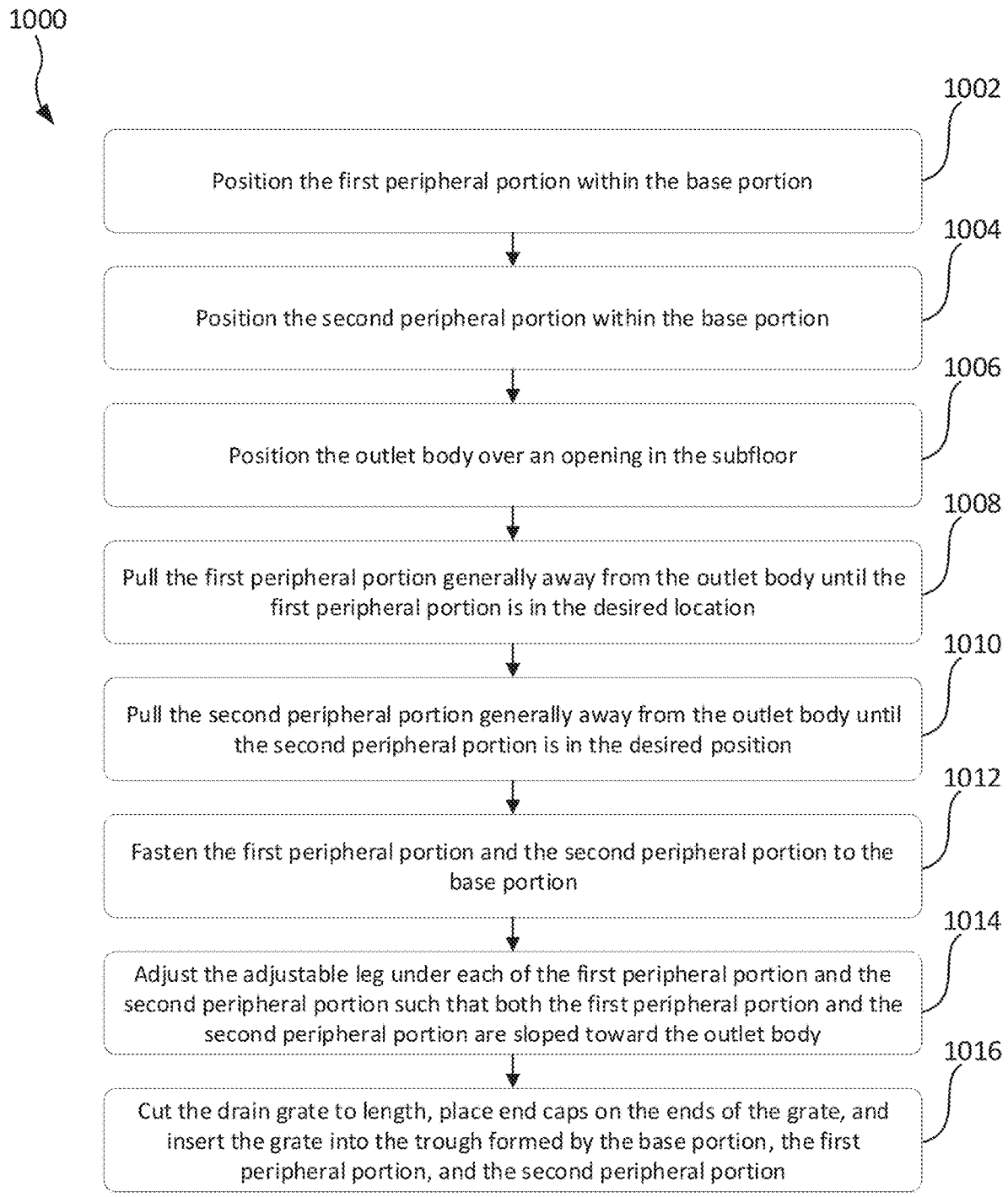
FIG. 10 is a method of assembling and installing the linear drain assembly of FIG. 1, according to an exemplary embodiment.
Figure 11:
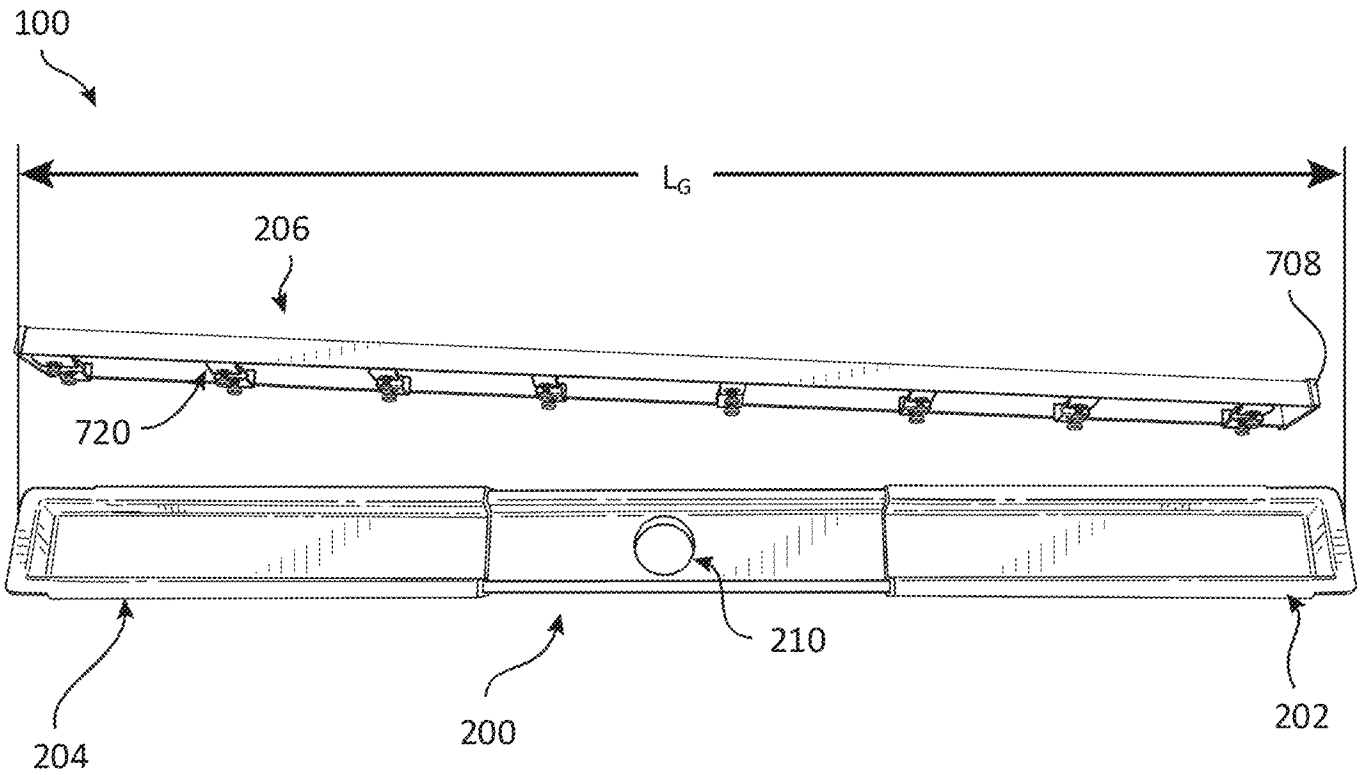
FIG. 11 is a perspective view of a linear drain assembly, according to an exemplary embodiment.

Referring to FIGS. 10 and 11, a method 1000 of assembling and installing the linear drain assembly 100 is shown and described. At 1002, slide the first peripheral portion 202 onto the base portion 200 such that the first base flange 318 is received within the first flange cavity 450 and the second base flange 320 is received within the second flange cavity 451. In some embodiments, the first peripheral portion 202 may be inserted into the base portion 200 from above. However, in some embodiments where the first peripheral portion 202 includes a flange hook, the first peripheral portion 202 is slid onto the base portion 200. The first peripheral portion 202 may be slid onto the base portion 200 such that the first end 412 is positioned proximate to the outlet body 210 and the second end 414 is positioned proximate to the second base end 302.

At 1004, slide the second peripheral portion 204 onto the base portion 200 such that the first base flange 318 is received within the first flange cavity 550 and the second base flange 320 is received within the second flange cavity 551. In some embodiments, the second peripheral portion 204 may be inserted into the base portion 200 from above. However, in some embodiments where the second peripheral portion 204 includes a flange hook, the second peripheral portion 204 is slid onto the base portion 200. The second peripheral portion 204 may be slid onto the base portion 200 such that the first end 512 is positioned proximate to the outlet body 210 and the second end 514 is positioned proximate to the second base end 302.

In some embodiments, the first peripheral portion 202 and the second peripheral portion 204 may be slidingly coupled to the base portion 200 when the installer removes the linear drain assembly 100 from the commercial packaging. Also, the fasteners may be pre-threaded into the first aperture 446 and the second aperture 456 such that the first peripheral portion 202 is able to slide along the base portion 200 and be adjusted.

At 1006, the outlet body 210 is positioned proximate to the drain plumbing configured to carry waste away from the shower enclosure. The outlet body 210 may be coupled to the drain plumbing. In some embodiments, step 1006 may be performed prior to steps 1002 and 1004.

At 1008, the first peripheral portion 202 may be slid or moved such that the first end 412 is moved away from the outlet body 210. For example, if the linear drain assembly 100 is to extend between two walls, the second end 414 of the first peripheral portion 202 may be pulled to be proximate to one of the two walls. At 1010, the second peripheral portion 204 may be slid or moved such that the first end 512 is moved away from the outlet body 210. For example, if the linear drain assembly 100 is to extend between two walls, the second end 514 of the second peripheral portion 204 may be pulled to be proximate to one of the two walls.

At 1012, the first peripheral portion 202 may be coupled to the base portion 200. The first peripheral portion 202 may be coupled to the base portion 200 using fasteners, adhesive, welding, or the like. For example, a fastener may be inserted through the first ledge 338 until the fastener interfaces with the base portion 200. The fastener may bias the base portion 200 toward the first peripheral portion 202 until a gasket (e.g., the gasket 460, the gasket 212) is compressed and forms a substantially watertight seal between the first peripheral portion 202 and the base portion 200. The second peripheral portion 204 may be coupled to the base portion 200. The second peripheral portion 204 may be coupled to the base portion 200 using fasteners, adhesive, welding, or the like. For example, a fastener may be inserted through the first ledge 538 until the fastener interfaces with the base portion 200. The fastener may bias the base portion 200 toward the second peripheral portion 204 until a gasket (e.g., the gasket 460, the gasket 212) is compressed and forms a substantially watertight seal between the second peripheral portion 204 and the base portion 200.

At 1014, the adjustable leg 220 may be adjusted to properly position the first peripheral portion 202 and the second peripheral portion 204 relative to the outlet body 210. The adjustable leg 220 may be coupled to the bracket 416.

At 1016, the drain grate 206 may be cut to fit within the trough 101 formed by the base portion 200, the first peripheral portion 202, and the second peripheral portion 204. The drain grate 206 may be formed of a metal or metal alloy and configured to be cut using a hacksaw or jigsaw. In some embodiments, the drain grate 206 is formed of wood, plastic, nylon, a polymer, or a similar material. After the drain grate 206 is cut to the appropriate length, the first endcap 706 and the second endcap 708 may be coupled to the ends of the drain grate 206. The drain grate 206 may then be placed within the trough 101, and the position of the 710 relative to the flange 410 and the flange 510 may be adjusted with the fixture 720 by threading and unthreading the adjustable leg 726 to the threaded orifice 728.

Referring specifically to FIG. 11, the linear drain assembly 100 is shown according to an exemplary embodiment. The linear drain assembly 100 is shown as including one base portion 200. However, in some embodiments, it may be desirable to couple a second base portion to the base portion 200. For example, the linear drain assembly 100 may be installed in environments where a higher-than-normal drainage rate of water is necessary or desired (e.g., automatic carwash, parking lot, 240 gallons per minute, etc.). Thus, a second base portion having a second outlet body may be coupled to the base portion 200. The base portion 200 may be coupled to the second base portion using adhesives, fasteners, welding, or the like. In some embodiments, a coupling member may be used to couple the second base portion to the base portion 200. For example, the coupling member may be similar to the first peripheral portion 202, but include two open ends. Specifically, the coupling member may be the first peripheral portion 202 with the third wall 408 removed such that water may exit the first peripheral portion 202, now modified to be a coupling member, through either of the first end 412 or the second end 414. Using such a coupling member, many base portions (e.g., 4, 6, 30, etc.) may be coupled end-to-end to create a linear drain assembly of varying lengths that may otherwise be difficult to manufacture or transport as a single body. The coupling member may be coupled to each of the second base portion and the base portion 200 such that a substantially watertight seal is formed between the coupling member, the base portion 200, and the second base portion. In a heavily flooded environment, water may exit the linear drain assembly 100 through either of the outlet body 210 or the second outlet body.

Referring now to FIGS. 12-54 a linear drain assembly is disclosed according to various example embodiments. The linear drain assemblies shown in FIGS. 12-54 are similar to the linear drain assemblies shown in FIGS. 1-11. A difference between the linear drain assemblies of FIGS. 12-54 and the linear drain assemblies of FIGS. 1-11 is that the linear drain assemblies of FIGS. 12-54 may include a waterproof adhesive or silicone sealant interposed between the base portion and the two peripheral portions that forms a watertight seal regardless of the final (e.g., total) length of the linear drain assembly. Thus, an outlet of the linear drain assembly may be positioned such that the outlet is not centered in the middle of the linear drain assembly, but is rather located closer to one end than the other end. In this manner, the linear drain may be installed in a retrofit application in a shower enclosure where the opening for the drain is not centered between two walls. The linear drain assembly may be configured to be used with the pre-existing opening for the drain while the linear drain assembly still extends wall-to-wall within the shower enclosure and provides an aesthetic that may be desirable. The adjustability of the linear drain assembly avoids having to reroute drain plumbing that does not open up in the center of a shower enclosure or shower environment.

Figure 12:
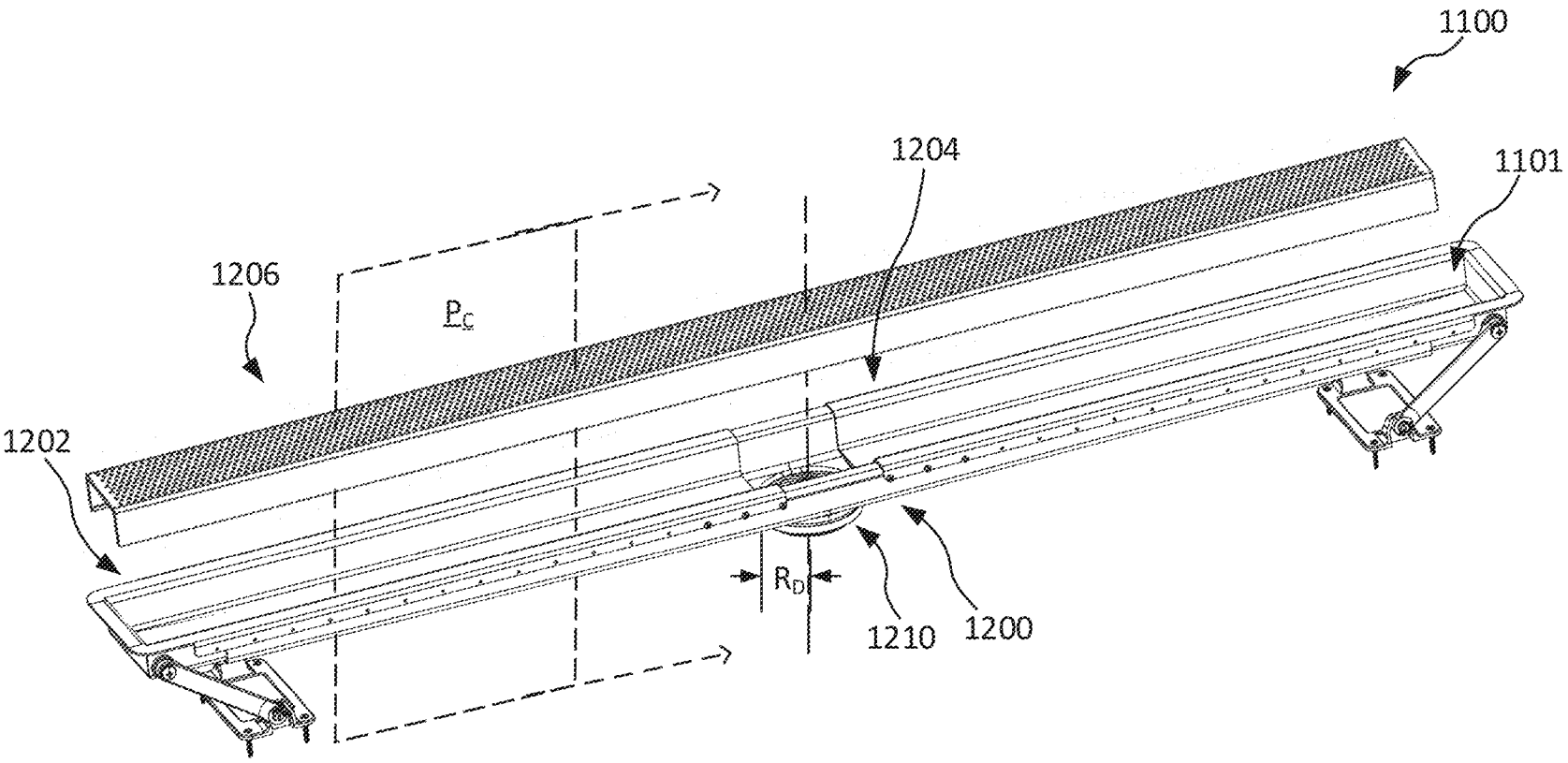
FIG. 12 is an exploded perspective view of a linear drain assembly, according to an exemplary embodiment.

Referring now to FIG. 12, an exploded, perspective view of the linear drain assembly 1100 is shown according to an exemplary embodiment. The linear drain assembly 1100 includes a base portion 1200 (e.g., first portion, etc.), a first peripheral portion 1202, a second peripheral portion 1204, and a drain grate 1206.

Generally speaking, the base portion 1200 is configured to receive the first peripheral portion 1202 and the second peripheral portion 1204. The base portion 1200, the first peripheral portion 1202, and the second peripheral portion 1204 cooperate to form a substantially watertight trough 1101. Extending substantially orthogonally away from the linear drain assembly 1100 may be an annular body, shown as an outlet body 1210. A flow of water, such as from a shower head or pool overflow, may enter the trough 1101 through the drain grate 1206 and flow toward the outlet body 1210. In some embodiments, the flow of water may enter the trough 1101 by flowing between the drain grate 1206 and the first peripheral portion 1202, between the drain grate 1206 and the second peripheral portion 1204, and between the drain grate 1206 and the base portion 1200. The outlet body 1210 may be coupled to a drain pipe configured to receive water from the linear drain assembly 1100 and carry the water away from the linear drain assembly 1100. The outlet body 1210 defines a radius, shown as a drain radius $R_D$. The outlet body 1210 defines a central axis $C_A$ that extends longitudinally through the outlet body 1210. The outlet body 1210 may be concentric about the central axis $C_A$. The linear drain assembly 1100 is longitudinally bisected (e.g., split in two lengthwise) by a plane, shown as a central plane $P_C$. From herein, the central plane $P_C$ will be used as a geometric reference point. The central axis $C_A$ is substantially parallel to the longitudinal plane $P_C$.

During installation of the linear drain assembly 1100, the outlet body 1210 is positioned over a drain in the floor. Then the first peripheral portion 1202 and the second peripheral portion 1204 are slid to the desired length. A mark may be made on the base portion 1200 to indicate the desired configuration of the first peripheral portion 202 and the second peripheral portion 1204. After determining the desired configuration of the linear drain assembly 1100, a liquid gasket (e.g., silicone sealant, rubber cement, waterproof adhesive. etc.) is interposed between the first peripheral portion 1202 and the base portion 1200. Similarly, the liquid gasket is interposed between the second peripheral portion 1204 and the base portion 1200. In some embodiments, the first peripheral portion 1202 and the second peripheral portion 1204 are removed from the base portion 1200, the liquid gasket is applied, and the first peripheral portion 1202 and the second peripheral portion 1204 are inserted back into the base portion 1200. To maintain the configuration of the linear drain assembly 1100 while the liquid gasket cures, the first peripheral portion 1202 and the second peripheral portion 204 are coupled to the base portion 1200, such as by fasteners or latches. Once the liquid gasket is cured, a substantially waterproof seal is formed between the base portion 1200 and the first peripheral portion 1202, and similarly between the base portion 1200 and the second peripheral portion 204.

Figure 13:
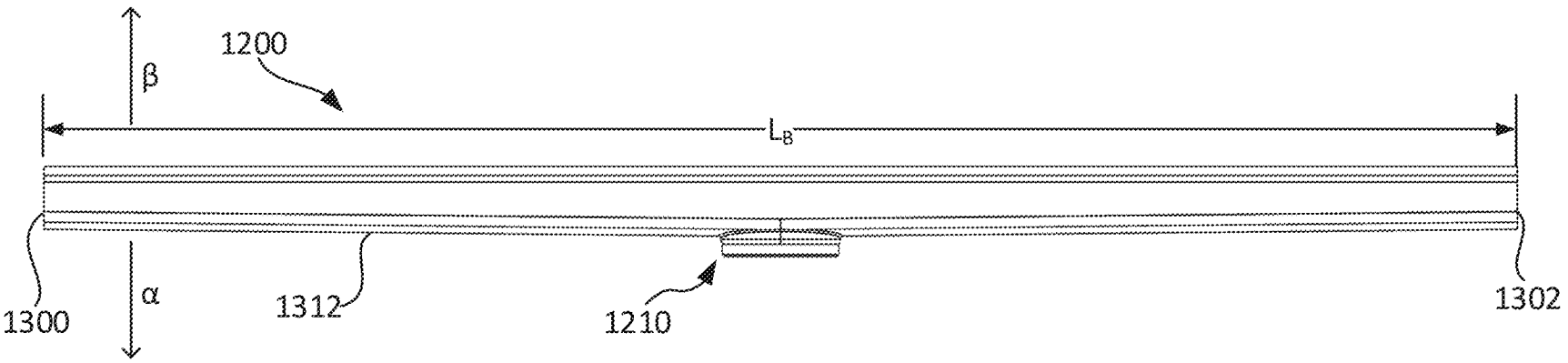
FIG. 13 is a front view of a portion of the linear drain assembly of FIG. 12, according to an exemplary embodiment.
Figure 14:
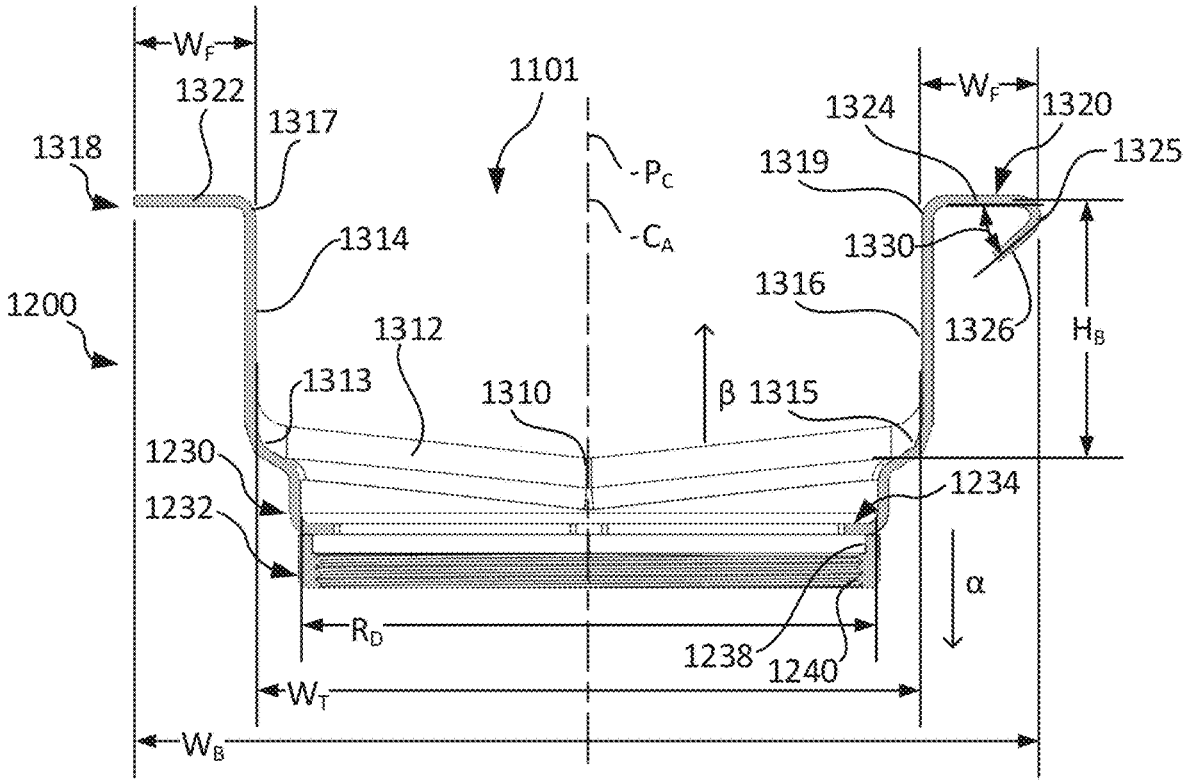
FIG. 14 is a cross-sectional side view of the portion of the linear drain assembly of FIG. 13, according to an exemplary embodiment.
Figure 15:
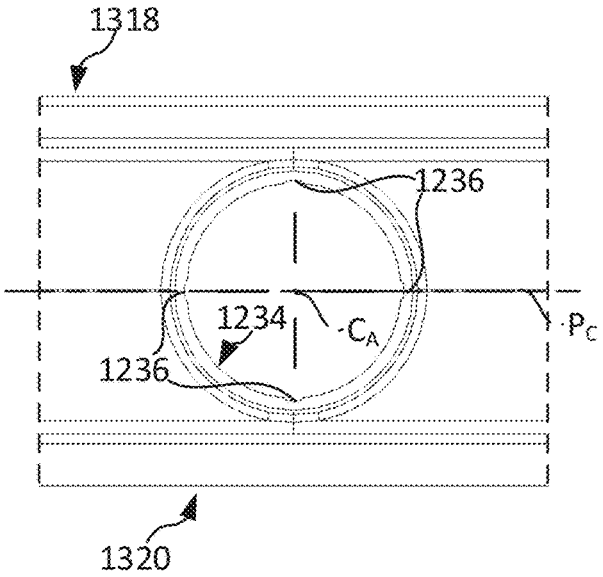
FIG. 15 is a detailed top view of the portion of the linear drain assembly of FIG. 13, according to an exemplary embodiment.

Turning to FIGS. 13-15, the base portion 1200 is shown according to an exemplary embodiment. The base portion 1200 defines a first base end 1300 and a second base end 1302 separated by a distance, shown as a base length $L_B$. In some embodiments, the base length $L_B$ is approximately (e.g., within ±5%) 30 inches. However, it should be appreciated that the base length $L_B$ may be most any length to accommodate the environment in which the linear drain assembly 1100 is installed. For example, for smaller shower enclosures (e.g., apartment shower, garden shower, etc.), the base length $L_B$ may be between approximately 10-20 inches, inclusive. In some embodiments, such as for use as a poolside drain, the base length $L_B$ may be between approximately 40-100 inches, inclusive. In some embodiments, the base portion 1200 may be coupled to a similar base portion to effectively extend the base length $L_B$. The base portion 1200 may be formed by extrusion, milling, injection molding, stamping and bending, and similar manufacturing processes. In some embodiments, the base portion 1200 is formed of 18 gauge stainless steel, such as by stamping out a pattern for the base portion 1200, bending the stainless steel, and welding the steel together to form the base portion 1200. In some embodiments, the base portion 1200 is formed of aluminum and treated, such as by anodizing or spray coating, to improve corrosion resistance.

The base portion 1200 may further include the outlet body 1210 (e.g., annular body) extending substantially orthogonally away from the base portion 200. The outlet body 1210 may be positioned such that the central axis $C_A$ lies on the central plane $P_C$. In some embodiments, the central plane $P_C$ intersects the outlet body 1210. The outlet body 1210 may be positioned equidistant from both the first base end 1300 and the second base end 1302. In some embodiments, the outlet body 1210 is positioned such that the outlet body 1210 is nearer the first base end 1300 than the second base end 1302.

When the linear drain assembly 1100 is positioned within a shower cell, a conduit may be coupled to the outlet body 1210 such that water that enters the base portion 1200 is directed toward the outlet body 1210 and may be received by a drain or sewer pipe.

Referring specifically to FIG. 14, a side, cross-sectional view of the base portion 1200 is shown from the first base end 1300. The base portion 1200 may define a portion of the trough 1101, such as a central portion of the trough 1101 positioned between the first peripheral portion 1202 and the second peripheral portion 1204. The portion of the trough 1101 defined by the base portion 1200 may be defined by a first base surface 1312, a second base surface 1314, and a third base surface 1316. The first base surface 1312 may be generally planar and extend between the first base end 1300 and the second base end 1302. In some embodiments, the first base surface 1312 is slightly sloped (e.g., pitched) toward the outlet body 1210 such that a fluid that enters the trough 1101 is be biased toward the outlet body 1210. For example, the first base surface 1312 may slope downward between the first base end 1300 and the outlet body 1210, and the first base surface 1312 may slope upward from the outlet body 1210 to the second base end 1302. In some embodiments, the first base surface 1312 is pitched toward the central plane $P_C$ such that a flow of water that enters the trough 1101 is biased toward the central plane $P_C$. Specifically, the first base surface 1312 may slope downward between the second base surface 1314 and the central plane $P_C$. Similarly, the first base surface 1312 may slope downward between the third base surface 1316 and the central plane $P_C$. The first base surface 1312 may include a bend 1310 (e.g., corner) lying substantially within the central plane $P_C$ and extending from the first base end 1300 to the outlet body 1210 and from the outlet body 1210 to the second base end 1302. In some embodiments, the first base surface 1312 is not pitched toward the outlet body 1210 and includes the bend 1310. In some embodiments, the first base surface 1312 is pitched toward the outlet body 1210 and the first base surface 1312 does not include the bend 1310. In some embodiments, the first base surface 1312 is pitched toward the outlet body 1210 and includes the bend 1310.

The outlet body 1210 extends substantially orthogonally away from the first base surface 1312 in a first direction, denoted by a, and is centered on the central axis $C_A$. The outlet body 1210 includes a first outlet portion 1230 and a second outlet portion 1232. The first outlet portion 1230 is coupled to the base portion 1200, contiguous with the first base surface 1312, and in fluid communication with the trough 1101. The first outlet portion 1230 may be integrally formed with the base portion 1200 such that the first outlet portion 1230 and the base portion 1200 are formed of a single piece, such as by stamping, pressing, milling, and similar manufacturing processes. In some embodiments, the first outlet portion 1230 is manufactured separately from the base portion 1200 and later coupled to the base portion 1200, such as by welding, fasteners, adhesives, and the like. The first outlet portion 1230 includes an outlet flange 1234 extending orthogonally away from the first outlet portion 1230 toward the central axis $C_A$. The outlet flange 1234 includes a plurality of notches 1236 configured to engage a drain cover or hair catcher such that the drain cover or hair catcher does not rotate. The second outlet portion 1232 is coupled to the first outlet portion 1230 and extends away from the first outlet portion 1230 in the first direction. The second outlet portion 1232 defines a substantially annular body including a first sealing groove 1238 and internal threads 1240. The internal threads 1240 are configured to form a threaded engagement with a drain adaptor such that the base portion 1200 may be configured (e.g., adapted) for use in various environments and with various drainage configurations. The first sealing groove 1238 is configured to receive a sealing member, such as an O-ring, where the O-ring is configured to form a sealing engagement between the outlet body 1210 and a drain adaptor. In some configurations, the first sealing groove 1238 may not be required to ensure a substantially watertight linear drain assembly 1100.

The second base surface 1314 and the third base surface 1316 may extend substantially orthogonally away from the first base surface 1312 in a second direction denoted by $\beta$, the second direction being opposite (e.g., separated by 180-rotational degrees) the first direction $\alpha$. The second base surface 1314 and the third base surface 1316 may be substantially parallel to each other. In some embodiments, the second base surface 1314 and the third base surface 1316 are substantially parallel to the central plane $P_C$. However, in some embodiments, the second base surface 1314 and the third base surface 1316 may extend away from the first base surface 1312 at a slight angle relative to the central plane $P_C$ such that the second base surface 1314 and the third base surface 1316, if extended, would intersect the central plane $P_C$ in the first direction $\alpha$.

The second base surface 1314 is contiguous with the first base surface 1312 at a first chamfer 1313. In some embodiments, the second base surface 1314 and the first base surface 1312 meet at a sharp corner (e.g., a non-differentiable corner). In some embodiments, the first chamfer 1313 is the result of bending a planar material (e.g., sheet metal) to form the first base surface 1312 and the second base surface 1314. In some embodiments, the first base surface 1312 and the second base surface 1314 are cut (e.g., waterjet, laser cut, etc.) from the same piece of planar material and coupled together, forming the first chamfer 1313. In some embodiments, the first chamfer 1313 is a weld.

The third base surface 1316 is contiguous with the first base surface 1312 at a second chamfer 1315. In some embodiments, the third base surface 1316 and the first base surface 1312 meet at a sharp corner. In some embodiments, the second chamfer 1315 is the result of bending a planar material to form the first base surface 1312 and the third base surface 1316. In some embodiments, the first base surface 1312 and the third base surface 1316 are cut from the same piece of planar material and coupled together, forming the second chamfer 1315. In some embodiments, the second chamfer 1315 is a weld.

The base portion 1200 may further include a first base flange 1318 extending from an end of the second base surface 1314 opposite from the first base surface 1312 in a direction generally away from the central plane $P_C$. The first base flange 1318 defines a flange width $W_F$, defined as a distance between the second base surface 1314 and an end of the first base flange 1318 distal from the second base surface 1314. The base portion 1200 may further include a second base flange 1320 extending substantially orthogonally away from an end of the third base surface 1316 distal from the first base surface 1312 in a direction generally away from the central plane $P_C$. A width of the second base flange 1320 may be equal to the flange width $W_F$.

The first base flange 1318 includes a surface, shown as a fourth base surface 322, and the second base flange 1320 includes a surface, shown as a fifth base surface 1324. The fourth base surface 1322 and the fifth base surface 1324 may be generally parallel to one another such that both the fourth base surface 1322 and the fifth base surface 324 lie within the same plane. The fourth base surface 1322 and the fifth base surface 1324 may be separated from the first base surface 1312 by a distance, shown as a base height $H_B$. The fourth base surface 1322 may extend substantially orthogonally away from the second base surface 1314 in a direction generally away from and generally perpendicular to (e.g., between 85° and 95° from) the central plane $P_C$. The fourth base surface 1322 may be contiguous with the second base surface 1314 and may meet (e.g., be coupled to) the second base surface 1314 at a third chamfer 1317. In some embodiments, the fourth base surface 1322 and the second base surface 314 meet at a sharp corner. In some embodiments, the third chamfer 1317 is the result of bending a planar material to form the second base surface 1314 and the fourth base surface 1322. In some embodiments, the second base surface 1314 and the fourth base surface 1322 are cut from the same piece of planar material and coupled together, forming the third chamfer 1317. In some embodiments, the third chamfer 1317 is a weld.

The fifth base surface 1324 may extend substantially orthogonally away from the third base surface 1316 in a direction generally away from and generally perpendicular to (e.g., between 85° and 95° from) the central plane $P_C$. The fifth base surface 1324 may be contiguous with the third base surface 1316 and may meet (e.g., be coupled to) the third base surface 1316 at a fourth chamfer 1319. In some embodiments, the fifth base surface 1324 and the third base surface 1316 meet at a sharp corner. In some embodiments, the fourth chamfer 1319 is the result of bending a planar material to form the third base surface 1316 and the fifth base surface 1324. In some embodiments, the third base surface 1316 and the fifth base surface 1324 are cut from the same piece of planar material and coupled together, forming the fourth chamfer 1319. In some embodiments, the fourth chamfer 1319 is a weld.

The second base flange 1320 further includes a sixth base surface 1326 extending away from the fifth base surface 1324 and toward the central plane $P_C$ at a non-zero angle, shown as a first angle 1330. The sixth base surface 1326 extends away from the fifth base surface 1324 opposite the third base surface 1316. The sixth base surface 1326 may be contiguous with the fifth base surface 1324 and may meet (e.g., be coupled to) the fifth base surface 1324 at a fifth chamfer 1325. In some embodiments, the sixth base surface 1326 and the fifth base surface 1324 meet at a sharp corner. In some embodiments, the fifth chamfer 1325 is the result of bending a planar material to form the sixth base surface 1326. In some embodiments, the sixth base surface 1326 and the fifth base surface 1324 are cut from the same piece of planar material and coupled together, forming the fifth chamfer 1325. In some embodiments, the fifth chamfer 1325 is a weld.

The second base surface 1314 and the third base surface 1316 are separated by a distance, shown as a trough width $W_T$. In some embodiments the trough width $W_T$ may be less (e.g., shorter) proximate to the first chamfer 1313 and the second chamfer 315 than proximate to the third chamfer 1317 and the fourth chamfer 1319. However, both instances are referred to as the trough width $W_T$. In some embodiments, the base height $H_B$ is less than the trough width $W_T$. The base portion 1200 also defines a distance between the end of the first base flange 1318 distal the second base surface 1314 and the end of the second base flange 1320 distal the third base surface 1316, the distance shown as a base width $W_B$.

In some embodiments, the base portion 1200 may be formed by extrusion. For example, the first base surface 1312, the second base surface 1314, the third base surface 1316, the fourth base surface 1322, the fifth base surface 1324, and the sixth base surface 1326 may be integrally formed in a single body by extrusion, bending, or stamping. Then, the outlet body 1210 may be formed, such as by stamping, punching, pressing, or by coupling the outlet body 1210 to the base portion 1200, such as by welding. In some embodiments, the sloping of the first base surface 1312 may be achieved by cutting the base portion 1200 from a flat sheet of material and welding first base surface 1312 to both of the second base surface 1314 and the third base surface 1316.

Figure 16:
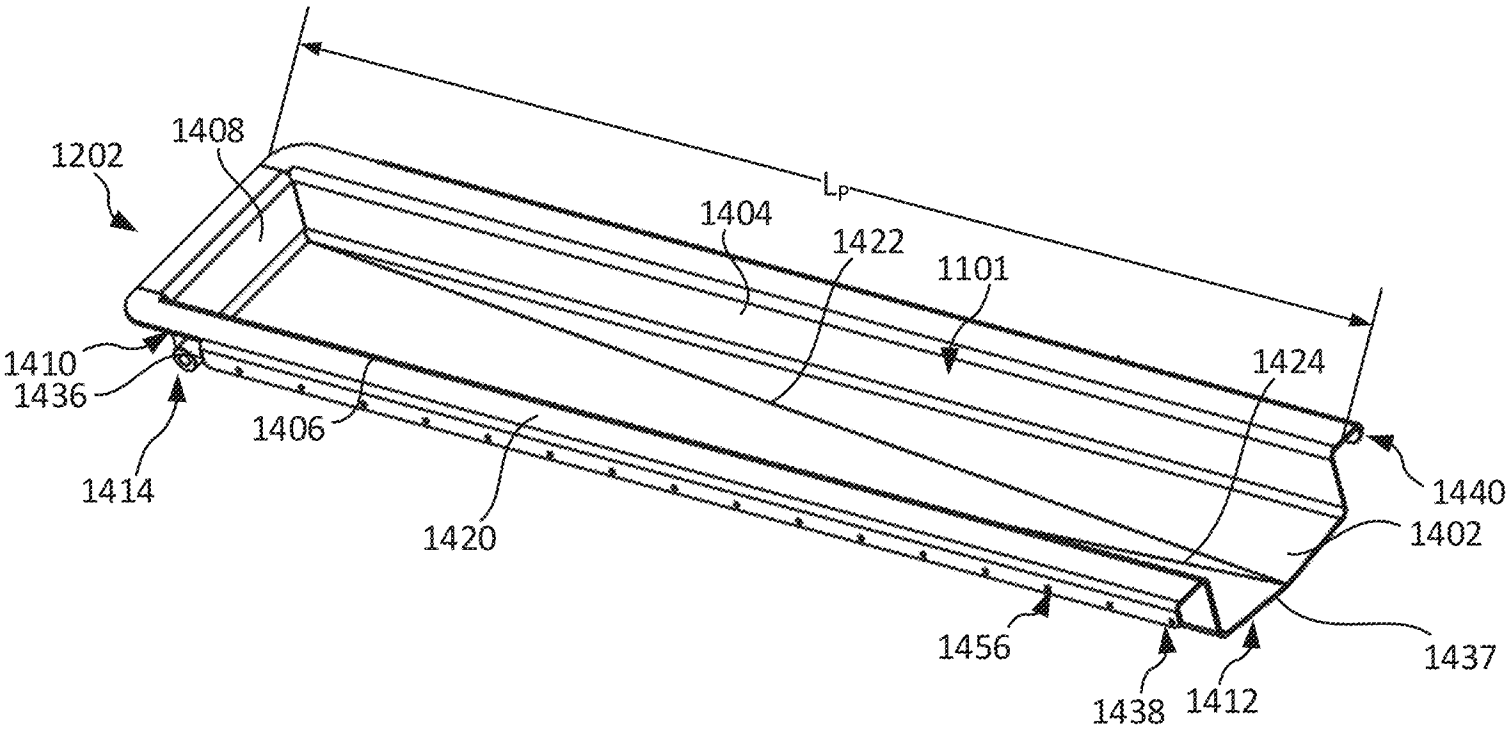
FIG. 16 is a perspective view of a portion of the linear drain assembly of FIG. 17, according to an exemplary embodiment.
Figure 17:
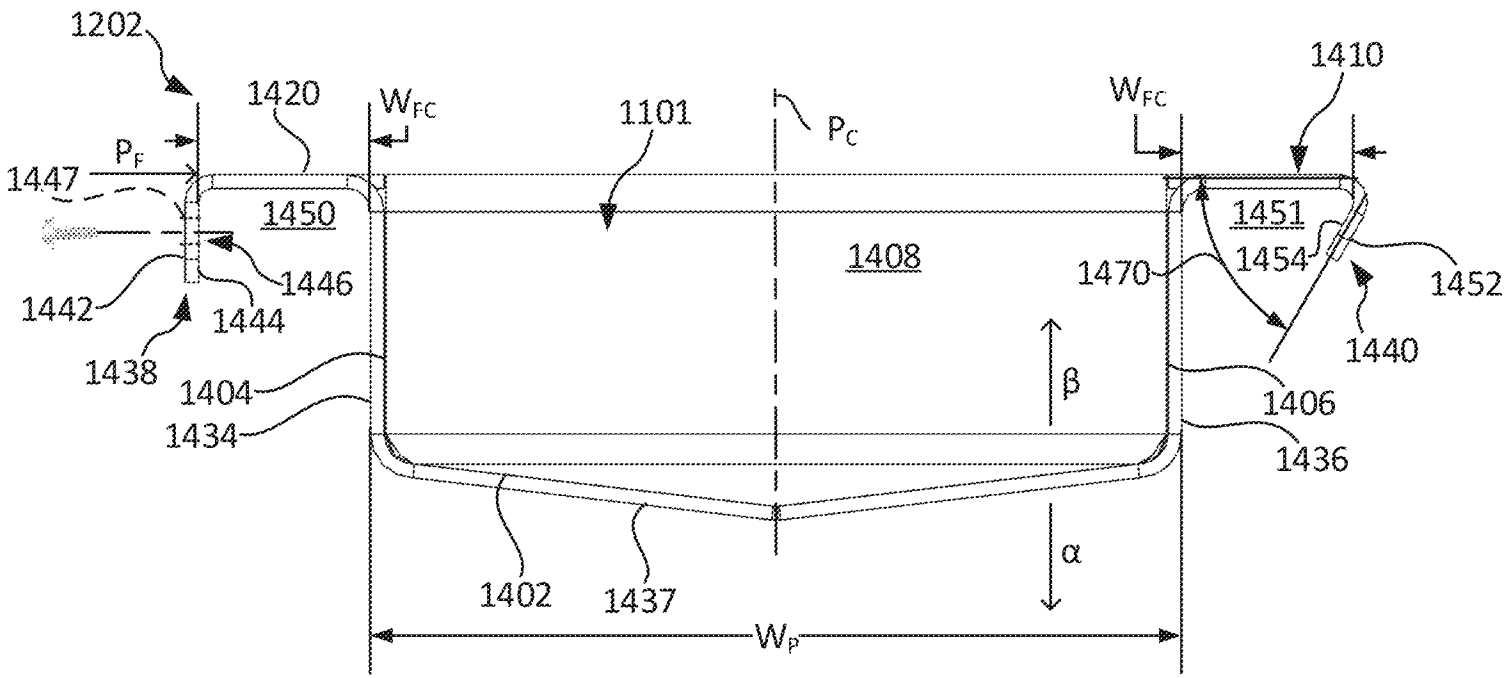
FIG. 17 is a side view of the portion of the linear drain assembly of FIG. 16, according to an exemplary embodiment.

Referring now to FIGS. 16-17, the first peripheral portion 1202 is shown. While only the first peripheral portion 1202 is shown, it should be understood that the second peripheral portion 1204 is similar to the first peripheral portion 1202. In some embodiments, the second peripheral portion 1204 is a mirror image of the first peripheral portion 1202. In some embodiments, the first peripheral portion 1202 and the second peripheral portion 1204 are identical such that a user may not be able to distinguish the first peripheral portion 1202 from the second peripheral portion 1204. In some embodiments, both the first peripheral portion 1202 and the second peripheral portion 1204 include a label or marker that distinguish them from each other (e.g., 'L' and 'R', 'A' and 'B', '1' and '2', etc.). For example, the first peripheral portion 1202 and the second peripheral portion 1204 are "polarized," or are designed to have a specific orientation relative to the base portion 1200. The first peripheral portion 1202 and the second peripheral portion 1204 may be formed by extrusion, milling, injection molding, stamping and bending, and similar manufacturing processes. In some embodiments, the first peripheral portion 1202 and the second peripheral portion 1204 are formed of 18 gauge stainless steel, such as by stamping out a pattern for the first peripheral portion 1202 and the second peripheral portion 1204, bending the stainless steel, and welding the steel together to form the first peripheral portion 1202 and the second peripheral portion 1204. In some embodiments, the first peripheral portion 1202 and the second peripheral portion 1204 are formed of aluminum and treated, such as by anodizing or spray coating, to improve corrosion resistance.

Referring specifically to FIG. 16, a perspective view of the first peripheral portion 1202 is shown, according to an example embodiment. The first peripheral portion 1202 includes a catch pan 1402 (e.g., first surface, bottom surface, etc.), a first wall 1404, a second wall 1406, and a third wall 1408. Each of the catch pan 1402, the first wall 1404, the second wall 1406, and the third wall 1408 cooperate to define a portion of the trough 1101. The first peripheral portion 1202 also includes a generally planar and contiguous flange 1410 that extends from each of the first wall 1404, the second wall 1406, and the third wall 1408.

The catch pan 1402 extends between a first end 1412 and a second end 1414 of the first peripheral portion 1202. The first peripheral portion defines a length, shown as a portion length $L_P$, the portion length $L_P$ defined as the distance between the first end 1412 and the flange 1410 proximate to the second end 1414. Both the first peripheral portion 1202 and the second peripheral portion 1204 may be defined by the peripheral length $L_P$.

The first wall 1404 and the second wall 1406 extend away from the catch pan 1402 in generally the second direction β. In some embodiments, the first wall 1404 and the second wall 1406 are parallel to one another. However, in some embodiments, the first wall 1404 and the second wall 1406 may extend away from the catch pan 1402 in a direction other than perpendicularly. For example, the first wall 1404 may extend away from the catch pan 1402 such that the first wall 1404 is sloped toward the central plane $P_C$ (e.g., the first wall 1404, if extended, would intersect the central plane $P_C$ in the first direction α). Similarly, the second wall 1406 may be sloped toward the central plane $P_C$ (e.g., the second wall 1406, if extended, would intersect the central plane $P_C$ in the first direction α).

The third wall 1408 extends from the catch pan 1402 in the second direction β. In some embodiments, the third wall 1408 extends from the catch pan 1402 perpendicularly. In some embodiments, the third wall 1408 slopes toward the outlet body 1210 such that the third wall 1408, if extended, would intersect a central axis of the outlet body 1210 in the first direction α.

Each of the first wall 1404, the second wall 1406, and the third wall 1408 are contiguous with the catch pan 1402. In some embodiments, the first wall 1404 meets the catch pan 1402 at a sharp corner. In some embodiments, the transition between the catch pan 1402 and the first wall 1404 is a gradual curve and may be the result of bending a planar material to form the first wall 1404 and the catch pan 1402. In some embodiments, the second wall 1406 meets the catch pan 1402 at a sharp corner. The transition between the catch pan 1402 and the second wall 1406 may be a gradual curve and may be the result of bending a planar material to form the second wall 1406 and the catch pan 1402. In some embodiments, the third wall 1408 meets the catch pan 1402 at a sharp corner. The transition between the catch pan 1402 and the third wall 1408 may be a gradual curve and may be the result of bending a planar material to form the third wall 1408 and the catch pan 1402.

The third wall 1408 is contiguous with both the first wall 1404 and the second wall 1406. In some embodiments, the first peripheral portion 1202 is cut from a flat sheet of a planar material, such as steel or aluminum (or similar alloys) and welded. While the transition between the first wall 1404 and the catch pan 1402 may be the result of bending a flat sheet of planar material, the transition between the first wall 1404 and the third wall 1408 may be formed by coupling the first wall 1404 to the third wall 1408, such as by welding. Similarly, the second wall 1406 and the third wall 1408 may be welded together and form a curved transition. In some embodiments, the first peripheral portion 1202 is formed by hydroforming, vacuum molding, cold forging, or similar manufacturing processes.

Referring specifically to FIG. 17, a side view of the first peripheral portion 1202 is shown from the first end 1412. The flange 1410 may define a flange surface 1420, and both the flange 1410 and the flange surface 1420 may lie within a plane substantially orthogonal to the central plane $P_C$, shown as a flange plane $P_F$. The flange 1410 extends from all of the first wall 1404, the second wall 1406, and the third wall 408. The flange surface 1420 is contiguous with all of the first wall 1404, the second wall 1406, and the third wall 1408. Generally speaking, the flange 1410 extends between the first end 1412 and the second end 1414 along both the first wall 1404 and the second wall 1406. The flange 1410 also extends away from the second end 1414.

The flange plane $P_F$ may be parallel to the catch pan 1402. In some embodiments, the catch pan 1402 is pitched toward the first end 1412. The catch pan 1402 may include a plurality of creases, shown as a first crease 1422 and a second crease 1424. The first crease 1422 extends from the middle of the first end 1412 to the intersection of the first wall 1404 and the third wall 1408. And the second crease 1424 extends from the middle of the first end 1412 to the intersection of the second wall 1406 and the third wall 1408. The first crease 1422, the second crease 1424, and the intersection of the third wall 1408 and the catch pan 1402 cooperate to form a substantially triangular body configured to direct water toward the first end 1412. In some embodiments, a distance between the catch pan 1402 and the flange plane $P_F$ may be less proximate to the second end 1414 than a distance between the catch pan 1402 and the flange plane $P_F$ proximate to the first end 1412. When the linear drain assembly 1100 is installed, the slope of the catch pan 1402 of the first peripheral portion 1202 may facilitate drainage of water such that water is directed from the second end 1414 to the first end 1412, and thus from the first peripheral portion 1202 to the base portion 1200.

The flange 1410 is contiguous with all of the first wall 1404, the second wall 1406, and the third wall 1408. In some embodiments, flange 1410 is not parallel to the flange plane $P_F$, but is instead sloped inward and toward the catch pan 1402. Such a slope of the flange 1410 may facilitate drainage of water into first peripheral portion 1202. In some embodiments, water is not configured to interface with the flange 1410 when the linear drain assembly 1100 is assembled and installed. For example, to facilitate coupling of the first peripheral portion 1202 to the base portion 1200, the flange 1410 may be angled away from the catch pan 1402.

The first peripheral portion 1202 further comprises a first outer wall 1434 and a second outer wall 1436. The first outer wall 1434 may face in a direction generally away from the central plane $P_C$. Similarly, the second outer wall 1436 may face in a direction generally away from the central plane $P_C$. Generally speaking, the first peripheral portion 1202 is configured to be received within the base portion 1200. To allow for such a configuration, the first outer wall 1434 and the second outer wall 1436 are separated by a distance, shown as a peripheral width $W_P$. While a distance between the first outer wall 1434 and the second outer wall 1436 may be different at different points (e.g., a greater distance proximate to the flange 1410 when compared to a lesser distance proximate to the catch pan 1402), the peripheral width $W_P$ designates the distance between the first outer wall 1434 and the second outer wall 1436. To allow for the first peripheral portion 1202 to be received within the base portion 1200, the peripheral width $W_P$ is less than the trough width $W_T$.

The flange 1410 includes a first ledge 1438 and a second ledge 1440. The first ledge 1438 extends substantially orthogonally away from the flange 1410 in the first direction α at an end of the flange 1410 opposite the second wall 1406. In some embodiments, the first ledge 1438 is generally parallel)(±5° to the first wall 1404. The first ledge 1438 includes an outer ledge surface 1442 and an inner ledge surface 1444. The outer ledge surface 1442 is contiguous with the flange surface 1420. In some embodiments, the outer ledge surface 442 meets the flange surface 1420 at a curved interface, such as may be achieved by bending a planar material at approximately 90 degrees. The inner ledge surface 1444 and the first outer wall 1434 are separated by a distance, shown as a flange cavity width $W_{FC}$. The first outer wall 1434, the flange 1410, and the inner ledge surface 1444 cooperate to form a first flange cavity 450 defined in part by the flange cavity width $W_{FC}$ such that the first flange cavity 1450 may receive the second base flange 1320. Specifically, the flange cavity width $W_{FC}$ is greater than the flange width $W_F$ of the second base flange 1320.

The first ledge 1438 further includes a first aperture 1446 defined by a generally annular surface, shown as an aperture surface 1447. The aperture surface 1447 extends through the first ledge 1438 and is contiguous with both the outer ledge surface 1442 and the inner ledge surface 1444. In some embodiments, the aperture surface 1447 may be tapped (e.g., threaded) to receive a screw. In some embodiments, the aperture surface 1447 is configured to receive a self-tapping screw or a sheet metal screw. The first aperture 1446 is configured to receive a fastener, such as a sheet metal screw, that is configured to selectively couple one of the first base flange 1318 or the second base flange 1320 to the first peripheral portion 1202.

The second ledge 1440 extends away from the flange 1410 at a non-zero angle, shown as a second angle 1470. The second ledge 1440 extends generally in the first direction a and generally toward the central plane $P_C$. The second angle 1470 may be greater than the first angle 1330. In some embodiments, the second angle 1470 is approximately equal to the first angle 1330. In some embodiments, the second angle 1470 is less than the first angle 1330. The second ledge 1440 includes an outer ledge surface 1452 and an inner ledge surface 1454. The outer ledge surface 1452 is contiguous with the flange surface 1420. In some embodiments, the outer ledge surface 1452 meets the flange surface 1420 at a curved interface, such as may be achieved by bending a planar material at approximately 90 degrees. The inner ledge surface 1454 and the second outer wall 1436 may be separated by a distance equal to or approximately equal to the flange cavity width $W_{FC}$. The second outer wall 1436, the flange 1410, and the inner ledge surface 1454 cooperate to form a second flange cavity 1451 defined in part by the flange cavity width $W_{FC}$ such that the second flange cavity 1451 may receive the first base flange 1318. When the linear drain assembly 1100 is installed, the first flange cavity 1450 may receive the second base flange 1320 while the second flange cavity 1451 receives the first base flange 1318.

Referring again to FIG. 16, the first ledge 1438 may include a plurality of apertures configured to receive a plurality of fasteners, the plurality of apertures profiled along a length of the first ledge 1438. In some embodiments, the first ledge 1438 does not extend the full length of the first peripheral portion 1202. For example, the first ledge 1438 may extend to the first end 1412, but the first ledge 1438 may not extend to the second end 1414. Thus, the first ledge 1438 may not be contiguous with the second ledge 1440. However, in some embodiments, the first ledge 1438 and the second ledge 1440 are contiguous, for example in embodiments where a third ledge extends from the flange 1410 proximate to the second end, the third ledge may be contiguous with both the first ledge 1438 and the second ledge 1440.

Figure 18:
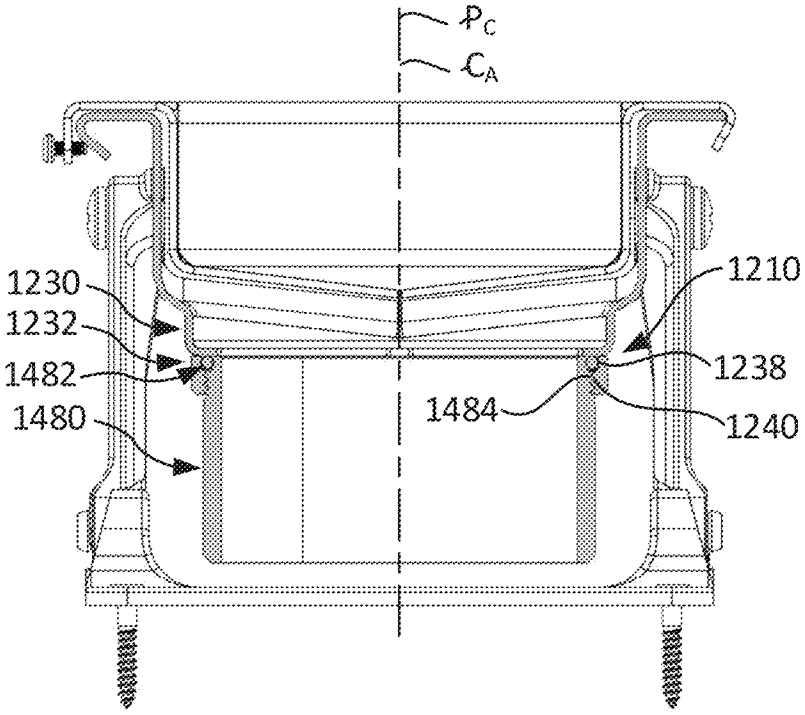
FIG. 18 is a cross-sectional side view of a portion of the linear drain assembly of FIG. 12, according to an exemplary embodiment.

Turning to FIG. 18, a cross-section of the outlet body 1210 is shown according to an embodiment. The outlet body 1210 may include a coupling member 1480 and a sealing member 1482 (e.g., O-ring). The coupling member 1480 defines a generally annular body having external threads 1484 positioned proximate to an end of the coupling member 1480. The external threads 1484 are configured to form a threaded engagement with the internal threads 1240 of the second outlet portion 1232. The second outlet portion 1232, the coupling member 1480, and the outlet flange 1234 cooperate to form the first sealing groove 1238 configured to receive the sealing member 1482. When the coupling member 1480 is coupled to the second outlet portion 1232, the sealing member 1482 is compressed and forms a substantially watertight seal between the coupling member 1480 and the outlet body 1210. The coupling member 1480 is configured to be coupled to drain plumbing, such as a rubber coupling, PVC plumbing, and the like.

Figure 19:
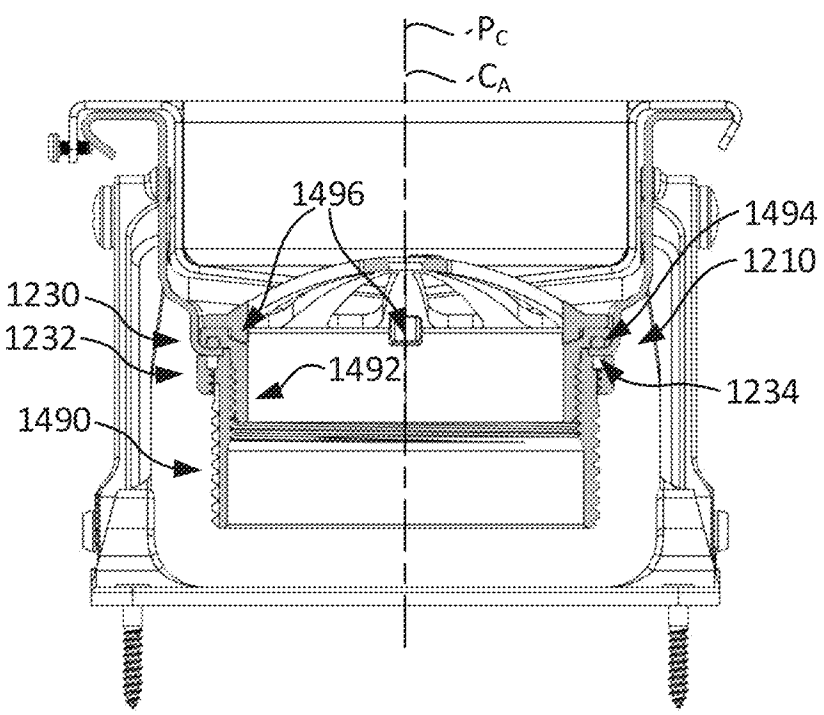
FIG. 19 is a cross-sectional side view of the portion of the linear drain assembly of FIG. 18, according to an exemplary embodiment.

Referring to FIG. 19 a cross-section of the outlet body 1210 is shown according to another embodiment. The outlet body 1210 may include a second coupling member 1490, a drain body 1492, and a second sealing member 1494. The second coupling member 1490 defines a generally annular body having external threads configured to be threadingly coupled to drain plumbing. The second coupling member 1490 further includes internal threads configured to be coupled to the drain body 1492. The drain body 1492 cooperates with the second coupling member 1490 to compress the second sealing member 1494 between the drain body 1492 and the outlet flange 1234 to form a substantially watertight seal. The drain body 1492 further includes a plurality of notches 1496 configured to receive a drain cover or hair trap such that the hair trap is prevented from rotation.

In some embodiments, the first peripheral portion 1202 includes a roughened surface that is configured to receive an adhesive or seal. For example, the first peripheral portion 1202 may include a roughened surface that extends across all of the first outer wall 1434, the second outer wall 1436, the flange 1410, and the outer catch surface 1437. The roughened surface may increase the surface area available for an adhesive to adhere to. When an installer is ready to position the first peripheral portion 1202 within the base portion 1200, the installer may apply an adhesive (e.g., bead of caulking, silicon sealant, gasket, etc.) to the roughened surface and then place the first peripheral portion 1202 within the base portion 1200. The first peripheral portion 1202 may be inserted from above (e.g., from the second direction β and in the first direction α) such that the adhesive is interposed between the roughened surface and the base portion 1200. The adhesive applied to roughened surface of the first peripheral portion 1202 may be squeezed and spread along the base portion 1200 as the first peripheral portion 1202 is slid along the base portion 1200.

Figure 20:
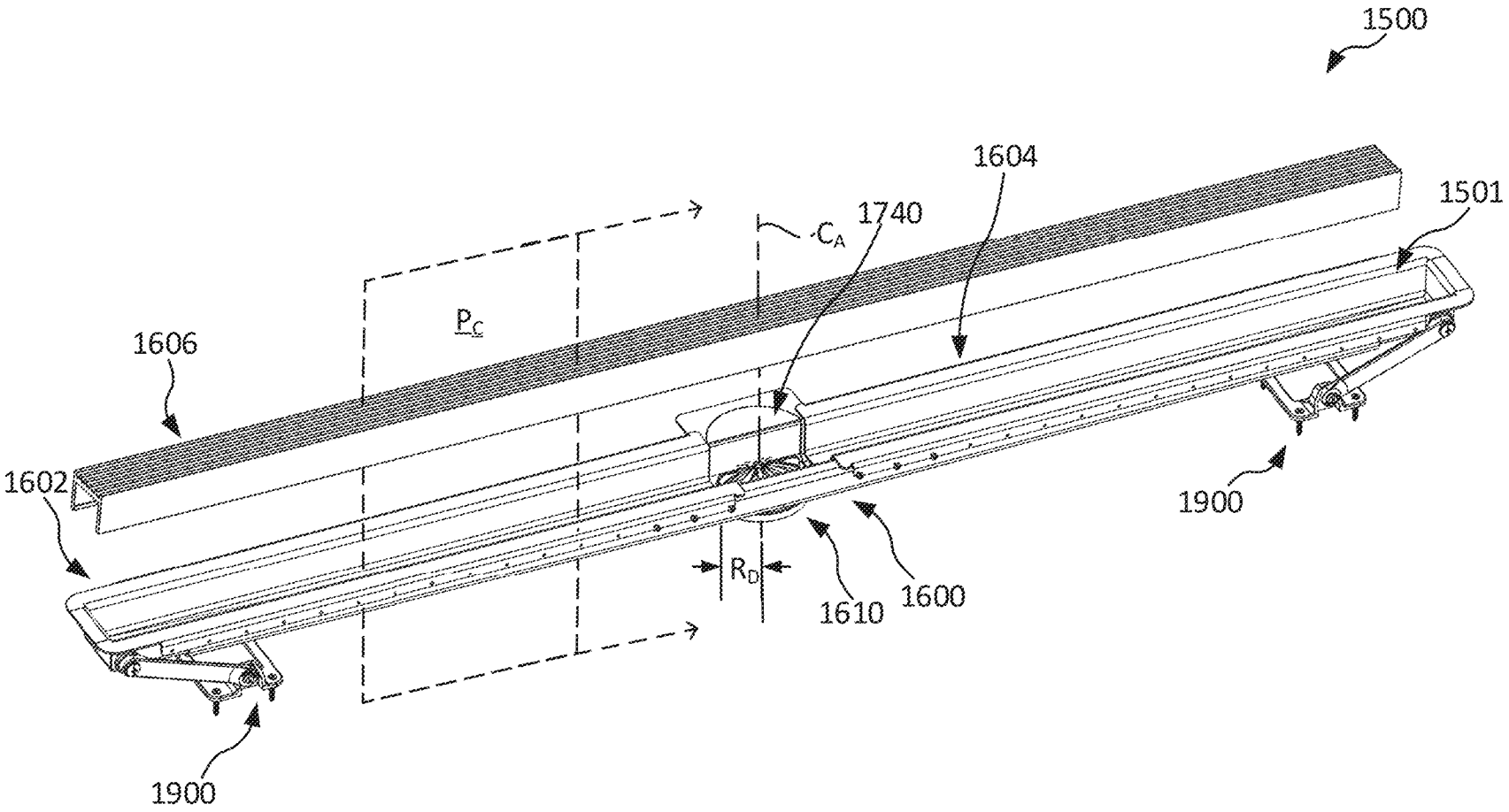
FIG. 20 is an exploded perspective view of a linear drain assembly according to another embodiment.
Figure 21:
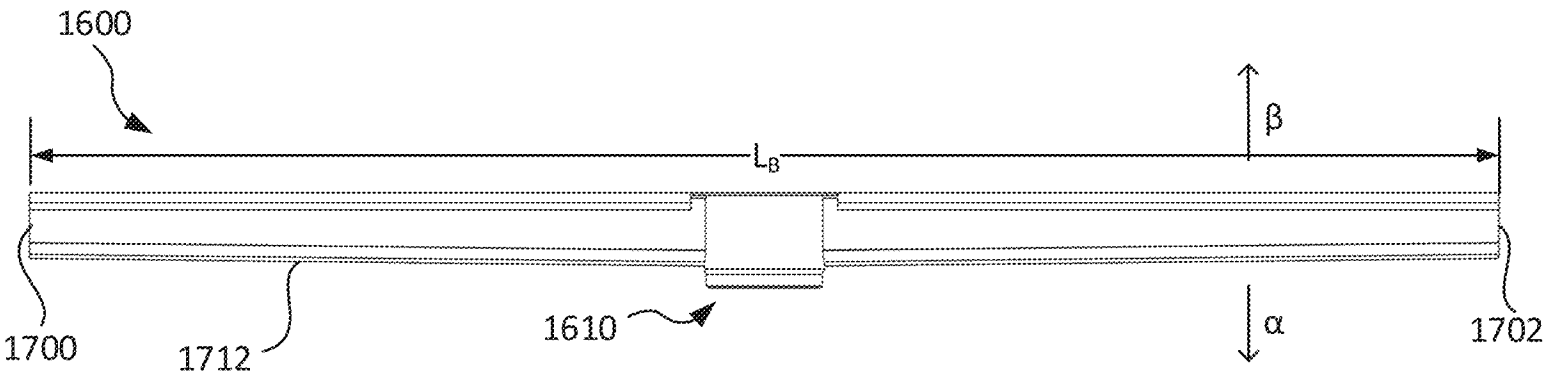
FIG. 21 is a front view of a portion of the linear drain assembly of FIG. 20, according to an exemplary embodiment.

Referring now to FIG. 20, an exploded, perspective view of a linear drain assembly 1500 is shown according to another example embodiment. The linear drain assembly 1500 includes a base portion 1600 (e.g., first portion, etc.), a first peripheral portion 1602, a second peripheral portion 1604, and a drain grate 1606. The linear drain assembly 1500 is similar to the linear drain assembly 1100. Accordingly, like numbering is used to designate like parts between the linear drain assembly 1500 and the linear drain assembly 1100. A difference between the linear drain assembly 1100 and the linear drain assembly 1500 is that the linear drain assembly 1500 defines a narrower trough 1501 than the trough 1101 of the linear drain assembly 1100. In some embodiments, the linear drain assembly 1500 is approximately one-half of the width of the linear drain assembly 1100.

The base portion 1600 is configured to receive the first peripheral portion 1602 and the second peripheral portion 1604 to adjust a length of the linear drain assembly 1500 and form a substantially watertight trough 1501. Extending substantially orthogonally away from the linear drain assembly 1500 may be an annular body, shown as an outlet body 1610. The outlet body 1610 of the linear drain assembly 1500 is similar to the outlet body 1210 of the linear drain assembly 1100. In some embodiments, the outlet body 1610 and the outlet body 1210 both define the drain radius $R_D$. A flow of water, such as from a shower head or pool overflow, may enter the trough 1501 through the drain grate 1606 and flow toward the outlet body 1610. In some embodiments, the flow of water may enter the trough 1501 by flowing between the drain grate 1606 and the first peripheral portion 1602, flowing between the drain grate 1606 and the second peripheral portion 1604, and flowing between the drain grate 1606 and the base portion 1600. The outlet body 1610 may be coupled to a drain pipe configured to receive water from the linear drain assembly 1100 and carry the water away from the linear drain assembly 1100. The linear drain assembly 1100 may also be longitudinally bisected (e.g., split in two lengthwise) by a plane, shown as a central plane $P_C$. From herein, the central plane $P_C$ will be used as a geometric reference point.

During installation of the linear drain assembly 1500, the outlet body 1610 is positioned over a drain in the floor. Then the first peripheral portion 1602 and the second peripheral portion 1604 are slid to the desired length and a mark may be made on the base portion 1600 to indicate the desired alignment of the first peripheral portion 1602 and the second peripheral portion 1604 relative to the base portion 1600. After determining a desired configuration of the linear drain assembly 1500, a liquid gasket may be interposed between the first peripheral portion 1602 and the base portion 1600. Similarly, the liquid gasket may be interposed between the second peripheral portion 1604 and the base portion 1600. In some embodiments, the first peripheral portion 1602 and the second peripheral portion 1604 are removed from the base portion 1600, the liquid gasket is applied to each of the first peripheral portion 1602 and the second peripheral portion 1604, and the first peripheral portion 1202 and the second peripheral portion 1204 are inserted back into the base portion 1600. To maintain the configuration of the linear drain assembly 1500 while the liquid gasket cures, the first peripheral portion 1602 and the second peripheral portion 1604 are coupled to the base portion 1600, such as by fasteners or latches. Once the liquid gasket is cured, a substantially waterproof seal is formed between the base portion 1600 and the first peripheral portion 1602, and similarly between the base portion 1600 and the second peripheral portion 1604.

Figure 22:
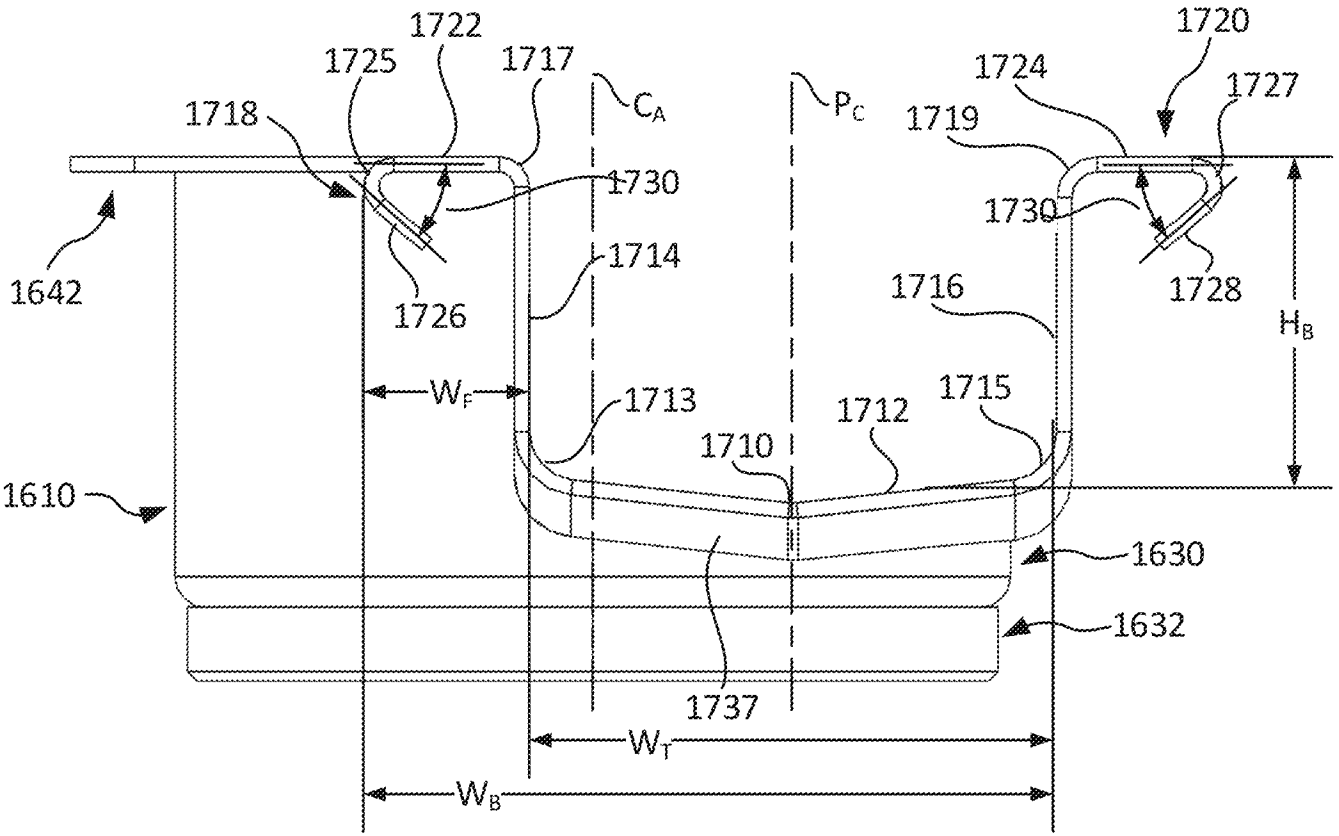
FIG. 22 is a side view of the portion of the linear drain assembly of FIG. 21, according to an exemplary embodiment.
Figure 24:
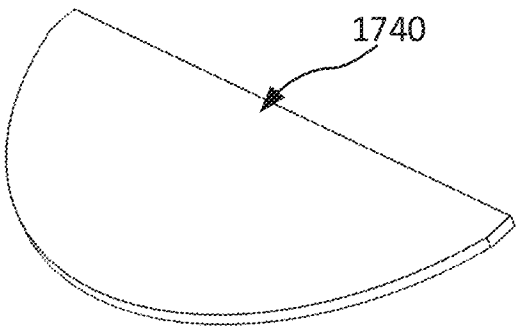
FIG. 24 is a perspective view of a portion of the linear drain assembly of FIG. 20, according to an exemplary embodiment.
Figure 23:
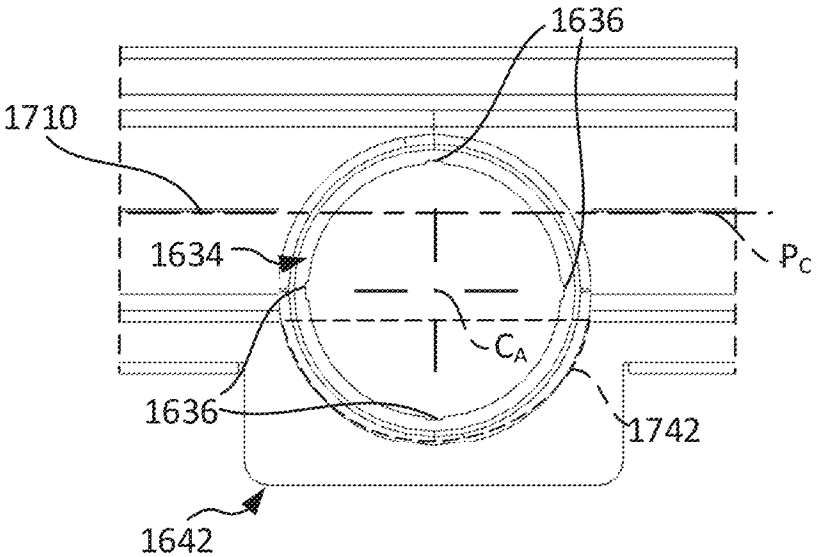
FIG. 23 is a detailed top view of the portion of the linear drain assembly of FIG. 21, according to an exemplary embodiment.

Turning to FIGS. 22-24, the base portion 1600 is shown according to an exemplary embodiment. The base portion 1200 defines a first base end 1700 and a second base end 1702 separated by a distance, shown as a base length $L_B$. In some embodiments, the base length $L_B$ is approximately (e.g., within ±5%) 30 inches. However, it should be appreciated that the base length $L_B$ may be most any length to accommodate the environment in which the linear drain assembly 1500 is installed. For example, for smaller shower enclosures, the base length $L_B$ may be between approximately 10-20 inches, inclusive. In some embodiments, such as for use as a poolside drain, the base length $L_B$ may be between approximately 40-100 inches, inclusive. In some embodiments, the base portion 1600 may be coupled to a similar base portion to effectively extend the base length $L_B$. The base portion 1600 may be formed by extrusion, milling, injection molding, stamping and bending, and similar manufacturing processes. In some embodiments, the base portion 1600 is formed of 18 gauge stainless steel, such as by stamping out a pattern for the base portion 1600, bending the stainless steel, and welding the steel together to form the base portion 1600. In some embodiments, the base portion 1600 is formed of aluminum and surface treated, such as by anodizing or spray coating, to improve corrosion resistance.

The base portion 1600 may further include the outlet body 1610 (e.g., annular body) coupled to the base portion. The outlet body 1610 may be positioned equidistant from both the first base end 1700 and the second base end 1702. In some embodiments, the outlet body 1610 is positioned such that the outlet body 1610 is nearer the first base end 1700 than the second base end 1702. The central plane $P_C$ may intersect the outlet body 1610. In some embodiments, the central axis $C_A$ of the outlet body 1610 is parallel to the central plane $P_C$ but offset from the central plane $P_C$.

When the linear drain assembly 1500 is positioned within a shower cell, a conduit may be coupled to the outlet body 1610 such that water that enters the base portion 1600 and is directed toward the outlet body 1610 may be received by a drain or sewer pipe.

Referring specifically to FIG. 22, a side view of the base portion 1600 is shown from the first base end 1700. The base portion 1600 may define a portion of the trough 1501, such as a central portion of the trough 1501 positioned between the first peripheral portion 1602 and the second peripheral portion 1604. The portion of the trough 1501 is defined by a first base surface 1712, a second base surface 1714, and a third base surface 1716. The first base surface 1712 may be generally planar and extend between the first base end 1700 and the second base end 1702. In some embodiments, the first base surface 1712 is slightly sloped (e.g., pitched) toward the outlet body 1610 such that a fluid that enters the trough 1501 is be biased toward the outlet body 1610. For example, the first base surface 1712 may slope downward between the first base end 1700 and the outlet body 1610, and the first base surface 1712 may slope upward from the outlet body 1610 to the second base end 1702. In some embodiments, the first base surface 1712 is pitched toward the central plane $P_C$ such that a flow of water that enters the trough 1501 is biased toward the central plane $P_C$. Specifically, the first base surface 1712 may slope downward between the second base surface 1714 and the central plane $P_C$. Similarly, the first base surface 1712 may slope downward between the third base surface 1716 and the central plane $P_C$. The first base surface 1712 may include a bend 1710 (e.g., corner) lying substantially within the central plane $P_C$ and extending from the first base end 1700 to the outlet body 1610 and from the outlet body 1610 to the second base end 1702. In some embodiments, the first base surface 1712 is not pitched toward the outlet body 1610 and includes the bend 1710. In some embodiments, the first base surface 1712 is pitched toward the outlet body 1610 and the first base surface 1712 does not include the bend 1710. In some embodiments, the first base surface 1712 is pitched toward the outlet body 1610 and includes the bend 1710.

The outlet body 1610 extends substantially orthogonally away from the first base surface 1712 in a first direction, denoted by a. The outlet body 1610 includes a first outlet portion 1630 and a second outlet portion 1632. The first outlet portion 1630 is coupled to the base portion 1600, contiguous with the first base surface 1712, and in fluid communication with the trough 1501. The first outlet portion 1630 may be integrally formed with the base portion 1600 such that the first outlet portion 1630 and the base portion 1600 are formed of a single piece, such as by stamping pressing, milling, and similar manufacturing processes. In some embodiments, the first outlet portion 1630 is manufactured separately from the base portion 1600 and later coupled to the base portion 1600, such as by welding, fasteners, adhesives, and the like. The first outlet portion 630 includes a first outlet flange 1634 (shown in FIG. 23) extending orthogonally away from the first outlet portion 1630 toward the central axis $C_A$. The first outlet flange 1634 includes a plurality of notches 1636 configured to engage a drain cover or hair catcher such that the drain cover or hair catcher does not rotate. The second outlet portion 1632 is coupled to the first outlet portion 1630 and extends away from the first outlet portion 1630 in the first direction $\alpha$. The second outlet portion 1632 is a substantially annular body including a first sealing groove 1638 and internal threads 1640 (shown in FIG. 27). The internal threads 1640 are configured to form a threaded engagement with a drain adaptor such that the base portion 1600 may be configured and adapted for use in various environments and with various drainage configurations. The first sealing groove 1638 is configured to receive a sealing member, such as an O-ring, configured to form a sealing engagement with a drain adaptor. In some configurations, the first sealing groove 1638 may not be required to ensure a substantially watertight interface between the linear drain assembly 1500 and drain plumbing.

The second base surface 1714 and the third base surface 1716 may extend substantially orthogonally away from the first base surface 1712 in a second direction denoted by $\beta$, the second direction $\beta$ being opposite (e.g., separated by 180-rotational degrees) the first direction $\alpha$. The second base surface 1714 and the third base surface 1716 may be substantially parallel to each other. In some embodiments, the second base surface 1714 and the third base surface 1716 are substantially parallel to the central plane $P_C$. However, in some embodiments, the second base surface 1714 and the third base surface 1716 may extend away from the first base surface 1712 at a slight angle relative to the central plane $P_C$ such that the second base surface 1714 and the third base surface 1716, if extended, would intersect the central plane $P_C$ in the first direction $\alpha$.

The second base surface 1714 is contiguous with the first base surface 1712 at a first chamfer 1713. In some embodiments, the second base surface 1714 and the first base surface 1712 meet at a sharp corner (e.g., a non-differentiable corner). In some embodiments, the first chamfer 1713 is the result of bending a planar material (e.g., sheet metal) to form the first base surface 1712 and the second base surface 1714. In some embodiments, the first base surface 1712 and the second base surface 1714 are cut (e.g., water-jet, laser cut, stamped etc.) from the same piece of planar material and coupled together, forming the first chamfer 1713. In some embodiments, the first chamfer 1713 is a weld.

The third base surface 1716 is contiguous with the first base surface 1712 at a second chamfer 1715. In some embodiments, the third base surface 1716 and the first base surface 1712 meet at a sharp corner. In some embodiments, the second chamfer 1715 is the result of bending a planar material to form the first base surface 1712 and the third base surface 1716. In some embodiments, the first base surface 1712 and the third base surface 1716 are cut from the same piece of planar material and coupled together, forming the second chamfer 1715. In some embodiments, the second chamfer 1715 is a weld.

The base portion 1600 may further include a first base flange 1718 extending from an end of the second base surface 1714 distal from the first base surface 1712 in a direction generally away from the central plane $P_C$ at. The first base flange 1718 defines a flange width $W_F$, defined as a distance between the second base surface 1714 and an end of the first base flange 1718 distal to the second base surface 1714. The base portion 1600 may further include a second base flange 1720 extending substantially orthogonally away from an end of the third base surface 1716 distal from the first base surface 1712 in a direction generally away from the central plane $P_C$. A width of the second base flange 1720 may be equal to the flange width $W_F$.

The first base flange 1718 includes a surface, shown as a fourth base surface 1722, and the second base flange 1720 includes a surface, shown as a fifth base surface 1724. The fourth base surface 1722 and the fifth base surface 1724 may be generally parallel to one another such that both the fourth base surface 1722 and the fifth base surface 1724 lie within the same plane. The fourth base surface 1722 and the fifth base surface 1724 may each be separated from the first base surface 1712 by a distance, shown as a base height $H_B$. The fourth base surface 1722 may extend substantially orthogonally away from the second base surface 1714 in a direction generally away from and generally perpendicular to (e.g., between 85° and 95° from) the central plane $P_C$. The fourth base surface 1722 may be contiguous with the second base surface 1714 and may meet (e.g., be coupled to) the second base surface 1714 at a third chamfer 1717. In some embodiments, the fourth base surface 1722 and the second base surface 1714 meet at a sharp corner. In some embodiments, the third chamfer 1717 is the result of bending a planar material to form the second base surface 1714 and the fourth base surface 1722. In some embodiments, the second base surface 1714 and the fourth base surface 1722 are cut from the same piece of planar material and coupled together, forming the third chamfer 1717. In some embodiments, the third chamfer 1717 is a weld.

The first base flange 1718 further includes a sixth base surface 1726 extending away from the fourth base surface 1722 and toward the central plane $P_C$ at a non-zero angle, shown as a third angle 1730. The sixth base surface 1726 extends away from the fourth base surface 1722 opposite the second base surface 1314. The sixth base surface 1726 may be contiguous with the fourth base surface 1722 and may meet (e.g., be coupled to) the fourth base surface 1722 at a fifth chamfer 1725. In some embodiments, the sixth base surface 1726 and the fourth base surface 1722 meet at a sharp corner. In some embodiments, the fifth chamfer 1725 is the result of bending a planar material to form the sixth base surface 1726. In some embodiments, the sixth base surface 1726 and the fourth base surface 1722 are cut from the same piece of planar material and coupled together, forming the fifth chamfer 1725. In some embodiments, the fifth chamfer 1725 is a weld.

The fifth base surface 1724 may extend substantially orthogonally away from the third base surface 1716 in a direction generally away from and generally perpendicular to (e.g., between 85° and 95° from) the central plane $P_C$. The fifth base surface 1724 may be contiguous with the third base surface 1716 and may meet (e.g., be coupled to) the third base surface 1716 at a fourth chamfer 1719. In some embodiments, the fifth base surface 1724 and the third base surface 1716 meet at a sharp corner. In some embodiments, the fourth chamfer 1719 is the result of bending a planar material to form the third base surface 1716 and the fifth base surface 1724. In some embodiments, the third base surface 1716 and the fifth base surface 1724 are cut from the same piece of planar material and coupled together, forming the fourth chamfer 1719. In some embodiments, the fourth chamfer 1719 is a weld.

The second base flange 1720 further includes a seventh base surface 1728 extending away from the fifth base surface 1724 and toward the central plane $P_C$ at a non-zero angle, shown as the third angle 1730. The seventh base surface 1728 extends away from the fifth base surface 1724 opposite the third base surface 1316. The seventh base surface 1728 may be contiguous with the fifth base surface 1724 and may meet (e.g., be coupled to) the fifth base surface 1724 at a sixth chamfer 1727. In some embodiments, the seventh base surface 1728 and the fifth base surface 1724 meet at a sharp corner. In some embodiments, the sixth chamfer 1727 is the result of bending a planar material to form the seventh base surface 1728. In some embodiments, the seventh base surface 1728 and the fifth base surface 1724 are cut from the same piece of planar material and coupled together, forming the sixth chamfer 1727. In some embodiments, the sixth chamfer 1727 is a weld.

The second base surface 1714 and the third base surface 1716 are separated by a distance, shown as a trough width $W_T$. In some embodiments the trough width $W_T$ may be less (e.g., shorter) proximate to the first chamfer 1713 and the second chamfer 1715 than proximate to the third chamfer 1717 and the fourth chamfer 1719. However, both instances are referred to as the trough width $W_T$. The base portion 1600 also defines a distance between the end of the first base flange 1718 distal the second base surface 1714 and the end of the second base flange 1720 distal the third base surface 1716, the distance shown as a base width $W_B$.

The outlet body 1610 interrupts the first base surface 1712, the first chamfer 1713, the second base surface 1714, the third chamfer 1717, the fourth base surface 1722, the fifth chamfer 1725, and the sixth base surface 1726. The outlet body 1610 extends from the second base flange 1720 to the second outlet portion 1632, the outlet body 1610 extending beyond the first base surface 1712. The outlet body 1610 further includes a second outlet flange 1642 contiguous with the fourth base surface 1722 and extending laterally away from the outlet body 1610 in a direction generally away from the central axis $C_A$. When the linear drain assembly 1500 is positioned within an installation environment, the second outlet flange 1642 may provide a surface for tile, adhesive, and grout to interface with. The outlet body 1610 may further include a cover 740 configured to be coupled to the second outlet flange 1642 to provide a surface for tile, adhesive, and grout to interface with. Specifically, the cover 1740 substantially defines a portion of a circle (e.g., segment, semicircle), shown in FIG. 23 by the dotted outline 1742. When the cover 1740 is coupled to the outlet body 1610, the cover 1740 is contiguous with the seventh base surface 1728 and the second outlet flange 1642. The cover 1740 may be coupled to the base portion 1600 using adhesives, fasteners, friction, welding, and the like. In some embodiments, the outlet body 1610 provides a lip for the cover 1740 to rest on. In some embodiments, the cover 1740 is integrally formed with the base portion 1600 such that the base portion 1600 and the cover 1740 are formed of a single body.

In some embodiments, the base portion 1600 may be formed by extrusion. For example, the first base surface 1712, the second base surface 1714, the third base surface 1716, the fourth base surface 1722, the fifth base surface 1724, the sixth base surface 1726, and the seventh base surface 1728 may be integrally formed in a single body by extrusion, bending, stamping, and similar manufacturing processes. The outlet body 1610 may be similarly formed. The outlet body 1610 may be manufactured separately from the base portion 1600 and be coupled to the base portion 1600, such as by welding. In some embodiments, the pitch of the first base surface 1712 may be achieved by cutting the base portion 1600 from a flat sheet of material and welding first base surface 1712 to both of the second base surface 1714 and the third base surface 1716.

Figure 25:
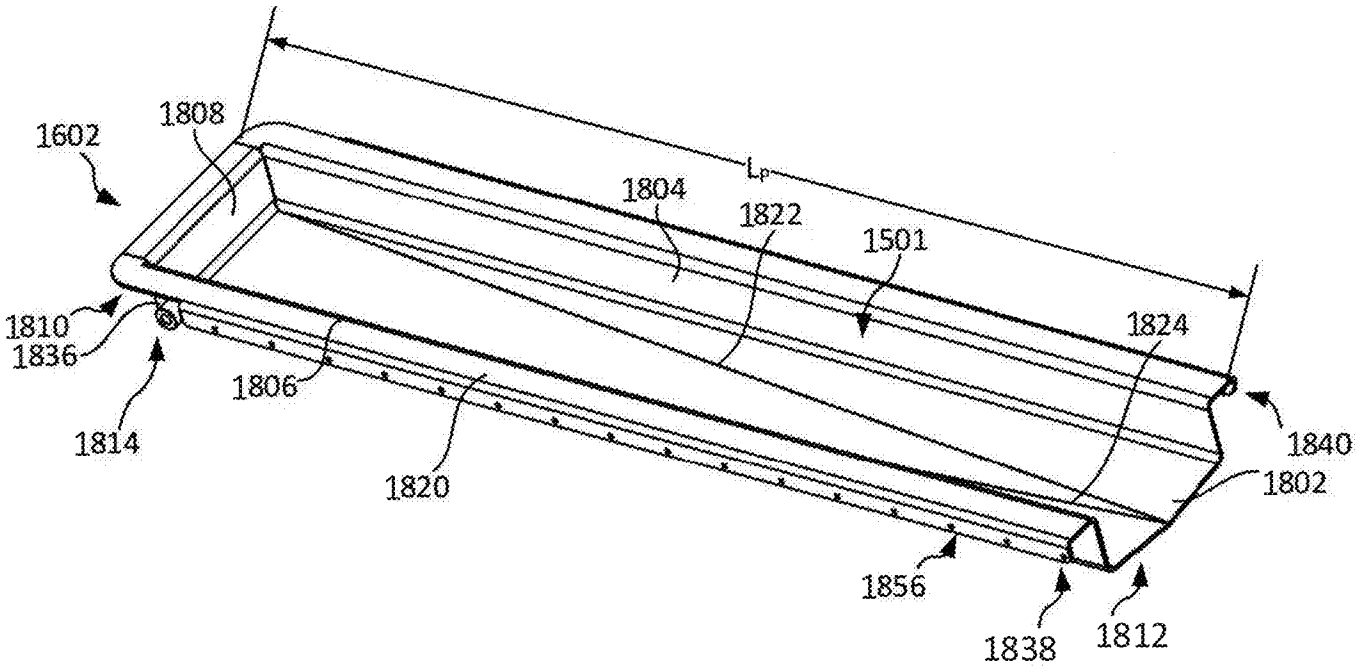
FIG. 25 is a perspective view of a portion of the linear drain assembly of FIG. 20, according to an exemplary embodiment.
Figure 26:
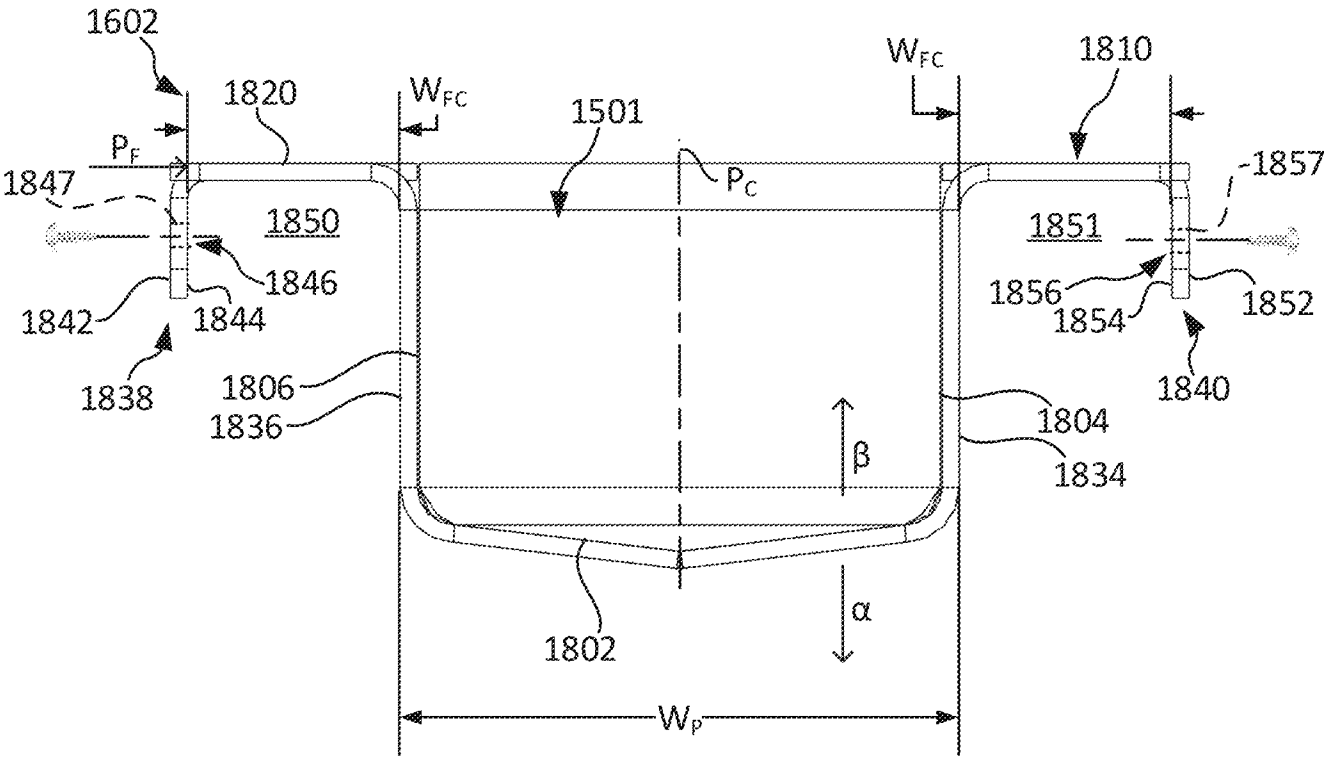
FIG. 26 is a side view of the portion of the linear drain assembly of FIG. 25, according to an exemplary embodiment.

Referring now to FIGS. 25-26, the first peripheral portion 1602 is shown. While only the first peripheral portion is shown, it should be understood that the second peripheral portion 1604 is similar to the first peripheral portion 1602. In some embodiments, the second peripheral portion 1604 is a mirror image of the first peripheral portion 1602. In some embodiments, the first peripheral portion 1602 and the second peripheral portion 1604 are identical such that a user may not be able to distinguish the first peripheral portion 1602 from the second peripheral portion 1604. In some embodiments, both the first peripheral portion 1602 and the second peripheral portion 1604 include a label or marker that distinguish them from each other (e.g., 'L' and 'R', 'A' and 'B', '1' and '2', etc.). For example, the first peripheral portion 1602 and the second peripheral portion 1604 may be "polarized," or designed to have a specific orientation relative to the base portion 1600. The first peripheral portion 1602 and the second peripheral portion 1604 may be formed by extrusion, milling, injection molding, stamping and bending, and similar manufacturing processes. In some embodiments, the first peripheral portion 1602 and the second peripheral portion 1604 are formed of 18 gauge stainless steel, such as by stamping out a pattern for the first peripheral portion 1602 and the second peripheral portion 1604, bending the stainless steel, and welding the steel together to form the first peripheral portion 1602 and the second peripheral portion 1604. In some embodiments, the first peripheral portion 1602 and the second peripheral portion 1604 are formed of aluminum and surface treated, such as by anodizing or spray coating, to improve corrosion resistance.

The first peripheral portion 1602 includes a catch pan 1802 (e.g., first surface, bottom surface, etc.), a first wall 1804, a second wall 1806, and a third wall 1808. Each of the catch pan 1802, the first wall 1804, the second wall 1806, and the third wall 1808 cooperate to define a portion of the trough 1501. The first peripheral portion 1602 also includes a generally planar and contiguous flange 1810 that extends from each of the first wall 1804, the second wall 1806, and the third wall 1808.

The catch pan 1802 extends between a first end 1812 and a second end 1814 of the first peripheral portion 1602. The first peripheral portion 1602 defines a length, shown as a portion length $L_P$, the portion length $L_P$ is defined as the distance between the first end 1812 and the flange 1810 proximate to the second end 1814. Both the first peripheral portion 1602 and the second peripheral portion 1604 may be defined by the peripheral length $L_P$.

The first wall 1804 and the second wall 1806 extend away from the catch pan 802 in generally the second direction β. In some embodiments, the first wall 1804 and the second wall 1806 are parallel to one another. However, in some embodiments, the first wall 1804 and the second wall 1806 may extend away from the catch pan 1802 in a direction other than perpendicularly. For example, the first wall 1804 may extend away from the catch pan 1802 such that the first wall 1804 is sloped toward the central plane $P_C$ (e.g., the first wall 1804, if extended, would intersect the central plane $P_C$ in the first direction α). Similarly, the second wall 1806 may be sloped toward the central plane $P_C$ (e.g., the second wall 1806, if extended, would intersect the central plane $P_C$ in the first direction α).

The third wall 1808 extends from the catch pan 1802 in the second direction β. In some embodiments, the third wall 1808 extends from the catch pan 1802 perpendicularly. In some embodiments, the third wall 1808 slopes toward the outlet body 1610 such that the third wall 1808, if extended, would intersect the central axis $C_A$ in the first direction α.

Each of the first wall 1804, the second wall 1806, and the third wall 1808 are contiguous with the catch pan 1802. In some embodiments, the first wall 1804 meets the catch pan 1802 at a sharp corner. In some embodiments, the transition between the catch pan 1802 and the first wall 1804 is a gradual curve and may be the result of bending a planar material to form the first wall 1804 and the catch pan 1802. In some embodiments, the second wall 1806 meets the catch pan 1802 at a sharp corner. The transition between the catch pan 1802 and the second wall 1806 may be a gradual curve and may be the result of bending a planar material to form the second wall 1806 and the catch pan 1802. In some embodiments, the third wall 1808 meets the catch pan 1802 at a sharp corner. The transition between the catch pan 1802 and the third wall 1808 may be a gradual curve and may be the result of bending a planar material to form the third wall 1808 and the catch pan 1802.

The third wall 1808 is contiguous with both the first wall 1804 and the second wall 1806. In some embodiments, the first peripheral portion 1602 is cut from a flat sheet of a planar material, such as steel or aluminum (or similar alloys) and welded. While the transition between the first wall 1804 and the catch pan 1802 may be the result of bending a flat sheet of planar material, the transition between the first wall 1804 and the third wall 1808 may be formed by coupling the first wall 1804 to the third wall 1808, such as by welding. Similarly, the second wall 1806 and the third wall 1808 may be welded together and form a curved transition. In some embodiments, the first peripheral portion 1602 is formed by hydroforming, vacuum molding, cold forging, or similar manufacturing processes.

Referring specifically to FIG. 26, the flange 1810 may define a flange surface 1820, and both the flange 1810 and the flange surface 1820 may lie within a plane substantially orthogonal to the central plane $P_C$, shown as a flange plane $P_F$. The flange 1810 extends from all of the first wall 1804, the second wall 1806, and the third wall 1808. The flange surface 1820 is contiguous with all of the first wall 1804, the second wall 1806, and the third wall 1808. The flange 1810 extends between the first end 1812 and the second end 1814 along both the first wall 1804 and the second wall 1806. The flange 1810 also extends away from the second end 1814.

The flange plane $P_F$ may be parallel to the catch pan 1802. In some embodiments, the catch pan 1802 is pitched toward the first end 1812. The catch pan 1802 may include a plurality of creases, shown as a first crease 1822 and a second crease 1824. The first crease 1822 extends from the middle of the first end 1812 to the intersection of the first wall 1804 and the third wall 1808. And the second crease 1824 extends from the middle of the first end 1812 to the intersection of the second wall 1806 and the third wall 1808. The first crease 1822, the second crease 1824, and the intersection of the third wall 1808 and the catch pan 1802 cooperate to form a substantially triangular body configured to direct water toward the first end 1812. In some embodiments, a distance between the catch pan 1802 and the flange plane $P_F$ may be less proximate to the second end 1814 than a distance between the catch pan 1802 and the flange plane $P_F$ proximate to the first end 1812. When the linear drain assembly 1500 is installed, the slope of the catch pan 1802 of the first peripheral portion 1602 may facilitate drainage of water such that water is directed from the second end 1814 to the first end 1812, and thus from the first peripheral portion 1602 to the base portion 1600.

The flange 1810 is contiguous with all of the first wall 1804, the second wall 1806, and the third wall 1s808. In some embodiments, flange 1810 is not parallel to the flange plane $P_F$, but is instead sloped inward and toward the catch pan 1802. Such a slope of the flange 1810 may facilitate drainage of water into first peripheral portion 1602.

The first peripheral portion 1602 further comprises a first outer wall 1834 and a second outer wall 1836. The first outer wall 1834 may face in a direction generally away from the central plane $P_C$. Similarly, the second outer wall 1836 may face in a direction generally away from the central plane $P_C$. The first peripheral portion 1602 is configured to be received within the base portion 1600. To allow for such a configuration, the first outer wall 1834 and the second outer wall 1836 are separated by a distance, shown as a peripheral width $W_P$. While a distance between the first outer wall 1834 and the second outer wall 1836 may be different at different points (e.g., a greater distance proximate to the flange 1810 when compared to a lesser distance proximate to the catch pan 1802), the peripheral width $W_P$ designates the distance between the first outer wall 1834 and the second outer wall 1836. To allow for the first peripheral portion 1602 to be received within the base portion 1600, the peripheral width $W_P$ is less than the trough width $W_T$.

The flange 1810 includes a first ledge 1838 and a second ledge 1840. The first ledge 1838 extends substantially orthogonally away from the flange 1810 in the first direction α at an end of the flange 1810 opposite the second wall 1806. In some embodiments, the first ledge 1838 is generally parallel (±5%) to the first wall 1804. The first ledge 1838 includes an outer ledge surface 1842 and an inner ledge surface 1844. The outer ledge surface 1842 is contiguous with the flange surface 1820. In some embodiments, the outer ledge surface 1842 meets the flange surface 1820 at a curved interface, such as may be achieved by bending a planar material at approximately 90 degrees. The inner ledge surface 1844 and the first outer wall 1834 are separated by a distance, shown as a flange cavity width WK. The first outer wall 1834, the flange 1810, and the inner ledge surface 1844 cooperate to form a first flange cavity 1850 defined in part by the flange cavity width $W_{FC}$ such that the first flange cavity 1850 may receive the first base flange 1718 and second base flange 1720. Specifically, the flange cavity width $W_{FC}$ is greater than the flange width $W_F$ of both the first base flange 1718 and the second base flange 1720.

The first ledge 1838 further includes a first aperture 1846 defined by a generally annular surface, shown as an aperture surface 1847. The aperture surface 1847 extends through the first ledge 1838 and is contiguous with both the outer ledge surface 1842 and the inner ledge surface 1844. In some embodiments, the aperture surface 1847 may be tapped (e.g., threaded) to receive a screw. In some embodiments, the aperture surface 1847 is configured to receive a self-tapping screw or a sheet metal screw. The first aperture 1846 is configured to receive a fastener, such as a sheet metal screw, that is configured to selectively couple one of the first base flange 1718 or the second base flange 1720 to the first peripheral portion 1602.

The second ledge 1840 extends substantially orthogonally away from the flange 1810 in the first direction a at an end of the flange 1810 opposite the first wall 1804. In some embodiments, the second ledge 1840 is generally parallel (±5%) to the first wall 1804. The second ledge 1840 includes an outer ledge surface 1852 and an inner ledge surface 1854. The outer ledge surface 1852 is contiguous with the flange surface 1820. In some embodiments, the outer ledge surface 1852 meets the flange surface 1820 at a curved interface, such as may be achieved by bending a planar material at approximately 90 degrees. The inner ledge surface 1854 and the first outer wall 1834 are separated by a distance, shown as a flange cavity width $W_{FC}$. The first outer wall 1834, the flange 1810, and the inner ledge surface 1854 cooperate to form a second flange cavity 1851 defined in part by the flange cavity width $W_{FC}$ such that the second flange cavity 1851 may receive the first base flange 1718 and second base flange 1720. Specifically, the flange cavity width $W_{FC}$ is greater than the flange width $W_F$ of both the first base flange 1718 and the second base flange 1720.

The second ledge 1840 further includes a second aperture 1856 defined by a generally annular surface, shown as an aperture surface 1857. The aperture surface 1857 extends through the second ledge 1840 and is contiguous with both the outer ledge surface 1852 and the inner ledge surface 1854. In some embodiments, the aperture surface 1857 may be tapped (e.g., threaded) to receive a screw. In some embodiments, the aperture surface 1857 is configured to receive a self-tapping screw or a sheet metal screw. The second aperture 1856 is configured to receive a fastener, such as a sheet metal screw, that is configured to selectively couple one of the first base flange 1718 or the second base flange 1720 to the first peripheral portion 1602.

Referring again to FIG. 25, the first ledge 1838 may include a plurality of apertures configured to receive a plurality of fasteners, the plurality of apertures profiled along a length of the first ledge 1838. In some embodiments, the first ledge 1838 does not extend the full length of the first peripheral portion 1602. For example, the first ledge 1838 may extend to the first end 1812, but the first ledge 1838 may not extend to the second end 1814. Thus, the first ledge 838 may not be contiguous with the second ledge 1840. However, in some embodiments, the first ledge 1838 and the second ledge 1840 are contiguous, for example in embodiments where a third ledge extends from the flange 1810 proximate to the second end 1814, the third ledge may be contiguous with both the first ledge 1838 and the second ledge 1840.

Figure 27:
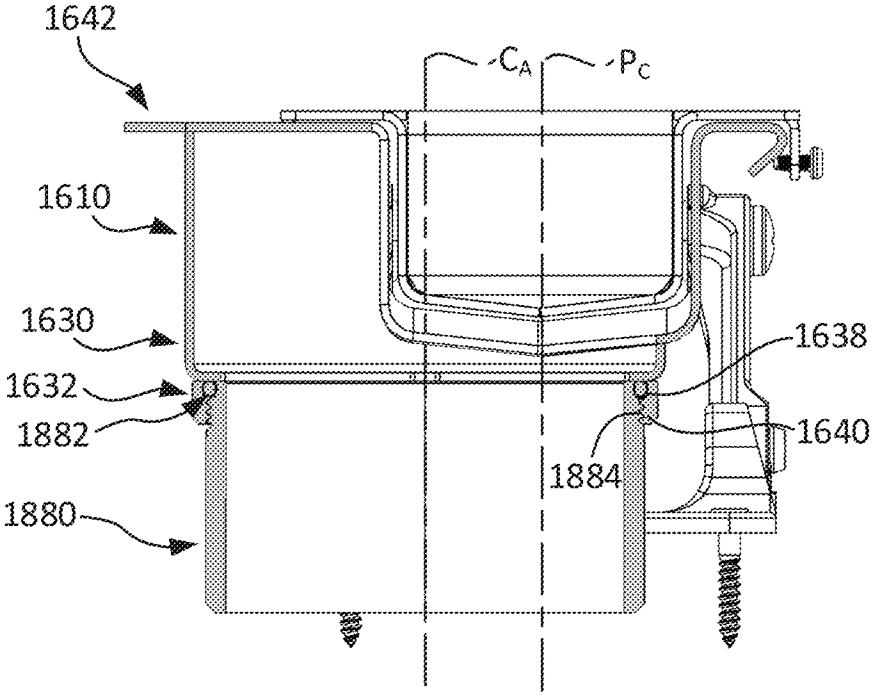
FIG. 27 is a cross-sectional side view of the linear drain assembly of FIG. 20, according to an exemplary embodiment.

Turning to FIG. 27, a cross-section of the outlet body 1610 is shown according to an example embodiment. The outlet body 1610 may further include a coupling member 1880 and a sealing member 1882. The coupling member 1880 defines a generally annular body having external threads 1884 positioned proximate to an end of the coupling member 1880. The external threads 1884 are configured to form a threaded engagement with the internal threads 1640 of the second outlet portion 1632. The second outlet portion 1632, the coupling member 1880, and the first outlet flange 1634 cooperate to form the first sealing groove 1638, the first sealing groove 1638 configured to receive the sealing member 1882. When the coupling member 1880 is coupled to the second outlet portion 1632, the sealing member 1882 is compressed and forms a substantially watertight seal between the coupling member 1880 and the outlet body 1610. The coupling member 1880 is configured to be coupled to drain plumbing, such as a rubber coupling, PVC plumbing, and the like.

Figure 28:
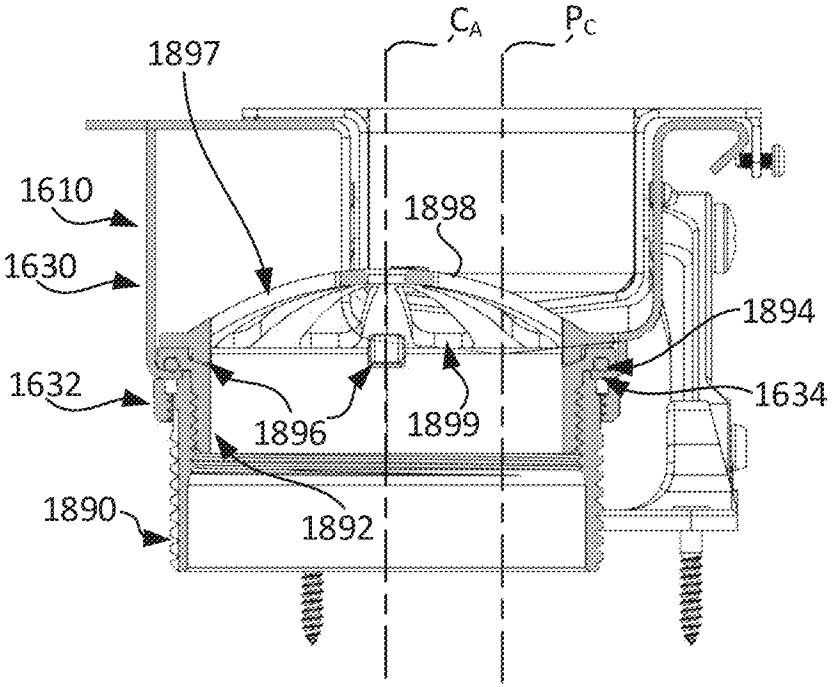
FIG. 28 is a cross-sectional side view of the linear drain assembly of FIG. 20, according to an exemplary embodiment.

Referring to FIG. 28, a cross-section of the outlet body 1610 is shown according to another example embodiment. The outlet body 1610 may further include a second coupling member 1890, a drain body 1892, and a second sealing member 1894. The second coupling member 1890 defines a generally annular body having external threads configured to be threadingly coupled to drain plumbing. The second coupling member 1890 includes internal threads configured to be coupled to the drain body 1892. The drain body 1892 cooperates with the second coupling member 1890 to compress the second sealing member 1894 between the drain body 1892 and the first outlet flange 1634 to form a substantially watertight seal. The drain body 1892 further includes a plurality of notches 1896 configured to receive a drain cover 1897 or hair trap such that the drain cover 1897 is prevented from rotation. The drain cover 1897 may also be used with the linear drain assembly 1100, and specifically may engage the notches 1496. When the drain cover 1897 is coupled to the outlet body 1610, a convex surface 1898 profiled with straining apertures 1899 protrudes above the first base surface 1712. The convex surface 1898 is shaped to prevent debris and foreign bodies (e.g., hair) from preventing a flow of water from entering the outlet body 1610. While FIGS. 27 and 28 show the straining apertures 1899 as elongate and triangular, various embodiments of the drain cover 1897 may include straining apertures 1899 defining various shapes, including circles, capsules, and regular and irregular polygons having sharp and rounded edges.

In some embodiments, the first peripheral portion 1602 includes a roughened surface that is configured to receive an adhesive or seal. For example, the first peripheral portion 1602 may include a roughened surface that extends across all of the first outer wall 1834, the second outer wall 1836, the flange 1810, and the outer catch surface 1737. The roughened surface may increase the surface area available for an adhesive or liquid gasket to adhere to. When an installer is ready to position the first peripheral portion 1602 within the base portion 1600, the installer may apply an adhesive (e.g., bead of caulking, silicon sealant, gasket, etc.) to the roughened surface and then place the first peripheral portion 1602 within the base portion 1600. The first peripheral portion 1602 may be inserted from above (e.g., from the second direction (3 and in the first direction $\alpha$) such that the adhesive is interposed between the roughened surface and the base portion 1600. The adhesive applied to roughened surface of the first peripheral portion 1602 may be squeezed and spread along the base portion 1600 as the first peripheral portion 1602 is slid.

Figure 30:
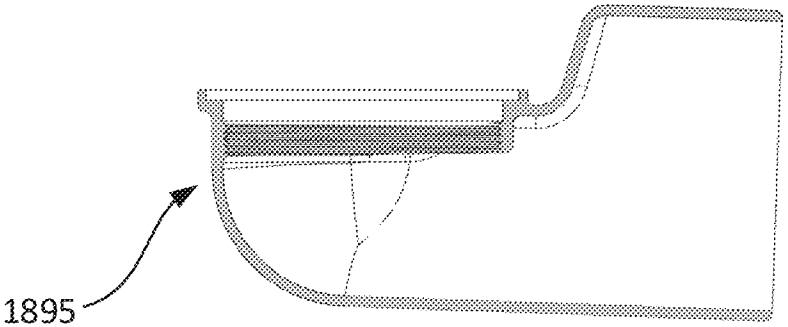
FIG. 30 is a perspective view of the outlet adaptor of FIG. 29, according to an exemplary embodiment.
Figure 29:
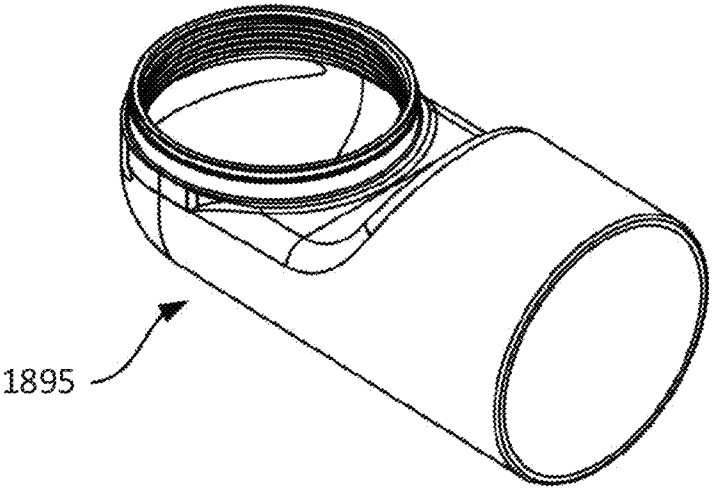
FIG. 29 is a perspective view of an outlet adaptor configured for coupling with either of the linear drain assembly of FIG. 12 or the linear drain assembly of FIG. 20, according to an exemplary embodiment.

Referring now to FIGS. 29-30, an outlet adaptor 1895 is shown. The outlet adaptor 1895 is configured to be coupled with either of the coupling member 1880 or the second coupling member 1890. The outlet adaptor 1895 facilitates the discharge of waste from the linear drain assembly 1500 in a direction generally away from the central axis $C_A$, such as in a horizontal installation environment. The outlet adaptor 1895 may be coupled to the outlet body 1610 using a rubber coupling, welding, threads, PVC glue, or the like. The outlet adaptor 1895 may be coupled to either of the outlet body 1610 or the outlet body 1210.

Figure 31:
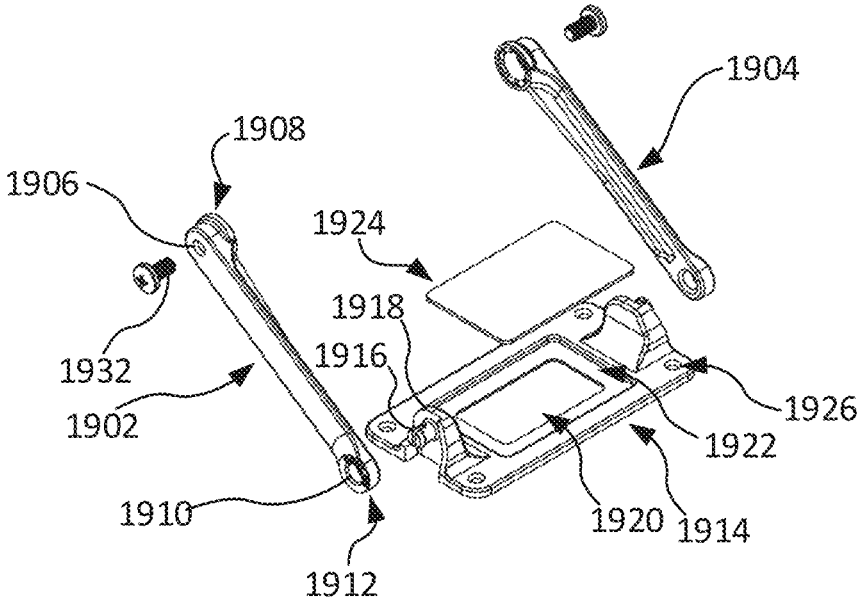
FIG. 31 is an exploded perspective view of a portion of the linear drain assembly of FIG. 12 and FIG. 20, according to an exemplary embodiment.

Referring to FIG. 31, a leg assembly 1900 is shown according to an example embodiment. As shown in FIGS. 12, 18, and 29, the linear drain assembly 1100 includes the leg assembly coupled to each of the first peripheral portion 1202 and the second peripheral portion 1204. As shown in FIGS. 20, 27, and 28, the linear drain assembly 1500 includes the leg assembly 1900 coupled to each of the first peripheral portion 1602 and the second peripheral portion 1604. The leg assembly 1900 is configured to adjust a height of the first peripheral portion 1202, the second peripheral portion 1204, the first peripheral portion 1602, and the second peripheral portion 1604 relative to the floor of the shower environment (e.g., subfloor, hot-mop, rubber sheet, etc.). For brevity, the leg assembly 1900 will be described relative to the first peripheral portion 1202 of the linear drain assembly 1100 only. However, it should be understood that the leg assembly 1900 is similarly utilized in relation to each of the second peripheral portion 204, the first peripheral portion 1602, the second peripheral portion 1604, and the linear drain assembly 1500. During installation of the linear drain assembly 1100, the installer may pitch the first peripheral portion 1202 and the second peripheral portion 1204 toward the outlet body 1210 and the drain plumbing. The leg assembly 1900 may maintain the height of the first peripheral portion 1202 until mortar is disposed between the linear drain assembly 1100 and the floor of the shower environment.

The leg assembly 1900 includes a first leg 1902 and a second leg 1904 rotatably coupled to the first peripheral portion 1202. To set a height of the first peripheral portion 1202, the first leg 1902 and the second leg 1904 may be selectively coupled to the first peripheral portion 202 so as to prevent rotation of the first leg 1902 and the second leg 1904 relative to the first peripheral portion 1202 and such that the first leg 1902 and the second leg 1904 are locked at an angle with respect to the catch pan 1402. The first leg 1902 includes a first aperture 1906 positioned at a first end 1908 of the first leg 1902, the first end 1908 of the first leg 1902 rotatably coupled to the first peripheral portion 1202. The first leg 1902 further includes a second aperture 1910 positioned at a second end 1912 of the first leg 1902, the second end 1912 of the first leg 1902 rotatably coupled to a mount member 1914. The mount member 1914 includes a first projection 1916 extending orthogonally away from the mount member 1914 in a direction generally away from the central plane $P_C$. The first projection 1916 is configured to extend into the second aperture 1910 of the first leg 1902, the second aperture 1910 acting as a bushing such that rotational movement of the first leg 1902 is allowed relative to the mount member 1914. Proximate to the first projection 1916 may be a first stop 1918 configured to interface with the first leg 1902 to limit rotation of the first leg 1902 about the first projection 1916. For example, the first stop 1918 may be positioned such that when the first leg 1902 interfaces with the first stop 1918, the first leg 1902 is at an orientation substantially perpendicular to the mount member 1914.

Positioned at a center of the mount member 1914 may be an opening 1920 bordered by a mount flange 1922. The mount flange 1922 is configured to receive (e.g., be coupled to) an adhesive body, shown as a sticker 1924. The side of the sticker 1924 not shown may include an adhesive configure to be coupled to the mount flange 1922, the dimensions of the mount flange 1922 complementing the dimensions of the sticker 1924. During installation, the mount member 1914 is slid along the floor of the shower environment. When the installer has the first peripheral portion 1202 at the desired height, the installer may couple the sticker 1924 to the mount flange 1922. By pressing the sticker 1924 through the opening 1920, the installer may adhere the sticker 1924 to the floor and thus secure the position of the mount member 1914. Securing the position of the mount member 1914 also secures the height of the leg assembly 1900, and thus secures the height of the linear drain assembly 1100 relative to the floor. The sticker 1924 may be used when screwing though the floor of the shower environment is undesirable, such as if a hot mop is used for fluidly sealing the shower environment. The mount member 1914 further includes an aperture 1926 configured to receive a fastener for coupling the mount member 1914 to the floor of the shower environment.

Figure 32:
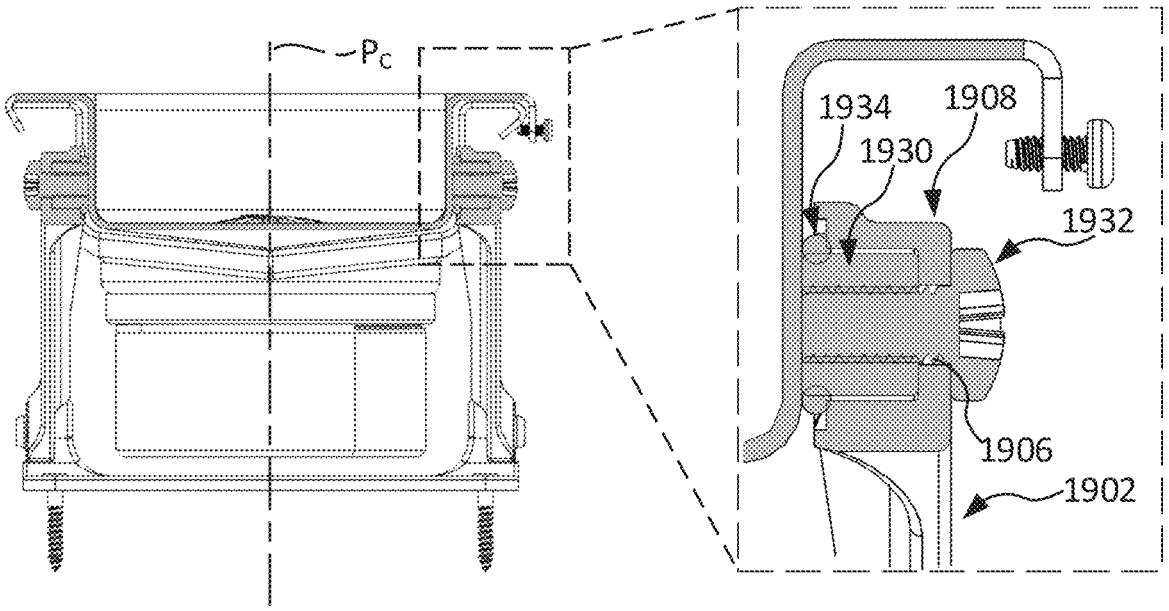
FIG. 32 is a detailed, cross-sectional side view of a portion of the linear drain assembly of FIG. 12, according to an exemplary embodiment.

Turning now to FIG. 32, a cross-sectional view of the leg assembly 1900 coupled to the linear drain assembly 1100 is shown. The first peripheral portion 1202 further includes a fixture 1930 coupled to the first outer wall 1434 proximate to the second end 1414. The fixture 1930 is also shown in FIGS. 26 and 25. The fixture 1930 extends orthogonally away from the first outer wall 1434 in a direction generally away from the central plane $P_C$. The fixture 1930 is configured to receive a fastener, such as a fastener 1932, for coupling the first leg 1902 to the first peripheral portion 1202. Positioned between the first end 1908 and the first outer wall 1434 may be a compressible body, shown as an O-ring 1934. The O-ring 1934 is configured to be compressed between the first end 1908 and the first outer wall 434 when the fastener 1932 is tightened. In other words, the O-ring 1934 helps to retain the first leg 1902 in the desired position while the linear drain assembly 1100 is being installed and mortar is positioned below the linear drain assembly 1100. After assembly, the leg assembly 1900 may be completely enclosed in mortar.

The linear drain assembly 1500 may include a leg assembly. The leg assembly of the linear drain assembly 1500 may be similar to the leg assembly 1900. A difference between the leg assembly of the linear drain assembly 1500 and the leg assembly 1900 is that the leg assembly of the linear drain assembly 1500 has a shorted distance between the first leg and the second leg to accommodate the narrower trough 1501 (e.g., narrower first peripheral portion 1602).

Figure 33:
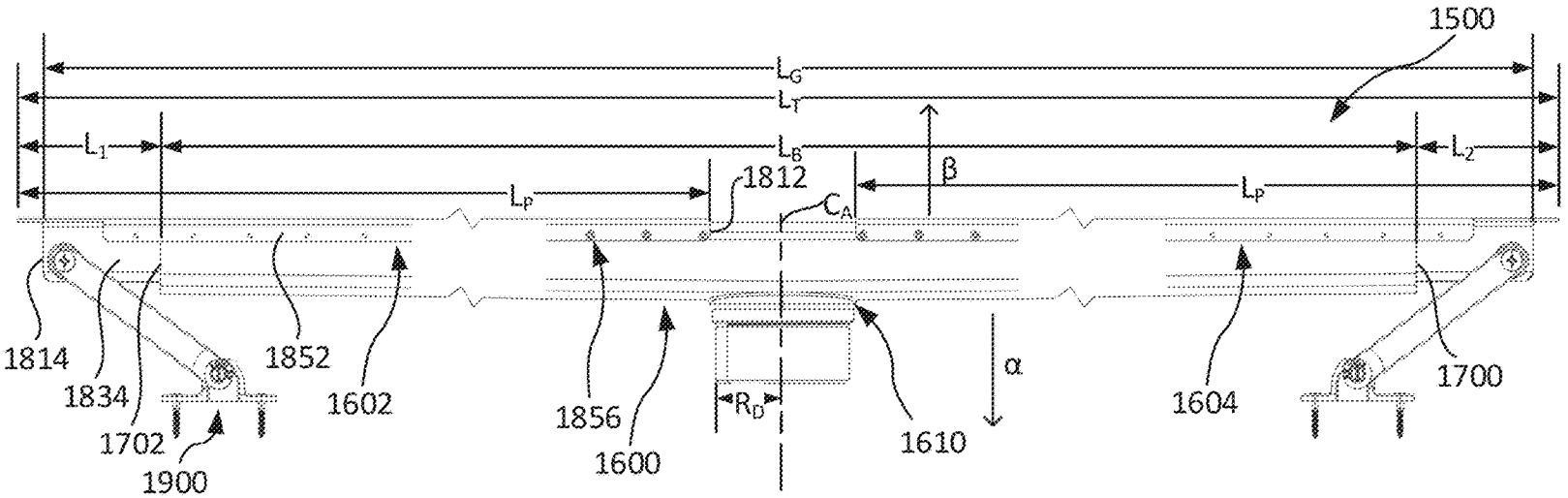
FIG. 33 is a front view of the linear drain assembly of FIG. 20, according to an exemplary embodiment.

Turning now to FIG. 33, a side view of the linear drain assembly 1500 is shown with the base portion 1600 coupled to both of the first peripheral portion 1602 and the second peripheral portion 1604.

The base portion 1600 and the first peripheral portion 1602 are configured to be slidably coupled to one another such that adjustments may be made to the length of the linear drain assembly 1500 by sliding the first peripheral portion 1602 generally toward and away from the outlet body 1610. Specifically, the catch pan 1802 is inserted into the portion of the trough 1501 defined by the base portion 1600 such that the first base flange 1718 is received within the first flange cavity 1850 and the second base flange 1720 is received within the second flange cavity 1851. Similarly, the second peripheral portion 1604 is configured to be coupled to the base portion 1600 such that the first base flange 1718 is received within a second flange cavity defined by the second peripheral portion 1604 and the second base flange 1720 is received within a first flange cavity defined by the second peripheral portion 1604. During an installation of the linear drain assembly 1500, the installer may position the base portion 1600 such that the outlet body 1610 is disposed within or near to a hole in the floor or near drainage plumbing. Once the base portion 1600 is in position, the installer may place a portion of the first peripheral portion 1602 into the base portion 1600 such that the first peripheral portion 1602 interfaces with the base portion 1600. Further, the first end 1812 may be positioned between the outlet body 1610 and the second base end 1702. In some embodiments, the first peripheral portion 1602 is configured to be positioned such that the first end 1812 is positioned between the first base end 1700 and the second base end 1702. Generally speaking, the structure of the first peripheral portion 1602 allows the first end 1812 and the second end 1814 to be positioned anywhere along the length of the base portion 1600. However, when the linear drain assembly 1500 is installed, it may be desirable for the first end 1812 to be positioned between the outlet body 1610 and the first base end 1700, and for the second end 1814 to be positioned at a greater distance from the outlet body 1610 than the first end 1812.

To adjust a distance between the outlet body 1610 and the second end 1814, the first peripheral portion 1602 may be positioned (e.g., slid, translated, telescoped, etc.) within the base portion 1600 such that a central axis of the second aperture 1856 intersects the base portion 1600. Once the first peripheral portion 1602 is in the desired position relative to the base portion 1600, a liquid gasket may be interposed between the first peripheral portion 1602 and the base portion 1600. To couple the first peripheral portion 1602 to the base portion 1600 while the liquid gasket cures, a fastener may be threaded into the second aperture 1856 and interface with the base portion 1600, biasing the first base flange 1718 into the flange 1810 and compressing (e.g., squeezing) the liquid gasket between the first peripheral portion 1602 and the base portion 1600 to form a watertight seal. Specifically, the fastener may be threaded into the second aperture 1856 and interface with the sixth base surface 1726. The third angle 1730 of the sixth base surface 1726 causes the sixth base surface 1726 to behave as a ramp, allowing the fastener to interface with the sixth base surface 1726 and bias the first base flange 1718 into the flange 1810. The first peripheral portion 1602 may be coupled to the base portion 1600 to prevent movement of the first peripheral portion 1602 while the liquid gasket is curing.

Because the first peripheral portion 1602 is slidable relative to the base portion 1600, the total length of the linear drain assembly 1500 may be adjusted without cutting (e.g., separating, splitting, etc.) either of the first peripheral portion 1602 or the base portion 1600. For example, to reduce the total length of the linear drain assembly, the first end 1812 may be positioned proximate to the outlet body 1610 and the second end 1814 may be positioned proximate to the second base end 1702. In this configuration, multiple fasteners may be threaded through the first ledge 1838 to secure the first peripheral portion 1602 to the base portion 1600. To increase the total length of the linear drain assembly 1500, the first end 1812 may be positioned proximate to the second base end 1702 and a fastener may be threaded through the first aperture 1846.

The linear drain assembly 1500 defines a total installation length, shown as a total length $L_T$. The total length $L_T$ is defined as the distance between the flange 1810 proximate to the second end 1814 and the flange of the second peripheral portion 1604 proximate to the second end of the second peripheral portion 1604. The total length $L_T$ is adjustable between a minimum length and a maximum length.

To achieve the minimum total length of the linear drain assembly 1500, the first peripheral portion 1602 may be positioned proximate to the outlet body 1610 such that the first end 1812 is the drain radius $R_D$ (e.g., a distance equal to the drain radius $R_D$) from the central axis $C_A$ and no portion of the first peripheral portion 1602 is intersected by the central axis $C_A$. Similarly, to achieve the minimum length, the second peripheral portion 1604 may be positioned such that the first end of the second peripheral portion 1604 is the drain radius $R_D$ from the central axis $C_A$ and no portion of the second peripheral portion 1604 is intersected by the central axis $C_A$. In other words, the minimum distance is achieved when the first end 1812 and the first end of the second peripheral portion 1604 are separated by twice the drain radius $R_D$. From herein, the "minimum distance" will refer to the aforementioned configuration. In some embodiments, the first end 1812 may interface with the outlet body 1610.

To achieve the maximum total length of the linear drain assembly 1500, the first peripheral portion 1602 may be positioned such that the first end 1812 is proximate to the second base end 1702 such that a central axis of the second aperture 1856 intersects the base portion 1600. Similarly, to achieve the maximum total length, the second peripheral portion 1604 may be positioned such that the first end is proximate to the first base end 1700 such that the central axis of a second screw aperture of a ledge of the second peripheral portion 1604 intersects the base portion 1600.

The total length $L_T$ may be adjusted without the use of adhesives and without permanent modification (e.g., cutting, welding, drilling holes, bending, etc.) to any of the base portion 1600, the first peripheral portion 1602, and the second peripheral portion 1604. The total length $L_T$ may also be adjusted without the use of a ruler. For example, an installer may position the outlet body 1610 above the drainage plumbing and place the catch pan 1802 into the trough of the base portion 1600. If it is desired that the linear drain assembly 1500 extend the full length of a wall of a shower cell, the second end 1814 may be pulled toward a wall of the shower cell until the flange 1810 interfaces with the wall or is the desired distance from the wall. The installer may then couple the first peripheral portion 1602 to the base portion 1600 with fasteners extending through the first ledge 1838 such that the first peripheral portion 1602 is no longer allowed to slide without significant force or without loosening the fasteners. Similarly, the second end of the second peripheral portion 1604 may be pulled toward an opposite wall of the shower cell until the flange of the second peripheral portion 1604 interfaces with the opposite wall or is the desired distance from the opposite wall. The installer may then couple the second peripheral portion 1604 to the base portion 1600 by threading a fastener into the first screw aperture (e.g., threading a plurality of fasteners into a first ledge of the second peripheral portion 1604).

The adjustability of the first peripheral portion 1602 relative to the base portion 1600 also allows for installation in environments where an asymmetrical installation configuration is desired. Thus, the base portion 1600 may be positioned such that the outlet body 1610 is over the drain plumbing. Then the catch pan 1802 may be placed within the base portion 1600. The installer may then pull the second end 1814 a desired distance from the second base end 1702, the distance shown as a first peripheral distance $L_1$. The installer may then place a catch pan of the second peripheral portion 1604 into the portion of the trough 1501 defined by the base portion 1600 and pull the second end of the second peripheral portion 1604 a desired distance away from the first base end 1700, the distance shown as a second peripheral distance $L_2$. The first peripheral distance $L_1$ and the second peripheral distance $L_2$ may be different. For example, the second end 1814 may be nearer to the outlet body 1610 than the second end of the second peripheral portion 1604. The total length $L_T$ is defined as the sum of the base length $L_B$, the first peripheral distance $L_1$, and the second peripheral distance $L_2$.

When the linear drain assembly 1500 is installed, the base portion 1600, the first peripheral portion 1602, and the second peripheral portion 1604 cooperate to form the trough 1501 having a trough length $L_G$. Specifically, the trough length Leis defined as a distance between the third wall 1808 and a third wall of the second peripheral portion 1604. The trough width is defined at various points along the trough length $L_G$ by the distance between the first wall 804 and the second wall 1806, and the second base surface 1714 and the third base surface 1716. The trough length $L_G$ shares a linear relationship with the total length $L_T$, in which both the total length $L_T$ and the trough length $L_G$ are adjusted simultaneously and equally. Thus, the trough length $L_G$ similarly may include a minimum trough length and a maximum trough length.

Figure 34:
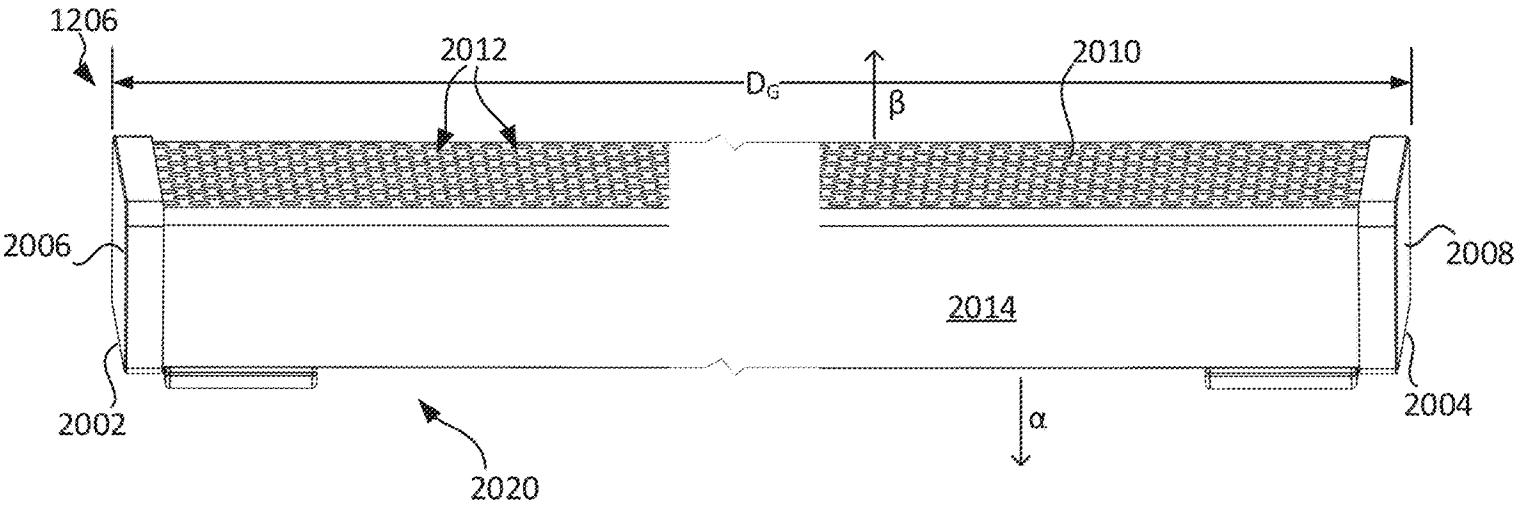
FIG. 34 is a front perspective view of a portion of the linear drain assembly of FIG. 12, according to an exemplary embodiment.

Referring now to FIG. 34, a drain grate 1206 is shown according to an example embodiment. The drain grate 1206 is similar to the drain grate 606. A difference between the drain grate 1206 and the drain grate 606 is that the drain grate 606 is narrower than the drain grate 1206. The drain grate 1206 is configured to be received within the trough 1101. The drain grate 1206 may be formed of an extruded metal, such as steel, aluminum, or aluminum alloys. The drain grate 1206 includes a first grate end 2002 and a second grate end 2004 opposite the first grate end 2002. The first grate end 2002 and the second grate end 2004 are separated by a distance, shown as a grate length $D_G$. The grate length $D_G$ may be slightly less than the trough length $L_G$ such that the drain grate 1206 may be received within the trough 1101 without requiring excessive force or tools. The grate length $D_G$ may be adjusted by cutting the drain grate 1206 to the desired length (e.g., the trough length $L_G$, slightly less than the trough length $L_G$). For example, the drain grate 1206 may be received by the installer as having the grate length $D_G$ equal to the maximum length of the trough length $L_G$. However, during installation, the trough length $L_G$ may be determined to be between the maximum trough length and the minimum trough length. To allow the drain grate 1206 to fit within the trough, the installer may cut the drain grate 1206. As cuts may be rough or unsightly (e.g., cuts made by hand tools), the drain grate 1206 may include a first endcap 2006 and a second endcap 2008. The first endcap 2006 may be configured to be coupled to the first grate end 2002 and the second endcap 2008 may be configured to be coupled to the second grate end 2004.

The drain grate 1206 further includes a generally planar surface, shown as a first grate surface 2010. The first grate surface 2010 extends between the first grate end 2002 and the second grate end 2004. When the drain grate 1206 is installed within the trough, the first grate surface 2010 may face (e.g., be directed) generally in the second direction β. The first grate surface 2010 may include a surface finish or unique machining to provide a desired aesthetic. For example, the first grate surface 2010 may include a plurality of apertures 2012 profiled evenly about the entirety of the first grate surface 2010. In some embodiments, the first grate surface 2010 and the plurality of apertures 2012 cooperate to provide an additional layer of filtering to a fluid or flow of water prior to the fluid entering the trough 1101 and the outlet body 1610. For example, the first grate surface 2010 may be configured to allow fluids to pass through, but may prevent larger solid objects from passing through, such as rings, jewelry, debris, leaves, pebbles, hair, and similar foreign bodies. In some embodiments, the first grate surface 2010 is profiled with elongated slots that prevent debris from entering the trough 1101. While the first grate surface 2010 shows an example pattern, it should be understood that the pattern may be changed for aesthetics while the drain grate 1206 is still configured to prevent debris from entering the trough.

The drain grate 1206 may further include a first sidewall 2014 and a second sidewall 2016 (not shown in FIG. 34). The first sidewall 2014 and the second sidewall 2016 may extend away from the first grate surface 2010 in generally the first direction α. In some embodiments, the first sidewall 2014 and the second sidewall 2016 are parallel to one another. Both the first sidewall 2014 and the second sidewall 2016 extend between the first grate end 2002 and the second grate end 2004. The first sidewall 2014 and the second sidewall 2016 may be angled to facilitate insertion and removal of the drain grate 1206 into and out of the trough. For example, the first sidewall 2014 and the second sidewall 2016 may be angled toward each other (e.g., the first sidewall 2014 and the second sidewall 2016 are positioned apart at a greater distance proximate the first grate surface 2010 than distal to the first grate surface 2010) such that the drain grate 1206 may form a wedge that facilitates insertion into the trough. In some embodiments, the first sidewall 2014 and the second sidewall 2016 may be angled away from one another.

Figure 35:
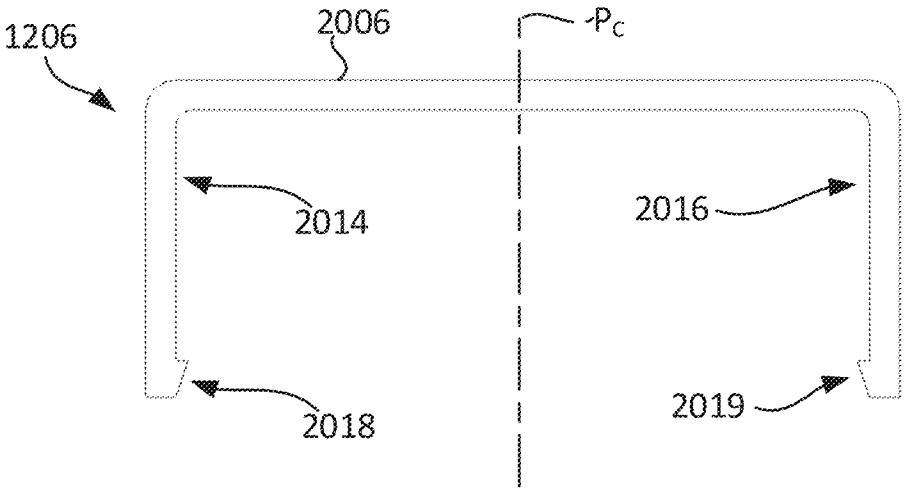
FIG. 35 is a side view of the portion of the linear drain assembly of FIG. 34, according to an exemplary embodiment.

Referring now to FIG. 35, a side view of the drain grate 1206 is shown. Extending away from the first sidewall 2014 in a direction generally toward the central plane $P_C$, the drain grate 1206 further includes a first hook 2018. The first hook 2018 extends away from the first sidewall 2014 at an end of the first sidewall 2014 opposite the first grate surface 2010. Similarly, extending away from the second sidewall 2016 in a direction generally toward the central plane $P_C$, the drain grate 1206 further includes a second hook 2019. The second hook 2019 extends away from the second sidewall 2016 at an end of the second sidewall 2016 opposite the first grate surface 2010. The first hook 2018 and the second hook 2019 may be integrally formed with the drain grate 1206, such as by extrusion, milling, casting, forging, and stamping. The first hook 2018 and the second hook 2019 are configured to engage a support structure, shown as a fixture 2020.

Figure 36:
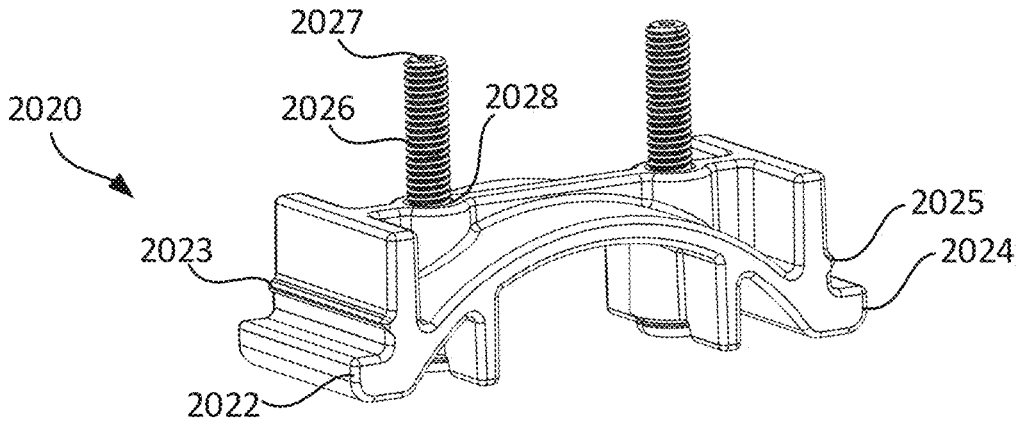
FIG. 36 is a perspective view of a portion of the linear drain assembly of FIG. 12, according to an exemplary embodiment.

Referring now to FIG. 36, the fixture 2020 is shown, according to an example embodiment. The fixture 2020 is configured to be positioned within an interior of the drain grate 1206. The first grate surface 2010, the first sidewall 2014, the second sidewall 2016, the first endcap 2006, and the second endcap 2008 cooperate to form the interior of the drain grate 1206. The fixture 2020 includes a first fixture flange 2022 configured to interface with the first sidewall 2014 and a second fixture flange 2024 configured to interface with the second sidewall 2016. When the drain grate 1206 is positioned within the trough, the fixture 2020 may interface with the catch pan 1402 (e.g., the catch pan of the second peripheral portion 1204, the first base surface 1312) and the first fixture flange 2022 may be positioned between the first sidewall 2014 and the catch pan 1402. Similarly, the second fixture flange 2024 may be positioned between the second sidewall 2016 and the catch pan 1402.

The fixture 2020 further includes a first projection 2023 configured to engage the first hook 2018 to facilitate coupling of the fixture 2020 with the drain grate 1206. The first projection 2023 extends away from the fixture 2020 in a direction generally away from the central plane $P_C$. Similarly, the fixture 2020 includes a second projection 2025 extending away from the fixture 2020 in a direction opposite to the first projection 2023, the second projection 2025 configured to engage the second hook 2019 to facilitate coupling of the fixture 2020 with the drain grate 1206. To couple the fixture 2020 with the drain grate 1206, the fixture 2020 is pressed into the drain grate 1206 such that the first hook 2018 is positioned between the first fixture flange 2022 and the first projection 2023, and such that the second hook 2019 is positioned between the second fixture flange 2024 and the second projection 2025. The drain grate 1206 may be coupled with a plurality of fixtures 2020 along the length of the drain grate 1206 to facilitate leveling of the drain grate 1206 within the trough 1101.

Figure 37:
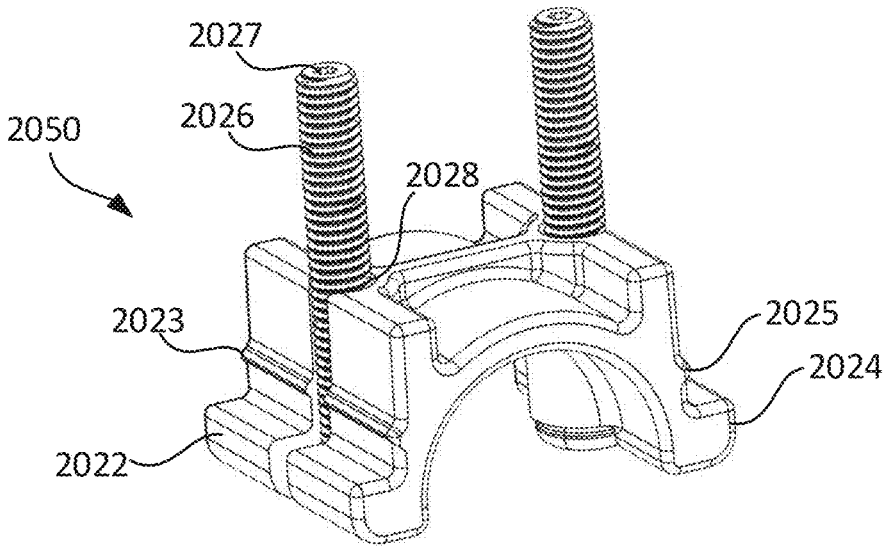
FIG. 37 is a perspective view of a portion of the linear drain assembly of FIG. 20, according to an exemplary embodiment.

The fixture 2020 is configured to receive a threaded body, shown as an adjustable leg 2026. The adjustable leg 2026 is configured to thread into a threaded orifice 2028 of the fixture 2020. As the adjustable leg 2026 is threaded into the fixture 2020, the adjustable leg 2026 translates in the first direction a, the fixture 2020 interfacing with the catch pan 1402 and biasing the fixture 2020 away from the catch pan 1402. Thus, the first fixture flange 2022 and the second fixture flange 2024 are displaced from the catch pan 1402. This allows the drain grate 1206 to be leveled within the trough. In some embodiments, the distal ends of the linear drain assembly (e.g., the catch pan 1402 proximate the second end 1414 and the catch pan of the second peripheral portion 1604 proximate to a second end of the second peripheral portion 1604) are raised above the first base surface 1312 such that the catch pan 1402 and the catch pan of the second peripheral portion 1604 bias fluids toward the outlet body 1210. Thus, the catch pan 1402 and the catch pan of the second peripheral portion may not be level with the ground (e.g., level relative to gravity) and the drain grate 1206 may not sit flush across all of the catch pan 1402, the catch pan of the second peripheral portion 1204, and the first base surface 1312. Thus, by threading the adjustable leg 2026 into the threaded orifice 2028, the first fixture flange 2022 and the second fixture flange 2024 may be adjusted to be level. In some embodiments, the drain grate 1206 includes a plurality of fixtures 2020 positioned within the drain grate 1206 and profiled along the length of the drain grate 1206, each of the plurality of fixtures 2020 interfacing with the drain grate 1206 and leveling the drain grate 1206. To allow for easy adjustment of the fixture 2020, the adjustable leg 2026 may be engaged with a tool (or by hand) from above the trough 1101 such that the adjustable leg 2026 may be threaded while the fixture 2020 is positioned within the trough 1101. For example, prior to disposing the drain grate 1206 within the trough, a plurality of fixtures 2020 may be coupled with the drain grate 1206. The first grate surface 2010 may include the plurality of apertures 2012 such that a tool (e.g., screw driver, torx driver, etc.) may be extended through the first grate surface 2010 and engage the adjustable leg 2026 for adjustment. As shown in FIGS. 36-37, the adjustable leg 2026 further includes a tool slot (e.g., torx, Philips, etc.) 2027 for engagement with a tool. Each of the plurality of fixtures 2020 may be adjusted from above and through the first grate surface 2010 such that the first fixture flange 2022 and the second fixture flange 2024 are level.

In some embodiments, if the trough length Leis approximately 36 inches, seven of the fixtures 2020 may be positioned within the trough 1101 equidistant from one another. The first fixture 2020 may be positioned proximate to the second end of the second peripheral portion 1204, and the seventh fixture 2020 may be positioned proximate to the second end 1414. The five other fixtures 2020 may be spaced equidistant from one another between the first fixture 2020 and the seventh fixture 2020. When the drain grate 1206 is positioned within the trough 1101, the drain grate 1206 is configured to interface with the first fixture flange 2022 and the second fixture flange 2024 of each of the fixtures 2020. However, because the catch pan 1402 and the catch pan of the second peripheral portion 1204 are sloped toward the outlet body 1210, each of the fixtures 2020 may be adjusted to facilitate leveling of the drain grate 1206 within the trough 1101.

Referring to FIG. 37, a fixture 2050 is shown according to another embodiment. The fixture 2050 is similar to the fixture 2020. Accordingly, like numbering is used to designate like parts between the fixture 2020 and the fixture 2050. A difference between the fixture 2050 and the fixture 2020 is that the fixture 2050 is narrower then (e.g., a distance between the first fixture flange 2022 and the second fixture flange 2024 is less than) the fixture 2020 such that the fixture 2050 may be coupled with a narrower drain grate (e.g., the drain grate 1606).

Figure 38:
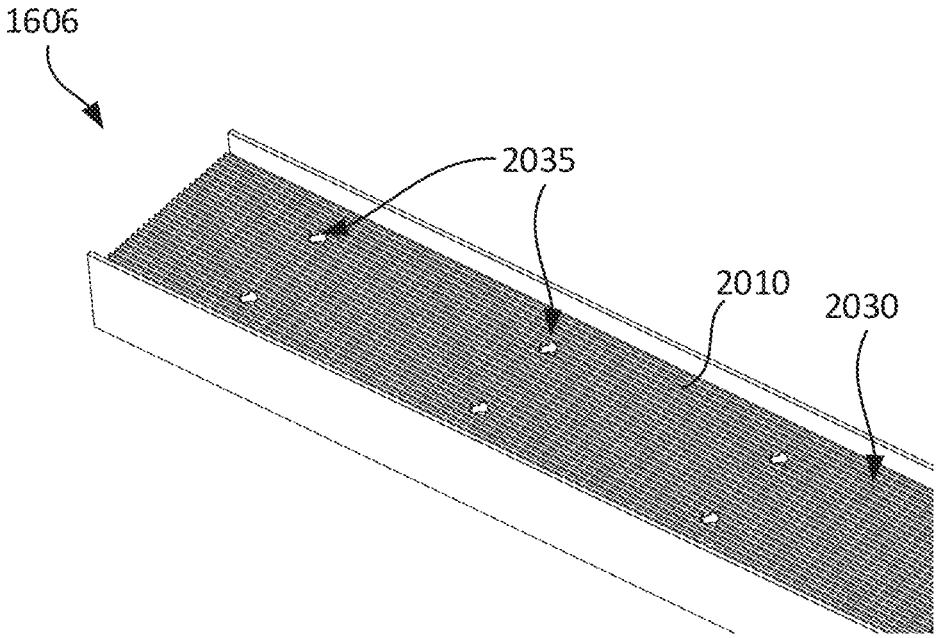
FIG. 38 is a detailed perspective view of a portion of the linear drain assembly of FIG. 20, according to an exemplary embodiment.
Figure 39:
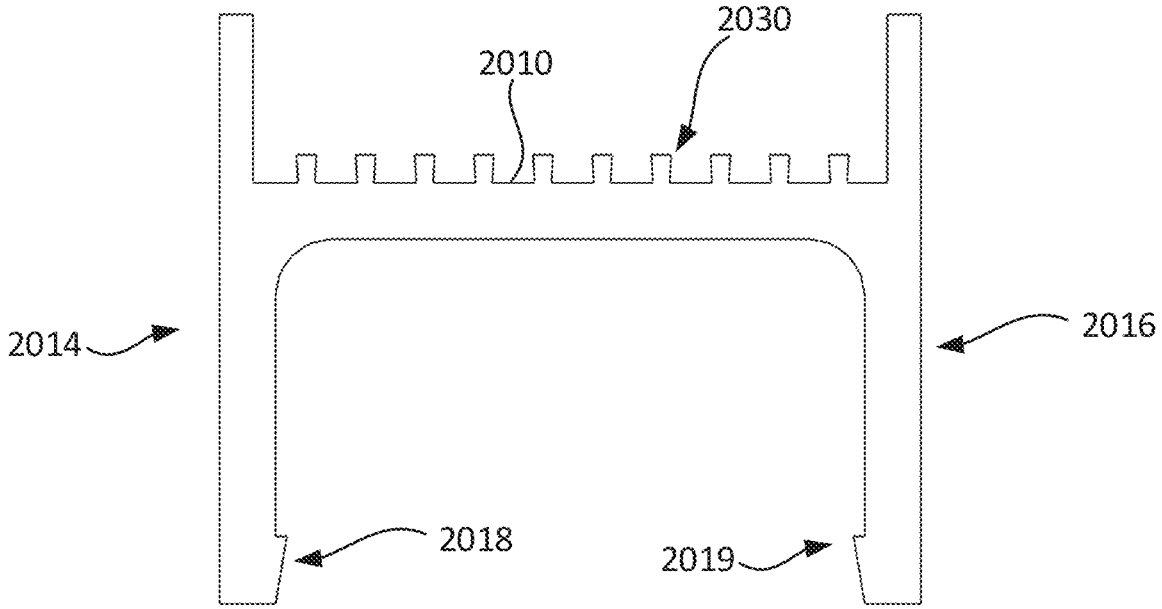
FIG. 39 is a side view of the portion of the linear drain assembly of FIG. 38, according to an exemplary embodiment.

Shown in FIGS. 38-39 is an example embodiment of the drain grate 1606. The drain grate 1606 is similar to the drain grate 1206. Accordingly, like numbering is used to designate like parts between the drain grate 1606 and the drain grate 1206. The drain grate 1606 shown is an example of a tile-over drain grate. After the linear drain assembly 1500 is assembled and installed, the installer may tile the floor of the shower environment, including coupling tile with the first grate surface 2010. The first grate surface 2010 may include a plurality of ridges 2030 configured to receive a tile adhesive and facilitate engagement of the tile adhesive with the drain grate 1606. Extending through the first grate surface 2010 may be a plurality of apertures 2035 positioned to allow a user to engage the tool slot 2027 of the adjustable leg 2026 while the fixture 2020 is coupled with the drain grate 1606 and while the drain grate 1606 and the fixture 2020 are positioned within the trough 1501.

Figure 40:
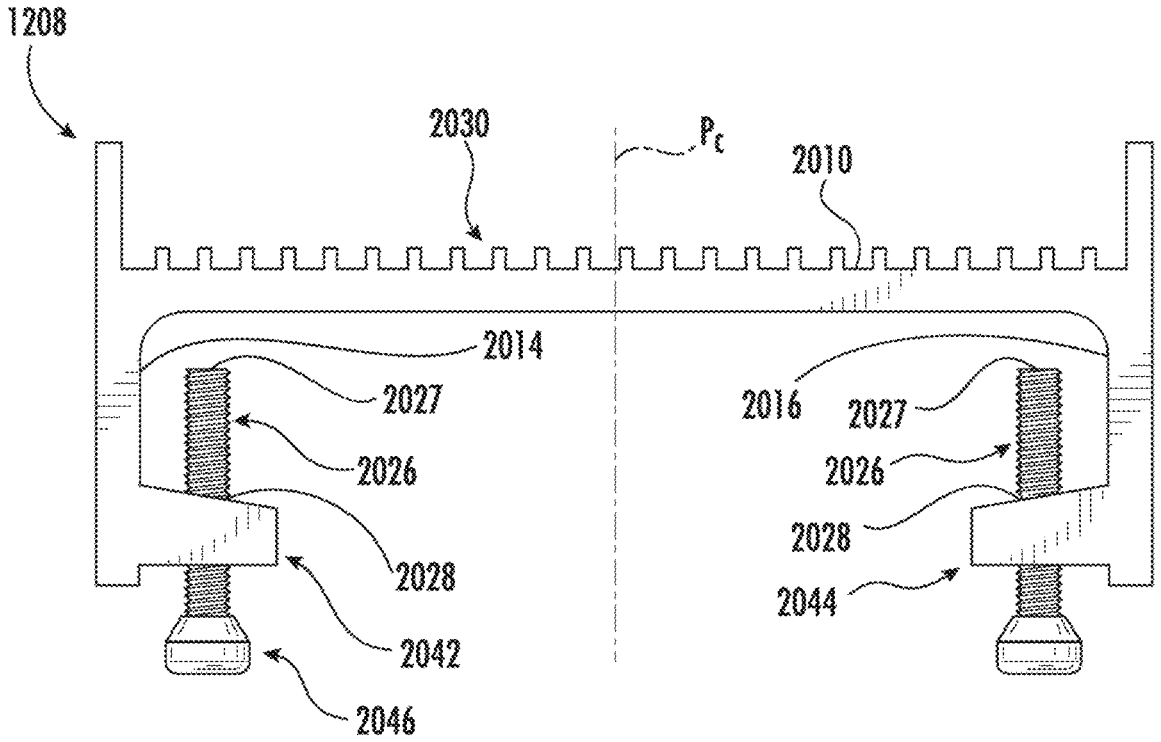
FIG. 40 is a side view of a portion of the linear drain assembly of FIG. 12, according to an exemplary embodiment.
Figure 41:
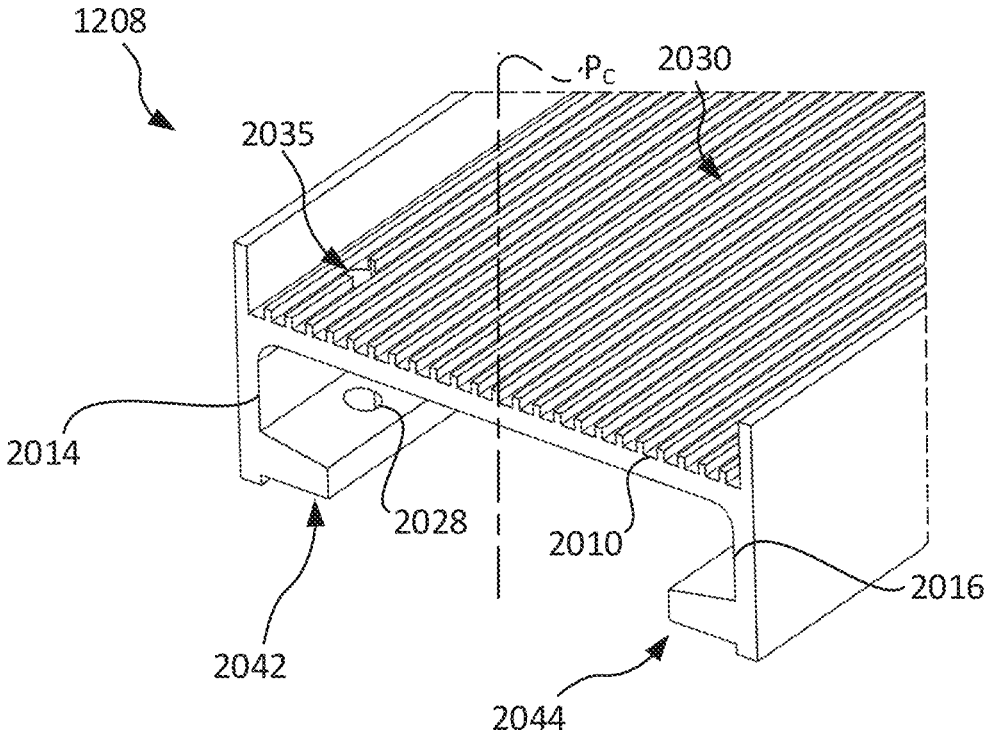
FIG. 41 is a detailed perspective view of the portion FIG. 40, according to an exemplary embodiment.

Turning now to FIGS. 40 and 41, a side view (FIG. 40) and a detailed perspective view (FIG. 41) of a drain grate 1208 are shown according to an example embodiment. The drain grate 1208 is similar to the drain grate 1206. Accordingly, like numbering is used to designate like parts between the drain grate 1206 and the drain grate 1208. A difference between the drain grate 1208 and the drain grate 1206 is that the drain grate 1208 includes apertures through which adjustable feet are threaded.

Extending away from the first sidewall 2014 in a direction generally toward the central plane $P_C$, the drain grate 1208 further includes a first grate flange 2042. The first grate flange 2042 extends away from the first sidewall 2014 at an end of the first sidewall 2014 opposite the first grate surface 2010. Similarly, extending away from the second sidewall 2016 in a direction generally toward the central plane $P_C$, the drain grate 1208 further includes a second grate flange 2044. The second grate flange 2044 extends away from the second sidewall 2016 at an end of the second sidewall 2016 opposite the first grate surface 2010. The first grate flange 2042 and the second grate flange 2044 may be integrally formed with the drain grate 1208, such as by extrusion, milling, casting, forging, and stamping. The first grate flange 2042 and the second grate flange 2044 are configured to receive the adjustable leg 2026. The plurality of apertures 2035 allow the user to access the tool slot 2027 of the adjustable leg 2026 to allow the user to adjust the height of the drain grate 1208 without having to lift the drain grate 1208 and turn the adjustable leg 2026 from underneath. A tool may be extended through the plurality of apertures 2035.

Specifically, the first grate flange 2042 includes the threaded orifice 2028 extending through the first grate flange 2042 and configured to form a threaded engagement with the adjustable leg 2026. The first grate flange 2042 may be profiled with a plurality of the threaded orifices 2028, equidistantly spaced from one another. For example, the plurality of threaded orifices 2028 may be spaced apart by 3-6 inches. Coupled to an end of the adjustable leg 2026 opposite to the tool slot 2027 is a shoe 2046. The shoe 2046 may be a rubber cap that prevents the adjustable leg 2026 from scratching the base portion 1200 when the drain grate 1208 is positioned within the base portion 1200. The shoe 2046 may receive a portion of the adjustable leg 2026.

Figure 42:
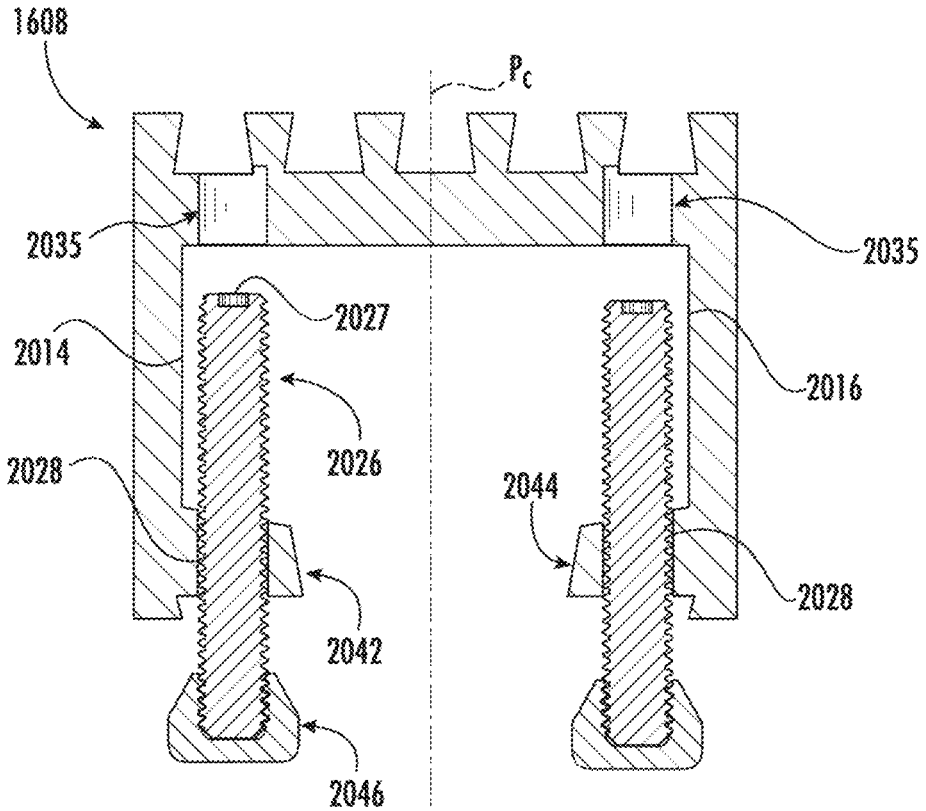
FIG. 42 is a cross-sectional side view of a portion of the linear drain assembly of FIG. 20, according to an exemplary embodiment.

Turning now to FIGS. 42, a cross-sectional side view of a drain grate 1608 shown according to an example embodiment. The drain grate 1608 is similar to the drain grate 1208. Accordingly, like numbering is used to designate like parts between the drain grate 1608 and the drain grate 1208. A difference between the drain grate 1608 and the drain grate 1208 is that the drain grate 1608 is narrower. Specifically, a distance between the first sidewall 2014 and the second sidewall 2016 of the drain grate 1608 is less than a distance between the first sidewall 2014 and the second sidewall 2016 of the drain grate 1208.

Extending away from the first sidewall 2014 in a direction generally toward the central plane $P_C$, the drain grate 1608 further includes a first grate flange 2042. The first grate flange 2042 extends away from the first sidewall 2014 at an end of the first sidewall 2014 opposite the first grate surface 2010. Similarly, extending away from the second sidewall 2016 in a direction generally toward the central plane $P_C$, the drain grate 1208 further includes a second grate flange 2044. The second grate flange 2044 extends away from the second sidewall 2016 at an end of the second sidewall 2016 opposite the first grate surface 2010. The first grate flange 2042 and the second grate flange 2044 may be integrally formed with the drain grate 1208, such as by extrusion, milling, casting, forging, and stamping. The first grate flange 2042 and the second grate flange 2044 are configured to receive the adjustable leg 2026.

Specifically, the first grate flange 2042 includes the threaded orifice 2028 extending through the first grate flange 2042 and configured to form a threaded engagement with the adjustable leg 2026. The first grate flange 2042 may be profiled with a plurality of the threaded orifices 2028, equidistantly spaced from one another. For example, the plurality of threaded orifices 2028 may be spaced apart by 3-6 inches. Coupled to an end of the adjustable leg 2026 opposite to the tool slot 2027 is the shoe 2046. Concentric with the threaded aperture 2038 is the aperture 2035. In some embodiments, the threaded orifice 2028 and the aperture 2035 may be machined at the same time, such as by milling or a drill press. The aperture 2035 allows an installer to access the tool slot 2027 while the adjustable leg 2026 is threaded within the threaded orifice 2028.

Figure 43:
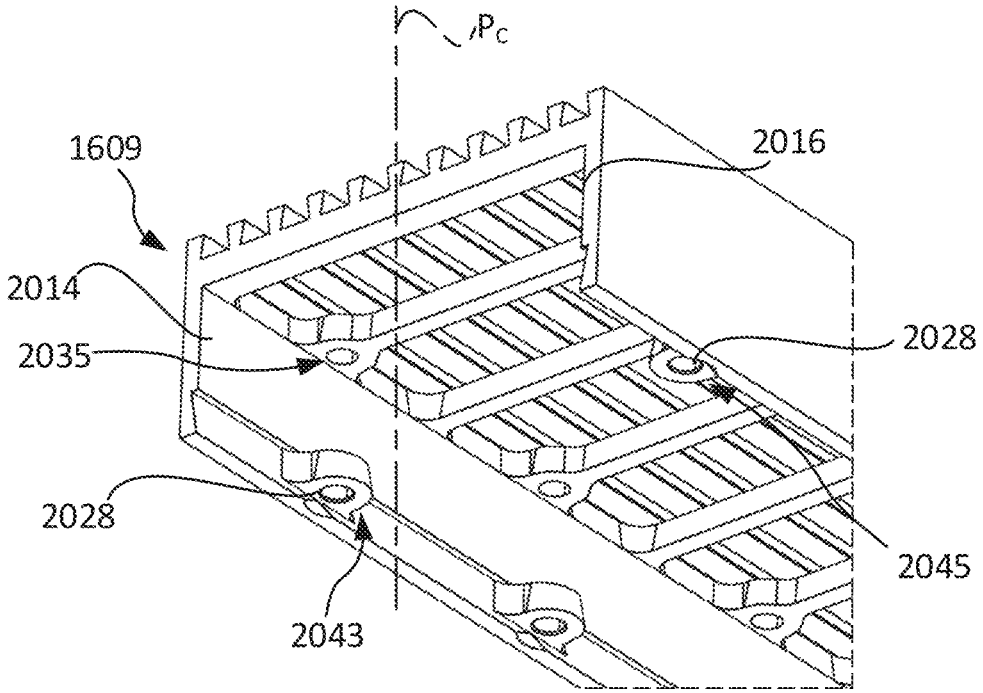
FIG. 43 is a bottom perspective view of a portion of the linear drain of FIG. 20, according to an example embodiment, according to an exemplary embodiment.

Referring now to FIG. 43, a bottom perspective view of a drain grate 1609 is shown according to an example embodiment. The drain grate 1609 is similar to the drain grate 1608. Accordingly, like numbering is used to designate like parts between the drain grate 1609 and the drain grate 1608. A difference between the drain grate 1609 and the drain grate 1608 is that the drain grate 1609 is wider. Specifically, a distance between the first sidewall 2014 and the second sidewall 2016 of the drain grate 1609 is greater than a distance between the first sidewall 2014 and the second sidewall 2016 of the drain grate 1608.

Extending away from the first sidewall 2014 in a direction generally toward the central plane $P_C$, the drain grate 1609 includes a first grate boss 2043. The first grate boss 2043 extends away from the first sidewall 2014 at an end of the first sidewall 2014 opposite the first grate surface 2010. Similarly, extending away from the second sidewall 2016 in a direction generally toward the central plane $P_C$, the drain grate 1609 further includes a second grate boss 2045. The second grate boss 2045 extends away from the second sidewall 2016 at an end of the second sidewall 2016 opposite the first grate surface 2010. The first grate boss 2043 and the second grate boss 2045 may be integrally formed with the drain grate 1609, such as by extrusion, milling, casting, forging, and stamping. For example, the drain grate 1609 may be manufactured by milling such that a desirable appearance in achieved when a user looks down into the trough from above.

The first grate boss 2043 and the second grate boss 2045 are configured to receive the adjustable leg 2026. Specifically, the first grate boss 2043 includes the threaded orifice 2028 extending through the first grate boss 2043 and configured to form a threaded engagement with the adjustable leg 2026. The first grate boss 2043 may be positioned proximate another first grate boss 2043 such that a plurality of first grate bosses 2043 are profiled along the length of the drain grate 1609. As a result, a plurality of the threaded orifices 2028 are equidistantly spaced from one another. In some embodiments, the plurality of threaded orifices 2028 may be spaced apart by 3-6 inches. Coupled to an end of the adjustable leg 2026 opposite to the tool slot 2027 is the shoe 2046. Concentric with the threaded aperture 2038 is the aperture 2035. In some embodiments, the threaded orifice 2028 and the aperture 2035 may be machined at the same time, such as by milling or a drill press. The aperture 2035 allows an installer to access the tool slot 2027 while the adjustable leg 2026 is threaded within the threaded orifice 2028. This avoids the need for the installer to lift the drain grate 1609 out of the trough to adjust the height of the adjustable legs 2026.

Figure 44:
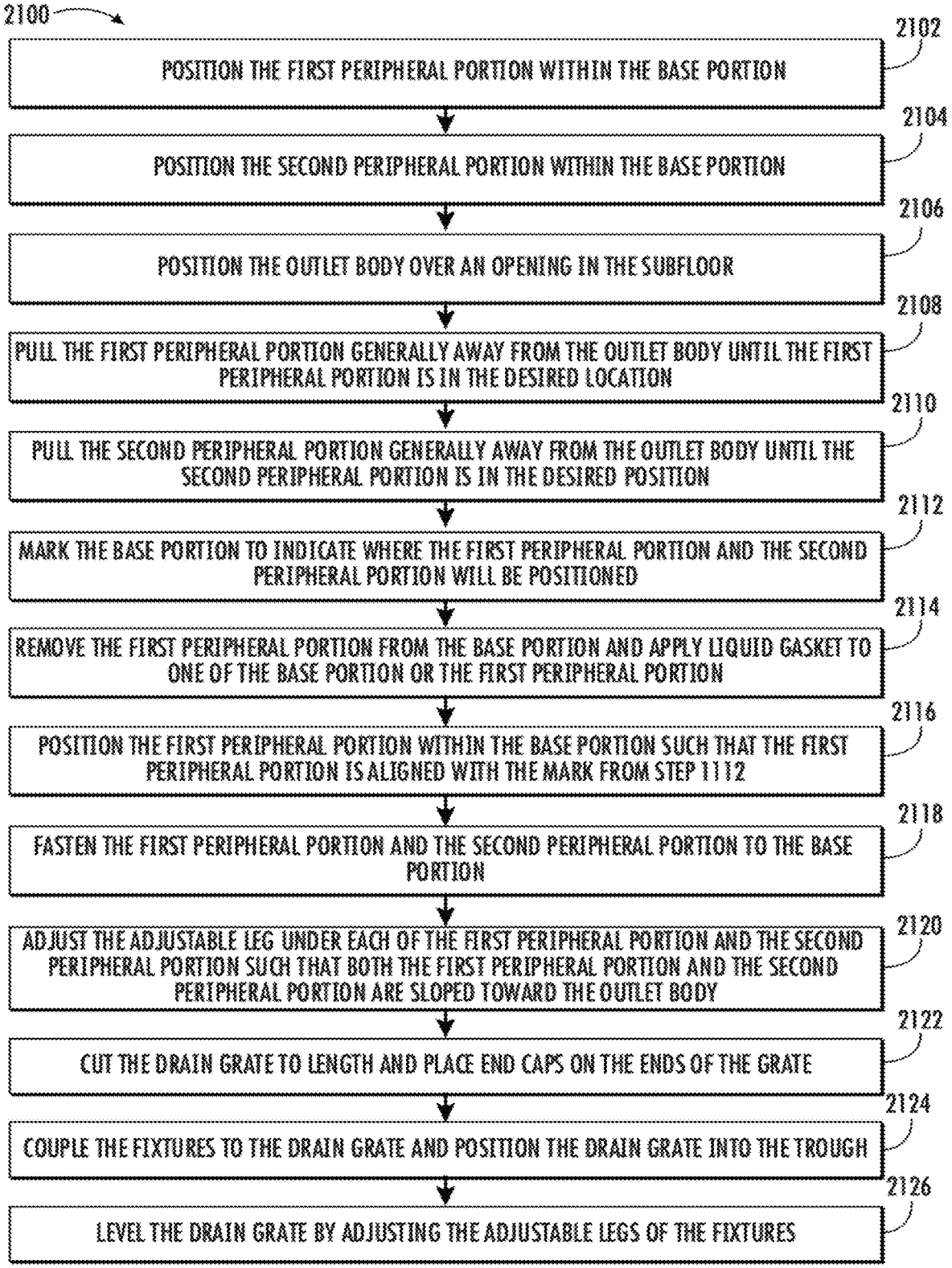
FIG. 44 is a flow chart of a method of assembling and installing the linear drain assembly of FIG. 12 and FIG. 20, according to an exemplary embodiment.

Referring to FIG. 44, a method 2100 of assembling and installing the linear drain assembly 1100 is shown and described. At 2102, slide the first peripheral portion 1202 onto the base portion 1200 such that the second base flange 1320 is received within the first flange cavity 1450 and the first base flange 1318 is received within the second flange cavity 1451. In some embodiments, the first peripheral portion 1202 may be inserted into the base portion 1200 from above. The first peripheral portion 1202 may be slid onto the base portion 1200 such that the first end 1412 is positioned proximate to the outlet body 1210 and the second end 1414 is positioned proximate to the second base end 1302.

At 2104, slide the second peripheral portion 1204 onto the base portion 1200 such that the first base flange 1318 is received within a second flange cavity of the second peripheral portion 1204 and the second base flange 1320 is received within the a first flange cavity of the second peripheral portion 1204. In some embodiments, the second peripheral portion 1204 may be inserted into the base portion 1200 from above. The second peripheral portion 1204 may be slid onto the base portion 1200 such that a first end is positioned proximate to the outlet body 1210 and a second end of the second peripheral portion 1204 is positioned proximate to the second base end 1302.

In some embodiments, the first peripheral portion 1202 and the second peripheral portion 1204 may be slidingly coupled to the base portion 1200 when the installer removes the linear drain assembly 1100 from the commercial packaging. Also, the fasteners may be pre-threaded into the first aperture 1446 and the second aperture 1456 such that the first peripheral portion 1202 is able to slide along the base portion 1200 and be adjusted.

At 2106, the outlet body 1210 is positioned proximate to the drain plumbing configured to carry waste away from the shower enclosure. The outlet body 1210 may be coupled to the drain plumbing. In some embodiments, step 2106 may be performed prior to steps 2102 and 2104.

At 2108, the first peripheral portion 1202 may be slid or moved such that the first end 1412 is moved away from the outlet body 1210. For example, if the linear drain assembly 1100 is to extend between two walls, the second end 1414 of the first peripheral portion 1202 may be pulled to be proximate to one of the two walls. At 2110, the second peripheral portion 1204 may be slid or moved such that a first end of the second peripheral portion 1204 is moved away from the outlet body 1210. For example, if the linear drain assembly 1100 is to extend between two walls, the second end of the second peripheral portion 1204 may be pulled to be proximate to one of the two walls.

At 2112, the installer marks on the base portion 1200 where the first peripheral portion 1202 and the second peripheral portion 1204 are to be located. The installer may use a grease pen, marker, or scratch the base portion 1200 with a sharp object, such as a nail.

At 2114, a liquid gasket is applied to the first peripheral portion 1202 and the second peripheral portion 1204. Specifically, the liquid gasket is applied to the outer surface of the first peripheral portion 1202. As outlined above, the first peripheral portion 1202 may include a roughened surface that is configured to receive an adhesive or seal. For example, the first peripheral portion 1202 may include a roughened surface that extends across all of the first outer wall 1434, the second outer wall 1436, the flange 1410, and the outer catch surface 1437. The roughened surface may increase the surface area available for an adhesive to adhere to. When an installer is ready to position the first peripheral portion 1202 within the base portion 1200, the installer may apply an adhesive (e.g., bead of caulking, silicon sealant, gasket, etc.) to the roughened surface. In some embodiments, the installer applies the liquid gasket directly to the base portion 1200, and more specifically to each of the first base surface 1312, the second base surface 1314, the third base surface 1316, the fourth base surface 1322, and the fifth base surface 1324 such that a substantially watertight seal is formed between the base portion 1200 and the first peripheral portion 1202 when the base portion 1200 and the first peripheral portion 1202 are coupled with one another. Similarly, application of the liquid adhesive to the second peripheral portion 1204 may be similar to application of the liquid gasket to the first peripheral portion 1202.

At 2116, the first peripheral portion 1202 is placed within the base portion 1200. The first peripheral portion 1202 may be inserted from above (e.g., from the second direction $\beta$ and in the first direction $\alpha$) such that the adhesive is interposed between the roughened surface and the base portion 1200. In some embodiments, the installer hooks the first base flange 1318 with the second ledge 1440 first, and then rotates the first peripheral portion 1202 into the portion of the trough 1101 defined by the base portion 1200. The second peripheral portion 1204 is similarly installed. The installer may align the first peripheral portion 1202 and the second peripheral portion 1204 with the marks made on the base portion 1200 in step 2112.

At 2118, the first peripheral portion 1202 is coupled to the base portion 1200. The first peripheral portion 1202 may be coupled to the base portion 1200 using fasteners, adhesive, welding, or the like. For example, a fastener may be inserted through the second ledge 1440 until the fastener interfaces with the base portion 1200. The fastener may bias the base portion 1200 toward the first peripheral portion 1202 until the liquid gasket is compressed and forms a substantially watertight seal between the first peripheral portion 1202 and the base portion 1200. The second peripheral portion 1204 may be coupled to the base portion 1200. The second peripheral portion 1204 may be coupled to the base portion 1200 using fasteners, adhesive, welding, and the like. For example, a fastener may be inserted through a first ledge of the second peripheral portion 1204 until the fastener interfaces with the base portion 1200. The fastener may bias the base portion 1200 toward the second peripheral portion 1204 until the liquid gasket is compressed and forms a substantially watertight seal between the second peripheral portion 1204 and the base portion 1200.

The liquid gasket may require a period of time to cure (e.g., harden, set, dry, etc.). Thus, the fasteners may be used to secure the first peripheral portion 1202 to the base portion 1200 while the liquid gasket is curing. Similarly, the second peripheral portion 1204 may be coupled to the base portion 1200 while the liquid gasket is curing. Allowing the installer to couple the first peripheral portion 1202 and the second peripheral portion 1204 with the base portion 1200 while the liquid gasket is curing allows the installer to continue the installation process without having to worry about shifting the linear drain assembly 1100 and adversely affecting the seal formed by (e.g., forming from) the liquid gasket.

At 2120, the leg assembly 1900 may be adjusted to properly position the first peripheral portion 1202 and the second peripheral portion 1204 relative to the outlet body 1210. One leg assembly 1900 is coupled to each of the first peripheral portion 1202 and the second peripheral portion 1204. To adjust the leg assembly 1900, the mount member 1914 is moved until the first peripheral portion 1202 is at the desired height. Next, the sticker 1924 is applied to the mount flange 1922 and the sticker 1924 is pressed through the opening 1920 such that the sticker 1924 is coupled with the floor and the leg assembly 1900 is fixed in position. In some embodiments, the installer may fasten the mount member 1914 to the floor using fasteners. In some embodiments, the first leg 1902 and the second leg 1904 are selectively coupled to the first peripheral portion 1202 via the fastener 1932 until the desired height of the first peripheral portion 1202 is achieved.

At 2122, the drain grate 1206 may be cut to fit within the trough 1101 formed by the base portion 1200, the first peripheral portion 1202, and the second peripheral portion 1204. The drain grate 1206 may be formed of a metal or metal alloy and configured to be cut using a hacksaw or jigsaw. In some embodiments, the drain grate 1206 is formed of wood, plastic, nylon, a polymer, or a similar material. After the drain grate 1206 is cut to the appropriate length, the first endcap 2006 and the second endcap 2008 may be coupled to the ends of the drain grate 1206.

At 2124, the fixtures 2020 are coupled to the drain grate 1206, such as by engaging the fixtures with the first hook 2018 and the second hook 2019. In some embodiments, the fixture 2020 are positioned with the aperture 2035 such that the tool slot 2027 is accessible by a tool extending through the first grate surface 2010.

At 2126, after the fixture 2020 are coupled with the drain grate 1206, the drain grate 1206 is positioned within the trough 1101. The drain grate 1206 may then be leveled by threading and unthreading the adjustable leg 2026.

Figure 45:
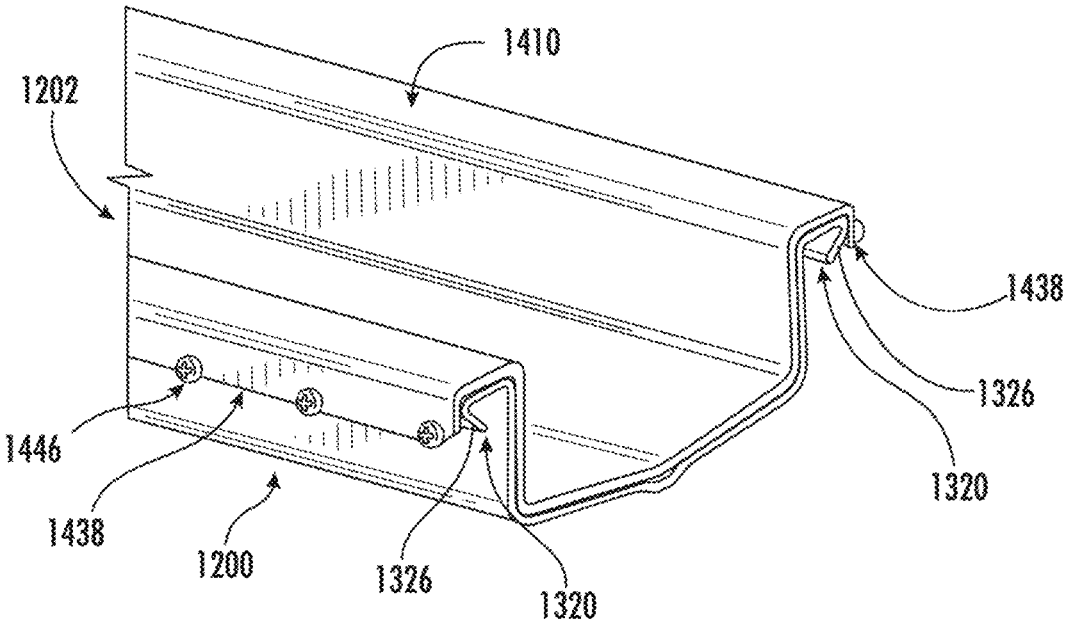
FIG. 45 is a detailed, perspective, cross-sectional view of the linear drain assembly of FIG. 12, according to an exemplary embodiment.

Referring now to FIG. 45, a perspective, cross-sectional view of the linear drain assembly 1100 is shown according to an example embodiment. The first peripheral portion 1202 is positioned within and coupled to the base portion 1200. As outlined above, the base portion 1200 includes a first base flange 1318 and a second base flange 1320. However, as shown in FIG. 43, both the flanges of base portion 1200 are the second base flange 1320. The second base flange 1320 includes a sixth base surface 1326 that extends away from the fifth base surface 1324 and toward the central plane $P_C$ at a non-zero angle. The angled sixth base surface 1326 behaves as a ramp when coupling the first peripheral portion 1202 to the base portion 1200. Specifically, when a fastener is threaded through the first peripheral portion 1202, the fastener engages with the sixth base surface 1326 and biases the second base flange 1320 into the flange 1410.

The first peripheral portion 1202 includes the first ledge 1438 extending from the flange 1410, the first ledge 1438 extending orthogonally away from the flange 1410. As shown in FIG. 43, the first peripheral portion 1202 does not include the second ledge 1440 extending toward the central plane $P_C$ at a non-zero angle.

To couple the first peripheral portion 1202 to the base portion 1200, a fastener is threaded through the first aperture 1446 from both sides of the first peripheral portion 1202, the fastener engaging the sixth base surface 1326. The flange configuration shown and described with respect to FIG. 45 allows the first peripheral portion 1202 to be inserted (e.g., positioned) within the base portion 1200 without twisting. For example, after the application of a liquid gasket to either of the first peripheral portion 1202 or the base portion 1200, the first peripheral portion 1202 may be dropped straight into the base portion 1200. In contrast, depending on the proportions of the flanges of FIGS. 14 and 17, the second ledge 1440 of the first peripheral portion 1202 may need to be hooked around the first base flange 1318 of the base portion 1200 and rotated down into the base portion 1200. In other words, the flange configuration disclosed with respect to FIG. 43 is similar to the flange configuration disclosed with respect to the linear drain assembly 1500.

Figure 46:
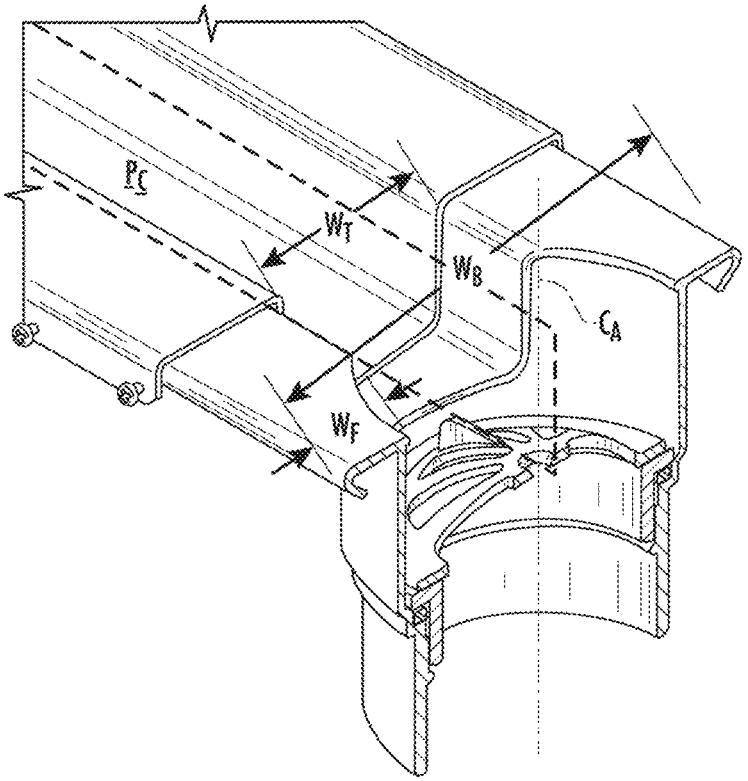
FIG. 46 is a detailed, perspective, cross-sectional view of the linear drain assembly of FIG. 20, according to an exemplary embodiment.

Turning now to FIG. 46, a perspective, cross-sectional view of the linear drain assembly 1500 is shown, according to an example embodiment. A difference between the linear drain assembly 1500 shown in FIG. 44 and the linear drain assembly 1500 disclosed in FIGS. 20-28 is that the central axis $C_A$ and the central plane $P_C$ are co-linear (e.g., co-planar, the central axis $C_A$ lies on the central plane $P_C$).

Another difference between the linear drain assembly 1500 shown in FIG. 46 and the linear drain assembly 1500 disclosed in FIGS. 20-28 is that the flange width $W_F$ of the linear drain assembly 1500 shown in FIG. 45 is greater than the flange width $W_F$ of the linear drain assembly 1500 disclosed in FIGS. 20-29 while the trough width $W_T$ of both is the same. As shown in FIG. 46, the flange width $W_F$ is greater than a diameter of the outlet body 1610 to aid in installation.

A similarity between the linear drain assembly 1500 shown in FIG. 46 and the linear drain assembly 1100 is the base width $W_B$. While the trough 1101 of the linear drain assembly 1100 is wider than the trough 1501 of the linear drain assembly 1500, the base width $W_B$ is approximately the same.

Figure 48:
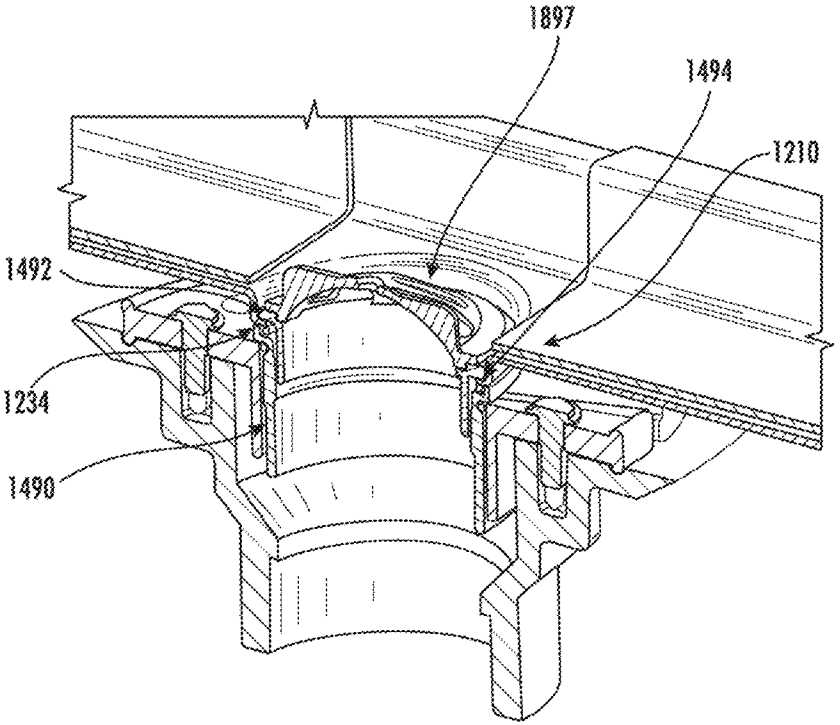
FIG. 48 is a detailed, perspective, cross-sectional view of the linear drain assembly of FIG. 20, according to an exemplary embodiment.
Figure 47:
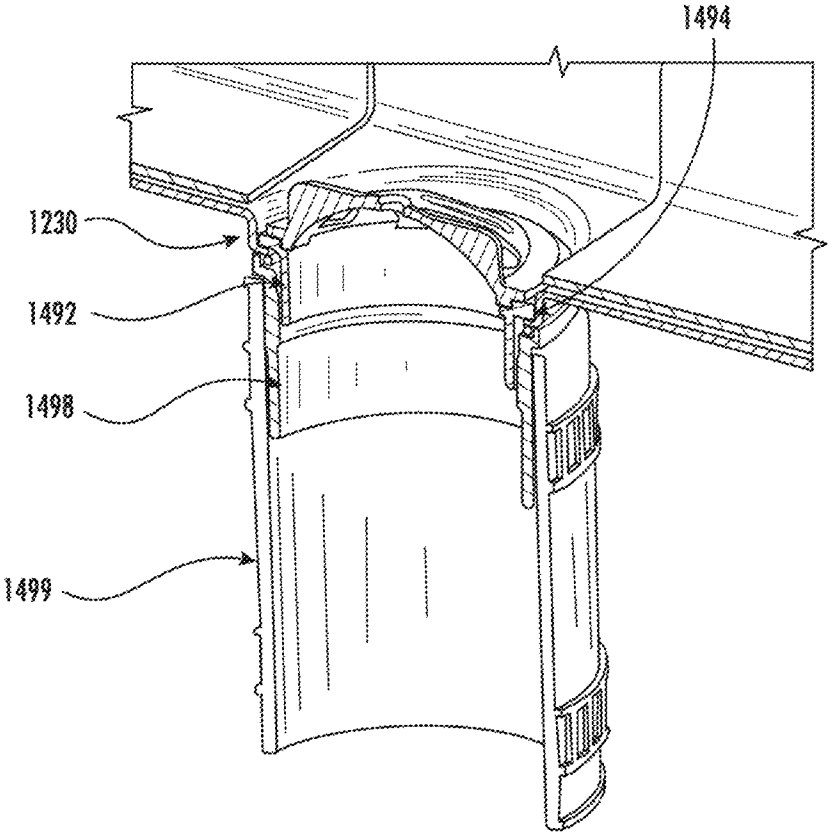
FIG. 47 is a detailed, perspective, cross-sectional view of the linear drain assembly of FIG. 20, according to an exemplary embodiment.
Figure 49:
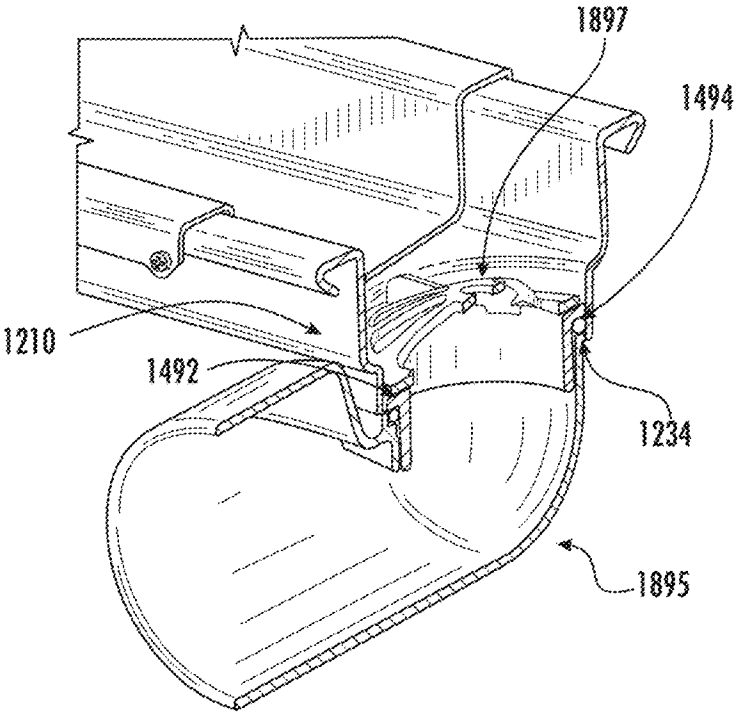
FIG. 49 is a detailed, perspective, cross-sectional view of the linear drain assembly of FIG. 20, according to an exemplary embodiment.

Referring to FIGS. 47-49, the outlet body 1210 is configured to be adapted to accommodate various outlet configurations. While not shown, the outlet body 1610 can be similarly adapted. Referring specifically to FIG. 47, a perspective, cross-sectional view of the outlet body 1210 is shown. The outlet body 1210 includes the first outlet portion 1230, but does not include the second outlet portion 1232. The outlet body 1210 includes the drain body 1492, the second sealing member 1494, and a coupling member 1498. The coupling member 1498 is similar to the second coupling member 1490. A difference between the coupling member 1498 and the second coupling member 1490 is that the coupling member 1498 does not include external threads. The drain body 1492 extends through the outlet body 1210 in the second direction β. The internal threads of the drain body 1492 are threadingly engaged with the internal threads of the coupling member 1498. The drain body 1492 cooperates with the coupling member 1498 to compress the second sealing member 1494 between the drain body 1492 and the outlet flange 1234 to form a substantially watertight seal. The drain body 1492 further includes a plurality of notches 1496 configured to receive the drain cover 1897 or hair trap such that the drain cover 1897 is prevented from rotation. The coupling member 1498 is configured for coupling to a floor drain or other drain plumbing via a pipe clamp 1499 (e.g., rubber pipe clamp). The pipe clamp 1499 may be fit around the coupling member 1498 and other drain plumbing to fluidly couple the coupling member 1498 to the drain plumbing.

Referring specifically to FIG. 48, a perspective, cross-sectional view of the outlet body 1210 is shown. The outlet body 1210 includes the first outlet portion 1230, but does not include the second outlet portion 1232. The outlet body 1210 includes the second coupling member 1490, the drain body 1492, the second sealing member 1494. The second coupling member 1490 is threaded into a floor drain (e.g., cast iron floor drain, etc.). Next, the drain body 1492 extends through the outlet body 1210 in the second direction β. The internal threads of the drain body 1492 are threadingly engaged with the internal threads of the second coupling member 1490 while the second coupling member 1490 is coupled to the floor drain. The drain body 1492 cooperates with the coupling member 1498 to compress the second sealing member 1494 between the drain body 1492 and the outlet flange 1234 to form a substantially watertight seal. The drain body 1492 further includes a plurality of notches 1496 configured to receive the drain cover 1897 or hair trap such that the drain cover 1897 is prevented from rotation.

Referring specifically to FIG. 49, a perspective, cross-sectional view of the outlet body 1210 is shown. The outlet body 1210 includes the first outlet portion 1230, but does not include the second outlet portion 1232. The outlet body 1210 further includes the drain body 1492, the second sealing member 1494, and the outlet adaptor 1895. The drain body 1492 extends through the outlet body 1210 in the second direction β and is threadingly coupled to the outlet adaptor 1895. The drain body 1492 cooperates with the coupling member 1498 to compress the second sealing member 1494 between the drain body 1492 and the outlet flange 1234 to form a substantially watertight seal. The drain body 1492 further includes a plurality of notches 1496 configured to receive the drain cover 1897 or hair trap such that the drain cover 1897 is prevented from rotation. The outlet adaptor 1895 may then be coupled to drain plumbing via a pipe clamp (e.g., the pipe clamp 1499).

Figure 50:
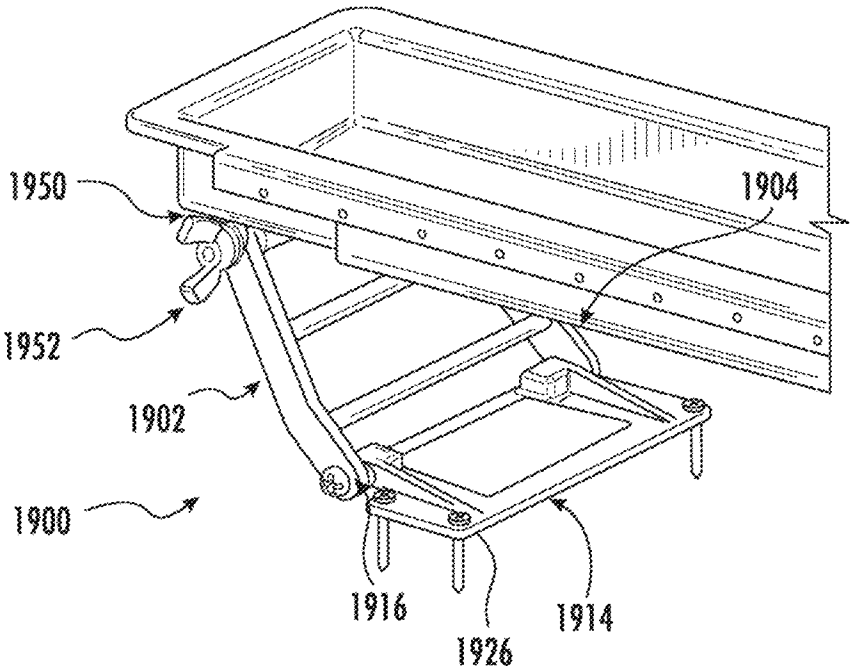
FIG. 50 is a detailed perspective view of the portion of the linear drain assembly of FIG. 31, according to an exemplary embodiment.

Referring now to FIG. 50, a perspective view of the leg assembly 1900 is shown, according to an example embodiment. A difference between the leg assembly 1900 shown in FIG. 50 and the leg assembly 1900 shown in FIGS. 31 and 32 is that first leg 1902 and the second leg 1904 are coupled together such that the first leg 1902 and the second leg 1904 move together. The leg assembly 1900 is rotatably coupled to a pair of eyelets 1950 coupled to the first peripheral portion 1602 and extending in the second direction β. A wingnut 1952 may selectively couple the first leg 1902 and the second leg 1904 to the first peripheral portion 1602 to lock the leg assembly 1900 in a desired configuration. Another difference between the leg assembly 1900 shown in FIG. 48 and the leg assembly 1900 shown in FIGS. 31 and 32 is that the first projection 1916 of the leg assembly 1900 shown in FIG. 48 is off-center such that the aperture 1926 is accessible to the installer.

Figure 51:
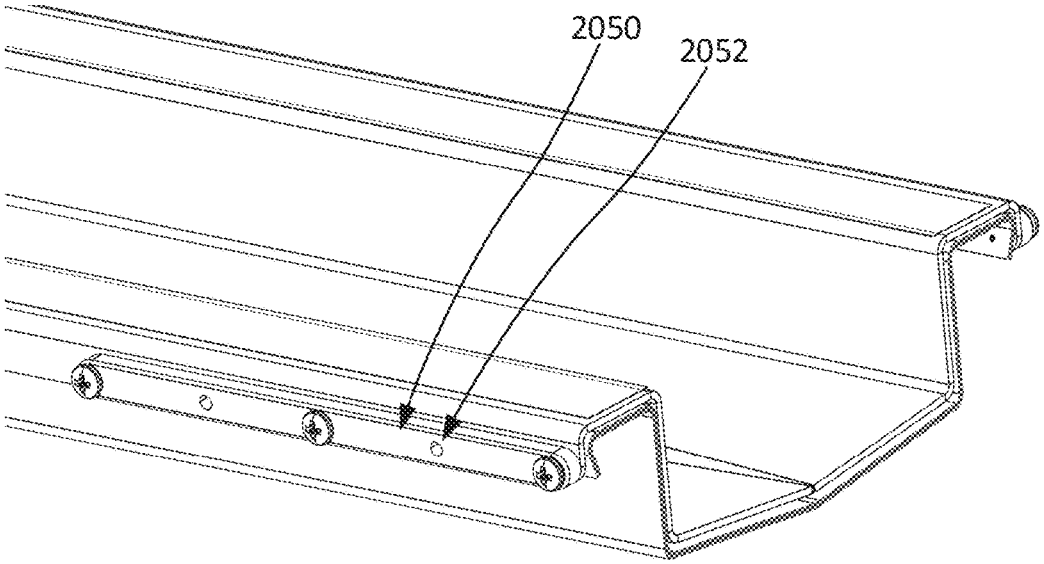
FIG. 51 is a perspective cross-sectional view of a linear drain assembly, according to an exemplary embodiment.
Figure 52:
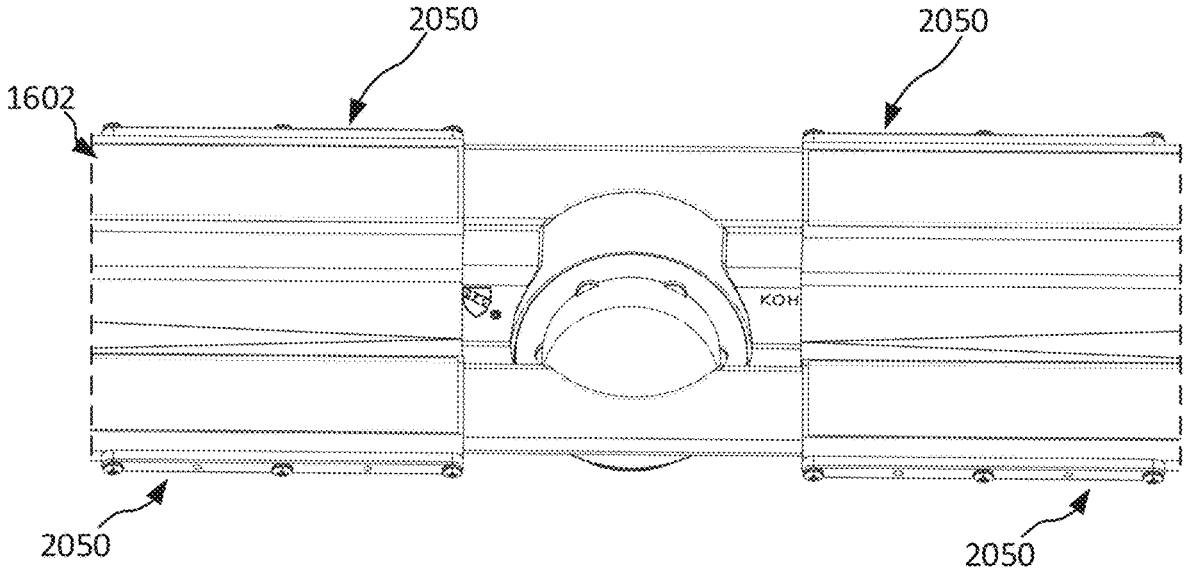
FIG. 52 is a top perspective view of a linear drain assembly, according to an exemplary embodiment.

Referring now to FIGS. 51 and 52, a threaded fixture 2050 is shown according to an example embodiment. The threaded fixture 2050 is coupled with the first ledge (e.g., first ledge 438) of the first peripheral portion (e.g., first peripheral portion 202, 602, 1202, 1602). The threaded fixture 2050 provides a threaded orifice 2052 configured to receive a fastener to couple the first peripheral portion with the base portion (e.g., base portion 200, 600, 1200, 1600). The threaded fixture 2050 may be provided on both the first peripheral portion and the second peripheral portion. The threaded fixture 2050 may include a plurality of the threaded orifices 2052 that are concentric with the apertures (e.g., 846) of the first ledge.

Figure 53:
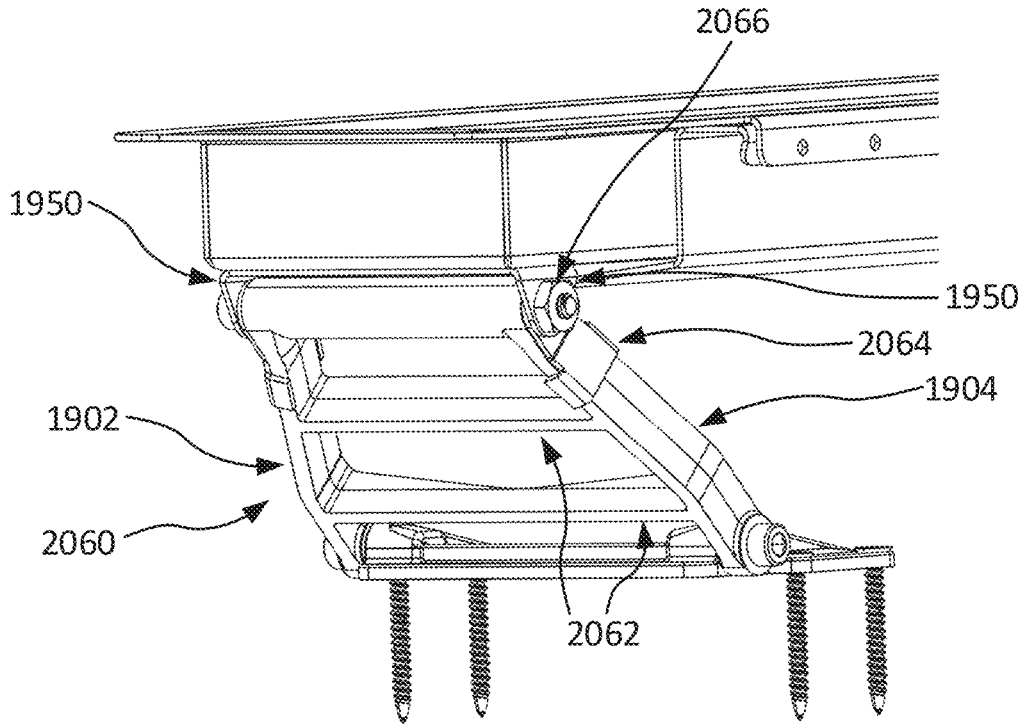
FIG. 53 is a perspective view of a portion of the linear drain assembly of FIG. 31, according to an exemplary embodiment.
Figure 54:
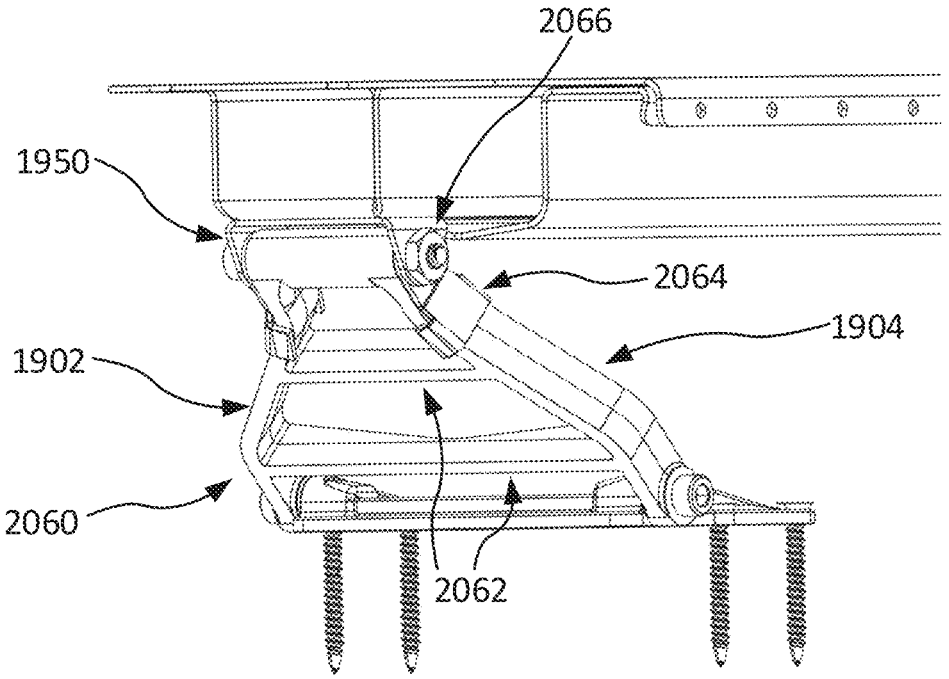
FIG. 54 is a perspective view of a portion of the linear drain assembly of FIG. 31, according to an exemplary embodiment.

Referring now to FIG. 53, a leg assembly 2060 is shown according to an example embodiment. The leg assembly 2060 is similar to the leg assembly 1900. A difference between the leg assembly 2060 and the leg assembly 1900 is that the first leg 1902 and the second leg 1904 are coupled to one another with cross-beams 2062 to increase the rigidity of the leg assembly 2060. Further, the leg assembly 2060 includes a pair of support brackets 2064 that are coupled with the first leg 1902 and the second leg 1904. The leg assembly 2060 further includes a fastener 2066 that rotatably couples the leg assembly 2060 with the peripheral portion. The fastener 2066 is tight enough such that the leg assembly 2060 may be positioned and maintained at any angle relative to the peripheral portion, but not so tight that a tool is required to loosen the fastener 2066 before rotating the leg assembly 2060. The leg assembly 2060 is continuously adjustable such that an installer is able to position the leg assembly 2060 in a desired position, and then reposition the leg assembly 2060 without tools and without being limited to set angles. Referring to FIG. 54, the leg assembly 2060 is shown in a narrower form factor.

102681 As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the linear drain assembly as shown in the various exemplary embodiments is illustrative only. Additionally, any element disclosed in one embodiment may be incorporated or utilized with any other embodiment disclosed herein. For example, the base portion 200 may include the first flange cavity 450 and the second flange cavity 451 of the first peripheral portion 202 described with reference to FIGS. 4-6, and the first base flange 318 and the second base flange 320 disclosed with reference to FIGS. 2-3 may be incorporated in the first peripheral portion 1202 such that the first peripheral portion 202 may telescope into the base portion 200, and more specifically so the first base flange 318 and the second base flange 320 now incorporated on the first peripheral portion 202 may be received within the first flange cavity 450 and the second flange cavity 451 now incorporated in the base portion 200. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A linear drain assembly comprising:

a base portion comprising a base trough and a base flange; and a first peripheral portion comprising a first trough and a first flange;

wherein the first trough is nested within the base trough and the base flange is nested within the first flange; and wherein the first peripheral portion is slidable along the base portion when the first trough is nested within the base trough.

2. The linear drain assembly of claim 1, wherein the base portion further includes an outlet body extending away from the base portion and in fluid communication with both the base trough and the first trough.

3. The linear drain assembly of claim 1, further comprising a second peripheral portion comprising a second trough and a second flange, the second trough configured for nesting within the base trough and second flange configured to receive the base flange, the second peripheral portion slidable along the base portion independently of the first peripheral portion when the second trough is nested within the base trough.

4. The linear drain assembly of claim 3, wherein all of the base portion, the first peripheral portion, and the second peripheral portion are formed of stainless steel.

5. The linear drain assembly of claim 1, wherein the first peripheral portion further includes a first ledge extending away from the first flange, the first ledge and the first flange cooperating to define a first flange cavity that receives the base flange.

6. The linear drain assembly of claim 5, wherein the first ledge comprises a first aperture extending through the first ledge and configured to receive a fastener.

7. The linear drain assembly of claim 6, further comprising a threaded fixture configured to receive the fastener.

8. The linear drain assembly of claim 1, further comprising a drain grate positionable within both the base trough and the first trough, the drain grate comprising a grate surface facing out of the base trough and the first trough, the grate surface profiled with a plurality of grate apertures configured to allow a flow of water through the grate surface.

9. The linear drain assembly of claim 8, wherein the drain grate further comprises adjustable legs, the adjustable legs threadedingly coupled with the drain grate and configured to engage one of the base portion and the first peripheral portion.

10. A linear drain assembly comprising:

a base portion comprising:

a first base end;

a second base end;

a base trough extending between the first base end and the second base end;

an outlet body in fluid communication with the base trough and extending away from the base portion in a first direction; and a base flange extending away from the base portion, the base flange defining a base flange width; and a first peripheral portion comprising:

a first peripheral end;

a second peripheral end;

a first wall, a second wall, and a third wall defining a first trough; and a first flange extending away from the first trough and defining a first flange width, the first flange width greater than the base flange width;

wherein the first peripheral portion is slidable along the base portion when the first trough is nested within the base trough.

11. The linear drain assembly of claim 10, wherein the first peripheral portion is slidable relative to the base portion when the first flange abuts the base flange.

12. The linear drain assembly of claim 10, further comprising a leg assembly rotatably coupled with the first peripheral portion proximate to the first peripheral end, the leg assembly configured to adjust a distance between the first peripheral end and a surface upon which the leg assembly rests.

13. The linear drain assembly of claim 12, wherein the leg assembly is coupled with both the first wall and the second wall.

14. A method of assembling a linear drain assembly, the method comprising:

positioning a first peripheral portion within a base portion;

sliding the first peripheral portion within the base portion to a desired position;

coupling the first peripheral portion to the base portion;

cutting a drain grate to fit within the first peripheral portion and the base portion; and positioning the drain grate within both the first peripheral portion and the base portion.

15. The method of claim 14, further comprising:

positioning a second peripheral portion within the base portion;

sliding the second peripheral portion within the base portion to a desired position;

coupling the second peripheral portion to the base portion; and positioning the drain grate within all of the first peripheral portion, the second peripheral portion, and the base portion.

16. The method of claim 15, further comprising:

forming a first watertight seal between the first peripheral portion and the base portion; and forming a second watertight seal between the second peripheral portion and the base portion such that the first peripheral portion, the second peripheral portion, and the base portion cooperate to form a single watertight trough.

17. The method of claim 16, wherein the step of forming the first watertight seal between the first peripheral portion and the base portion comprises:

disposing a liquid sealant on at least one of the base portion and the first peripheral portion; and positioning the first peripheral portion within the base portion to squeeze the liquid sealant between the first peripheral portion and the base portion and form the first watertight seal.

18. The method of claim 14, wherein:

the first peripheral portion includes a first flange and a first ledge cooperating to define a first cavity, the first ledge having a first aperture configured to receive a fastener; and the base portion includes a base flange configured to be received within the first cavity;

the method further comprising:

positioning the base flange within the first cavity;

threading a fastener through the first aperture and engaging the base portion with the fastener to couple the first peripheral portion with the base portion.

19. The method of claim 14, wherein the drain grate includes adjustable feet that engage with one of the base portion and the first peripheral portion, the method further comprising:

extending a tool through the drain grate to engage the adjustable feet to adjust the height of the drain grate relative to the base portion.

* * * * *